US012635843B2

(12) United States Patent
Clouse et al.

(10) Patent No.: US 12,635,843 B2
(45) Date of Patent: May 26, 2026

(54) MAGNETIC APPARATUS FOR BATHROOM FIXTURES AND DEVICES

(71) Applicant: Kohler Co., Kohler, WI (US)

(72) Inventors: Kathryn L. Clouse, Howards Grove, WI (US); Helene L. Cornils, Lafayette, IN (US); Brianna L. Crotty, Adell, WI (US); Diego A. Cuervo Ayala, Sheboygan Falls, WI (US); Amber L. Hall Nelson, Grand Rapids, MI (US); Jason M. Kwacz, Kohler, WI (US); Jesse N. Lemel, Bayside, WI (US); John O. Lipinski, Sheboygan, WI (US); Dustin Lobner, Port Washington, WI (US); Katerina A. Revelis, Sheboygan, WI (US); Mark Schibur, Kohler, WI (US); Erich Slothower, Kohler, WI (US); Andrew L. Smith, Sheboygan, WI (US); Jennifer L. Tarplee, Sheboygan Falls, WI (US); Yunjie Zhang, Orlando, FL (US); Rebecca Becker, Kohler, WI (US); Lindsay Hartman, Kohler, WI (US); Aaron Mitchell, Kohler, WI (US)

(73) Assignee: Kohler Co., Kohler, WI (US)

( * ) Notice: Subject to any disclaimer, the term of this patent is extended or adjusted under 35 U.S.C. 154(b) by 21 days.

(21) Appl. No.: 18/211,329

(22) Filed: Jun. 19, 2023

(65) Prior Publication Data

US 2023/0404352 A1 Dec. 21, 2023

Related U.S. Application Data

(60) Provisional application No. 63/353,069, filed on Jun. 17, 2022.

(51) Int. Cl.
*A47L 11/40* (2006.01)
*A47L 11/38* (2006.01)

(52) U.S. Cl.
CPC ..... *A47L 11/4083* (2013.01); *A47L 11/38* (2013.01); *A47L 11/4091* (2013.01); (Continued)

(58) Field of Classification Search
CPC ..... B08B 3/024; B08B 13/00; B08B 1/145; B08B 1/12; A47L 11/4083; A47L 11/38; (Continued)

(56) References Cited

U.S. PATENT DOCUMENTS 5,785,913 A 7/1998 Clark, Jr. et al.
6,605,661 B2 8/2003 Hamami
(Continued)

FOREIGN PATENT DOCUMENTS

CN 101092529 B 7/2010
CN 109044197 A * 12/2018 ..... A47L 9/04
(Continued)

*Primary Examiner* — Katina N. Henson
(74) *Attorney, Agent, or Firm* — Lempia Summerfield Katz LLC

(57) ABSTRACT

The following embodiments include magnetic based devices, systems, and techniques applicable in a bathroom setting or a kitchen setting. A magnetic cleaning system is configured to clean a surface in the bathroom setting or kitchen setting. A magnetic mounting assembly is configured to mount a magnetic accessory. A cabinet includes the magnetic mounting assembly. A shower panel may include one or more magnetic acoustic shower tiles. A levitating drain stopper system for a basin is configured to magnetic open or close an opening in the basin. A magnetic water steering device is configured to magnetically direct water in a predetermined path.

14 Claims, 65 Drawing Sheets

(52) U.S. Cl.
CPC ... *A47L 2201/022* (2013.01); *A47L 2201/024* (2013.01); *A47L 2201/026* (2013.01)

(58) Field of Classification Search
CPC ..... A47L 2201/026; A47L 2201/024; A47L 2201/022; A47L 11/4091; B25J 11/00
USPC ..... 15/49.1
See application file for complete search history.

(56) References Cited

U.S. PATENT DOCUMENTS

| | | | |
|---|---|---|---|
| 8,354,145 | B2 | 1/2013 | De Rydt et al. |
| 8,696,031 | B2 | 4/2014 | Despland et al. |
| 8,895,133 | B2 | 11/2014 | Nesbitt |
| 9,199,502 | B2 | 12/2015 | Degott et al. |
| 9,724,956 | B2 | 8/2017 | Schmid et al. |
| 9,834,028 | B2 | 12/2017 | Degott et al. |
| 9,849,713 | B2 | 12/2017 | Schmid et al. |
| 10,052,903 | B2 | 8/2018 | Loginov et al. |
| 10,279,618 | B2 | 5/2019 | Degott et al. |
| 10,328,739 | B2 | 6/2019 | Loginov et al. |
| 10,500,889 | B2 | 12/2019 | Li et al. |
| 10,610,888 | B2 | 4/2020 | Nikseresht Ghanepour et al. |
| 10,737,526 | B2 | 8/2020 | Loginov et al. |
| 10,780,456 | B2 | 9/2020 | Kim |
| 10,850,305 | B2 | 12/2020 | Loginov et al. |
| 10,906,066 | B2 | 2/2021 | Loginov et al. |
| 10,933,442 | B2 | 3/2021 | Schmid et al. |
| 10,981,401 | B2 | 4/2021 | Loginov et al. |
| 11,065,906 | B2 | 7/2021 | Amerasinghe et al. |
| 2013/0320024 | A1 | 12/2013 | Perillon et al. |
| 2015/0217594 | A1 | 8/2015 | Pieters et al. |
| 2015/0296936 | A1 | 10/2015 | Demange et al. |
| 2017/0305184 | A1 | 10/2017 | Muller |
| 2018/0213993 | A1* | 8/2018 | Lindeque ..... A47L 11/22 |
| 2019/0217335 | A1 | 7/2019 | Nikseresht Ghanepour et al. |
| 2020/0017737 | A1 | 1/2020 | Roosen |
| 2020/0215844 | A1 | 7/2020 | Amerasinghe et al. |
| 2020/0254484 | A1 | 8/2020 | Amerasinghe et al. |
| 2020/0329941 | A1* | 10/2020 | Buehler ..... A47L 11/4083 |
| 2020/0346479 | A1 | 11/2020 | Schmid et al. |
| 2021/0024759 | A1 | 1/2021 | Robinson et al. |
| 2021/0088959 | A1 | 3/2021 | Schmid et al. |
| 2021/0245197 | A1 | 8/2021 | Amerasinghe et al. |
| 2021/0308718 | A1 | 10/2021 | Nikseresht Ghanepour et al. |
| 2021/0319937 | A1 | 10/2021 | Nikseresht Ghanepour et al. |

FOREIGN PATENT DOCUMENTS

| | | | | |
|---|---|---|---|---|
| DE | 2010831 | A1 | 9/1971 | |
| GB | 2495788 | A * | 4/2013 | ..... A47L 11/00 |
| JP | 2009007800 | A | 1/2009 | |
| WO | 2018234659 | A1 | 12/2018 | |
| WO | 2019215148 | A1 | 11/2019 | |
| WO | 2020025218 | A1 | 2/2020 | |
| WO | 2020025482 | A1 | 2/2020 | |
| WO | 2020160993 | A1 | 8/2020 | |
| WO | 2020193009 | A1 | 10/2020 | |
| WO | WO-2022200524 | A2 * | 9/2022 | ..... A47L 11/4083 |

* cited by examiner

MAGNETIC APPARATUS FOR BATHROOM FIXTURES AND DEVICES

CROSS-REFERENCE TO RELATED APPLICATIONS

This application claims priority benefit of Provisional Application No. 63/353,069 filed Jun. 17, 2022, which is hereby incorporated by reference in its entirety.

FIELD

The present application relates to magnetic apparatuses for use in a bathroom or kitchen setting.

BACKGROUND

A magnet is a material or object that creates a magnetic field. A permanent magnet is an object or material that is magnetized and creates its own magnetic field. A temporary magnet only maintains its magnetic field at certain times such as when in the presence of a permanent magnetic field or electric current. An electromagnet may create a magnetic field only at such time such as when it is connected to an electrical current. Although ferromagnetic materials (e.g., iron, nickel, cobalt) are the only materials attracted to a magnet strongly enough to be considered magnetic, other substances respond weekly to a magnetic field. These other substances may include objects less traditionally viewed as magnetic such as wood, water, and particles suspended in water. Typically, magnetic fields have no impact on non-ferromagnetic materials; however, small forces applied in specific situations may provide useful features in the following embodiments.

BRIEF DESCRIPTION OF THE DRAWINGS

Exemplary embodiments are described herein with reference to the following drawings, according to an exemplary embodiment.

DETAILED DESCRIPTION

The following embodiments include magnetic based devices, systems, and techniques applicable in a bathroom setting or a kitchen setting. Various embodiments are described and illustrated separately. However, each of these embodiments are usable together in a single implementation, device, or system. It should be understood that the present disclosure is not limited to the details and methodology set forth in the detailed description or illustrated in the figures. It should be understood that the terminology used herein is for the purpose of description only and should not be regarded as limiting.

When a component, element, device, or the like of the present disclosure is described as having a purpose or performing an operation, function, or the like, the component, device, or element should be considered herein as being "configured to" meet that purpose or to perform that operation or function.

Molded Solid Surface and Ferrous Material

Natural and engineered stone surfaces have desirable aesthetics including natural veins and distinct geometric patterns. However, natural and engineered stone surfaces are expensive. Production of natural stone surfaces requires access to stone quarries and stone surfaces are limited to flat surfaces that must be sealed. Additionally, production of natural and engineered stone surfaces requires the use of expensive specialized equipment. Accordingly, there exists a need for inexpensive solid surface products having desirable aesthetics Described herein are apparatuses including a molded solid surface and ferrous particles and methods of manufacturing molded solid surfaces including ferrous particles. More specifically, the present disclosure describes methods of manufacturing molded solid surfaces including ferrous particles, wherein a predetermined pattern and/or a docking location are created in the molded solid surface by applying a force to the ferrous particles using a localized magnetic field (i.e., one or more permanent magnets, temporary magnets, electromagnets, and the like). Any magnets described in the disclosure may be neodymium, electromagnets, or another type of magnet. The apparatuses including a molded solid surface and ferrous particles may provide a solid surface with desirable aesthetics. The apparatuses may provide less expensive alternatives to natural and engineered stone surfaces.

Figure 1:
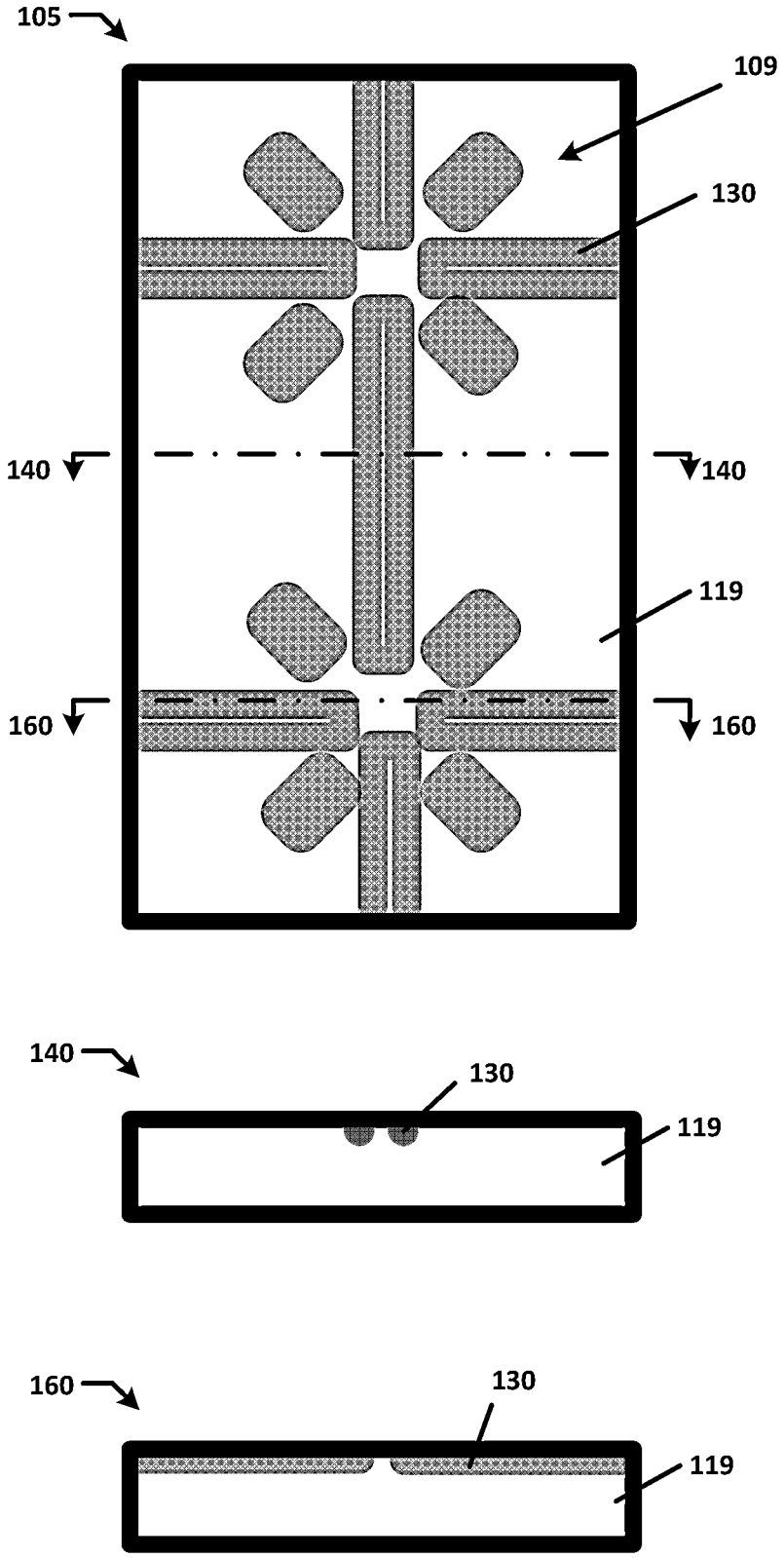
FIG. 1 illustrates an apparatus including a molded solid surface and ferrous material according to an exemplary embodiment of the present disclosure.

FIG. 1 illustrates an apparatus including a molded solid surface and ferrous particles according to an exemplary embodiment of the present disclosure. FIG. 1 illustrates a front view of an apparatus 105 comprising a molded solid surface 119 and ferrous particles 130 injection molded within a portion of the molded solid surface 119 formed of resinous material. In other embodiments, the molded solid surface 119 including ferrous particles 130 may be manufactured using compression molding, resin transfer molding (RTM), gravity casting, extrusion, pultrusion, and the like. In embodiments, where the ferrous particles 130 are injection molded within the molded solid surface 119, the ferrous particles 130 may be mixed with the resinous material and injected into a mold. The ferrous particles 130 may be drawn to a surface of the mold with a magnet before the resinous material is cured into the molded solid surface 119. In embodiments where the molded solid surface is manufactured using extrusion or pultrusion, the ferrous particles may be drawn to a surface of the extruded or formed material (e.g., a solid surface of the extruded or formed material). In some embodiments and as illustrated in FIG. 1, the ferrous particles 130 may create a predetermined pattern 109 in the molded solid surface 119. In other embodiments, the ferrous particles 130 may create a docking location in the molded solid surface 119. The docking location may be configured to secure an accessory including a magnet to the molded solid surface 119.

The molded solid surface 119 as illustrated in FIG. 1 is a planar surface. The molded solid surface as illustrated in FIG. 1 may be one of a countertop, tile, wall (e.g., a shower wall), and a floor. In other embodiments, the molded solid surface 119 does not need to be a planar surface. For example, the molded solid surface 119 may be one of a sink, a toilet, and a faucet. The molded solid surface 119 may be any solid surface manufactured by molding a resinous material.

The portion of the molded solid surface 119 in which the ferrous particles 130 are injection molded comprises a resinous material. The resinous material may be an acrylic, polyester, urethane, epoxy, or hybrid composite, or other suitable resin. The apparatus 105 illustrates the portion of the molded solid surface 119 comprising resinous material in a state in which the resinous material has cured into a solid surface. In some embodiments, the resinous material may be a transparent or semitransparent material when cured. In other embodiments, the resinous material may be opaque when cured. In some embodiments, resinous material may include a colorant such that the resinous material has a colored appearance when cured. The resinous material may be configured to provide a desired exterior finish when cured.

The ferrous particles 130 in the portion of the molded solid surface 119 comprised of resinous material may be ferromagnetic particles. The ferrous particles may be one of iron, nickel, cobalt, and their alloys. In some embodiments, the ferrous particles 130 may be iron dust. In some embodiments, the ferrous particles 130 may be recovered from a manufacturing waste stream of another product. For example, the ferrous particles 130 may be recovered from a foundry waste stream.

The predetermined pattern 109 formed by the ferrous particles 130 in the portion of the molded solid surface 119 formed of a resinous material is an intentional manipulation of the location of the ferrous particles 130 within the resinous material. The predetermined pattern 109 may create an aesthetic design in the molded solid surface. In some embodiments the predetermined pattern 109 may be a repeating pattern on the molded solid surface. However, the predetermined pattern 109 does not need to be a repeating pattern.

A cross section of the apparatus 105 taken along line 140 is illustrated. The ferrous material 130 is located near a surface of the molded solid surface 119. The ferrous material 130 located near the surface of the molded solid surface may create the predetermined pattern 109 in the molded solid surface. The ferrous particles 130 may be visible through the transparent or semitransparent cured resinous material allowing a user to see the predetermined pattern 109.

A cross section of the apparatus 105 taken along like 160 is illustrated. The ferrous particles 130 located near a surface of the molded solid surface 119. The cross section 160 is at a different location along the apparatus 105 where the ferrous particles 130 forming the predetermined pattern 109 are present at locations different than those illustrated with respect to cross section 140.

Figure 2:
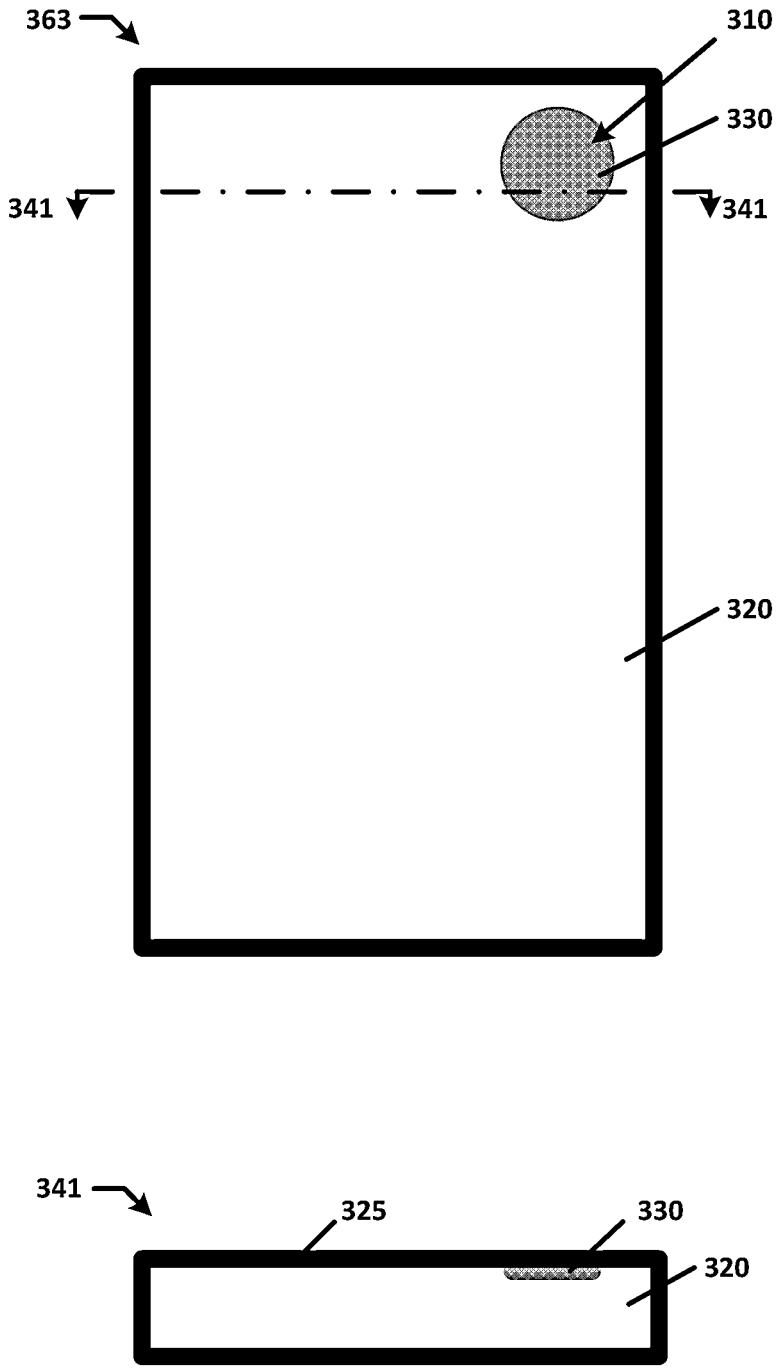
FIG. 2 illustrates an apparatus including a molded solid surface and ferrous material according to an exemplary embodiment of the present disclosure.

FIG. 2 illustrates an apparatus 363 including a molded solid surface 320 and ferrous particles 330 according to an exemplary embodiment of the present disclosure. FIG. 2 illustrates a front view of the apparatus 363 comprising a molded solid surface 320 and ferrous particles 330 injection molded within a portion of the molded solid surface formed of resinous material. The molded solid surface 320 and ferrous particles 330 may be the same as those discussed above with reference to apparatus 105 and FIG. 1. The resinous material may be the same as that discussed above with respect to apparatus 105 and FIG. 1. As illustrated in FIG. 2, the ferrous particles 330 create a docking location 310 in the molded solid surface 320.

The docking location 310 formed by the ferrous particles 130 in the portion of the molded solid surface 320 formed of resinous material is configured to secure (e.g., mount) an accessory including a magnet to the molded solid surface 320. In some embodiments, the accessory may be a soap dispenser, or a container configured to store a kitchen or bathroom implement. In some embodiments, the accessory may be a kitchen appliance, such as a coffee maker, a toaster, a toaster oven, and the like. In some embodiments, the accessory may be a kitchen accessory such as a cutting board, a knife block, a trivet, and the like. A kitchen implement may be one of a knife, a fork, a spoon, a cooking utensil (e.g., a spatula, a whisk, etc.), and the like. In some embodiments, the accessory may be a bathroom appliance such as a toothbrush (or toothbrush stand), a hair dryer, an electric razor, or the like. A bathroom implement may be one of a toothbrush, a brush, a comb, tweezers, cotton swabs, and the like. In some embodiments, the accessory may be a vanity and the apparatus may be configured to secure itself to the top of the vanity. For example, the apparatus may be a countertop and the countertop may be configured to secure itself to the vanity (e.g., during installation of the countertop. In some embodiments, the docking location 310 may be visible within the molded solid surface 320. The vanity or sink may also include magnetic drain stoppers as described herein.

In some embodiments, the docking location 310 may not be visible within the molded solid surface 320. A cross section of the apparatus 363 taken along line 340 illustrates the ferrous material 330 is located near a surface 325 of the molded solid surface 320. The ferrous material 330 located near the surface 325 of the molded solid surface 320 may form the docking location 310. The apparatus 363 may be configured to secure an accessory including a magnet to the molded solid surface 320. The magnet in the accessory may be attracted to the ferrous material 330 in the apparatus 363, thereby securing the accessory to the molded solid surface 320. In some embodiments, a magnet may be included in the apparatus 363 and the accessory may include a ferromagnetic material.

In some embodiments, magnetic components (e.g., permanent magnets) may be embedded in the molded solid surface. Magnetic components may be embedded in the molded solid surface to secure (e.g., mount) accessories including ferrous components to the molded solid surface. Accordingly, a molded solid surface including a magnet embedded therein may be configured to secure (e.g., mount) any of the accessories described above or below as including a magnet by including a ferrous material in the accessory described as including a magnet. For example, a soap dispenser including a ferrous component, or a container configured to store a kitchen, or a bathroom implement including a ferrous component may be secured or mounted to a molded solid surface including a magnet embedded therein. In some embodiment, objects including ferrous components may be secured to a molded solid surface including a magnet embedded therein. For example, pens, paper clips, and the like may be secured to the molded solid surface. In some embodiments, a molded solid surface may include both ferrous particles 330 and a magnetic component.

In some embodiments, the molded solid surface may be one of a tile. In embodiments where the molded solid surface is one of a tile, the docking location formed in the tile may be configured to secure an accessory including a magnet to the tile. For example, a shelf, a dispenser (e.g., a soap dispenser, a shampoo dispenser, a conditioner dispenser, and the like), or a container configured to store a kitchen and/or bathroom implement may be secured to the tile. In other embodiments, the docking location formed in the tile may be configured to secure a mat, a rug, a garbage can, or a toilet brush holder.

In some embodiments where the molded solid surface is one of a sink, the molded solid surface may form the basin of the sink. In embodiments where the basin of a sink has a rectangular or substantially rectangular shape, the mold solid surface may form the bottom and/or walls of the basin. In some embodiments, the molded solid surface may be a strainer, strainer basket, or drain stopper for a sink. Accordingly, a predetermined pattern may be formed in any of the basin, walls, bottom, strainer, strainer basket and/or stopper. Similarly, a docking location may be formed in any of the basin, walls, bottom, strainer, strainer basket, and/or stopper for a sink. For example, a docking location on the basin and/or wall of the sink may be configured to secure an accessory such as a basket for holding a sponge, soap, or the like. In another example, the strainer may be configured to secure a strainer basket and/or stopper.

In some embodiments, where the molded solid surface is one of a toilet, the molded solid surface may form one or more parts of a flush engine for a toilet, for example, an interior of the bowl, a rim, sump, and or trapway and the like. In other embodiments, the molded solid surface may one or more parts of a surrounding shell of the toilet, for example, a shroud, pedestal, cover, and the like. The cover may be configured to cover an exterior surface of the bowl, sump, trapway, and the like. In some embodiments, the molded solid surface may form one or more components of the surrounding shell and may be over molded on an outer surface of the flush engine. In some embodiments, the molded solid surface may form a tank or cover for a toilet tank. Accordingly, a predetermined pattern may be formed in an interior of the bowl, rim, sump, trapway, shroud, pedestal, cover, tank, or tank cover. Similarly, a docking location may be formed in an interior of the bowl, rim, sump, trapway, shroud, pedestal, cover, tank, or tank cover. For example, a docking location may be formed in the interior of the toilet bowl to dispense a cleaning agent into the bowl. In another example, a docking location may be formed in the tank cover to secure an air freshener or the like to the tank cover.

In some embodiments where the molded solid surface is one of a faucet, the molded solid surface may be one or more surfaces of the faucet body and/or faucet handle. In some embodiments, the faucet body may be configured to receive a faucet handle and/or a plumbing network (e.g., internal waterways, aerator, valve system, valve cartridge). For example, the faucet body may extend vertically concealing portions of the plumbing network (e.g., an internal waterway and/or a valve system) and may extend horizontally and/or vertically concealing another portion of the plumbing network (e.g., a faucet spout). In other embodiments, the faucet body may be formed around the valve cartridge and plumbing network, for example, via injection molding, compression molding, resin transfer molding (RTM), gravity casting, and the like. The faucet body may be configured to give the faucet a desirable finish and/or aesthetic (e.g., shape, texture, color, etc.). Accordingly, a predetermined pattern may be formed in the faucet body and/or the faucet handle. Similarly, a docking location may be formed in the faucet body and/or the faucet handle. For example, a docking location may be formed in the faucet body to secure a water filter or the like to the end of a faucet.

Figure 3:
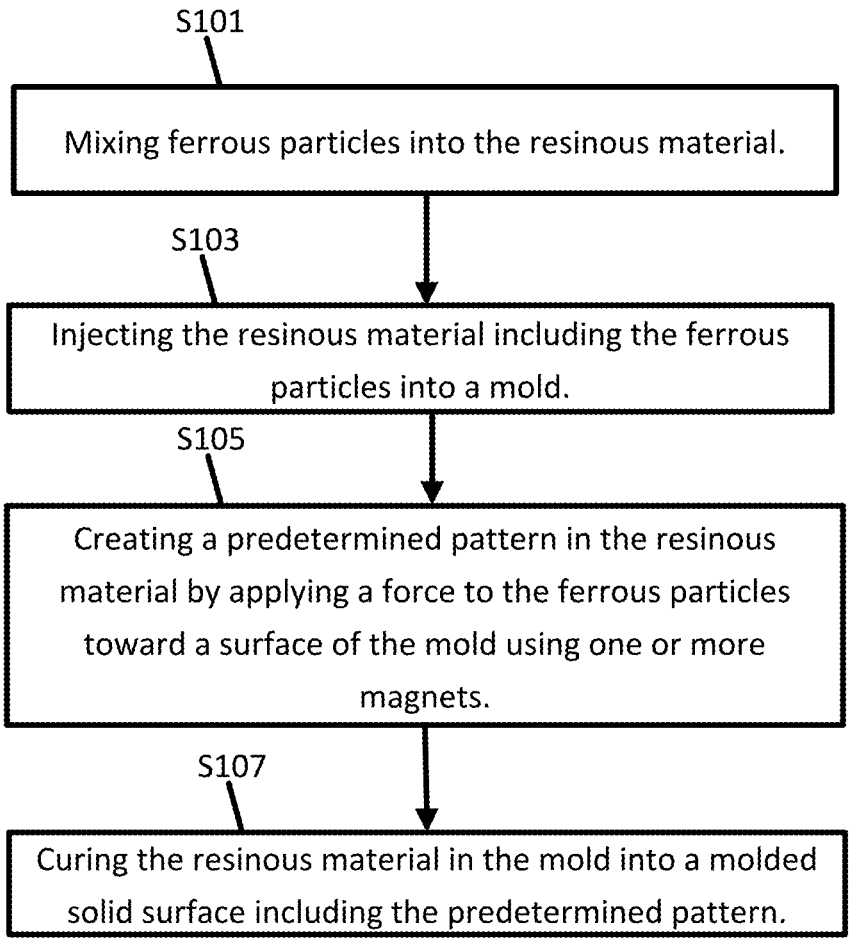
FIG. 3 illustrates a flow chart for manufacturing a molded solid surface according to an exemplary embodiment of the present disclosure.

FIG. 3 illustrates a flow chart for manufacturing a molded solid surface according to an exemplary embodiment of the present disclosure. The various systems and apparatuses disclosed herein may employ the method of FIG. 3. Additional different or fewer acts may be provided.

At act S101, ferrous particles are mixed into the resinous material. The ferrous particles and resinous material may be the same as those discussed above with respect to FIGS. 1 and 2. At act S101, the resinous material may be in a liquid phase and comprise a mixture of two or more liquids. For example, one of the liquids may include the epoxy groups used and another liquid may be a hardener (e.g., an epoxy curing agent). The ferrous particles may be mixed into the resinous material while the resinous material is in a liquid phase. The ferrous particles may be mixed into the resinous material such that they are distributed throughout the resinous material. In some embodiments, a filler material and/or a colorant may further be mixed into the resinous material.

At act S103, the resinous material including the ferrous particles is injected into a mold. The mold may comprise a top mold half and a bottom mold half. At act S103, the mold may be closed, such that the top mold half and the bottom mold half form a sealed, enclosed space having the desired shape of the molded solid surface. For example, the desired shape may be one of a countertop, tile, wall, floor, toilet, faucet, and the like. The resinous material including the ferrous particles may be injected into the mold through an injection channel. The injection channel may be fluidly connected the top half and/or the bottom half of the mode such that the interior of the molded is filled with the resinous material including the ferrous particles during injection. The resinous material including the ferrous particles may be injected into the mold under pressure such that the entire interior of the mold is filled.

At act S105, a predetermined pattern is created in the resinous material by applying a force to the ferrous particles toward a surface of the mold using one or more magnets. One or more magnets may be provided in the mold or proximate to the mold such that the magnets apply a magnetic force to the ferrous particles in the resinous material after the resinous material is injected into the mold. The one or more magnets may be configured to apply a force to the ferrous particles such that the ferrous particles accumulate at specific locations near a surface of the mold. The one or more magnets may be one of permanent magnets and electromagnets. The one or more magnets may have specific intensities (e.g., create a magnetic field of a certain strength) and be placed at specific locations relative to the mold such that a predetermined pattern is created in the resinous material (and subsequently the molded solid surface) by moving (e.g., pulling, pushing, drawing) the ferrous particles toward a surface of the mold using the applied magnetic force. In some embodiments, the ferrous particles may be moved toward a surface of the mold as to be visible within the molded solid surface proximate to the surface of the mold toward which the ferrous particles are moved (i.e., visible concentrations of ferrous particles may be formed). Areas of the molded solid surface corresponding to areas in the mold in which the ferrous particles are moved toward a surface of the mold may have a relatively dark shade due to a relatively high concentration of ferrous particles. In some embodiments, the ferrous particles may be moved away from a surface of the mold as to not be visible within the molded solid surface proximate to the surface of the mold from which the ferrous particles are moved away from (i.e., all visible particles may be removed from an area). Areas of the molded solid surface corresponding to areas in the mold in which the ferrous particles are moved away from a surface of the mold may have a relatively light shade due to a relatively low concentration of ferrous particles. In some areas of the mold particles may not be moved toward or away from a surface of the mold. Areas of the molded solid surface corresponding to areas of the mold where the ferrous particles are neither moved toward or away from a surface of the mold may have a medium shade due to the medium concentration of ferrous particles. In some embodiments, the ferrous particles may be moved toward a surface of the mold in some areas, moved away from the same surface of the mold in other areas, and not moved toward or away from the same surface in different areas. Accordingly, a predetermined pattern including three different shades may be formed in the molded solid surface. The one or more magnets may be configured to apply a force the ferrous particles such that the ferrous particles remain a specified distance away from a surface of the mold. The resinous material may be transparent or semitransparent when cured and the ferrous particles may have a color different than that of the resinous material when cured such that a user may see the predetermined pattern created in the resinous material after the molded solid surface has cured.

In some embodiments, the one or more magnets may move toward and/or away from one of the upper mold half and the lower mold half to create the predetermined pattern. In some embodiments, the one or more magnets may move along a surface of one of the upper mold half and the lower mold half to form the predetermined pattern. In some embodiments, the one or more magnets may move along a plane perpendicular to a surface of one of the upper mold half and the lower mold half to create the docking location.

At act S107, the resinous material including the ferrous particles is cured into the molded solid surface including the predetermined pattern. The resinous material may cure into an apparatus including a molded solid surface with ferrous particles forming a predetermined pattern injection molded within a portion of the molded solid surface formed from a resinous material. In some embodiments, the resinous material may begin curing during creation of the predetermined pattern (act S105). In some embodiments, the resinous material may be cured at an elevated temperature. For example, one of the upper mold half and the lower mold half may be at an elevated during injection molding (act S103), creation of the predetermined pattern (act S105), and curing of the resinous material (act S107).

The resinous material may be cured into a transparent or semitransparent molded solid surface such that predetermined pattern comprising the ferrous particles is visible within the molded solid surface. The resinous material may be configured such that the molded solid surface has specific color after curing. The resinous material may be configured such that the cured molded solid surface has desirable surface characteristics (e.g., stain resistance, heat resistance, abrasion resistance, and the like).

In some embodiments, the method of manufacturing a molded solid surface further includes separating the upper mold half and the lower mold half and removing the molded solid surface from one of the upper mold half and the lower mold half.

Figure 4:
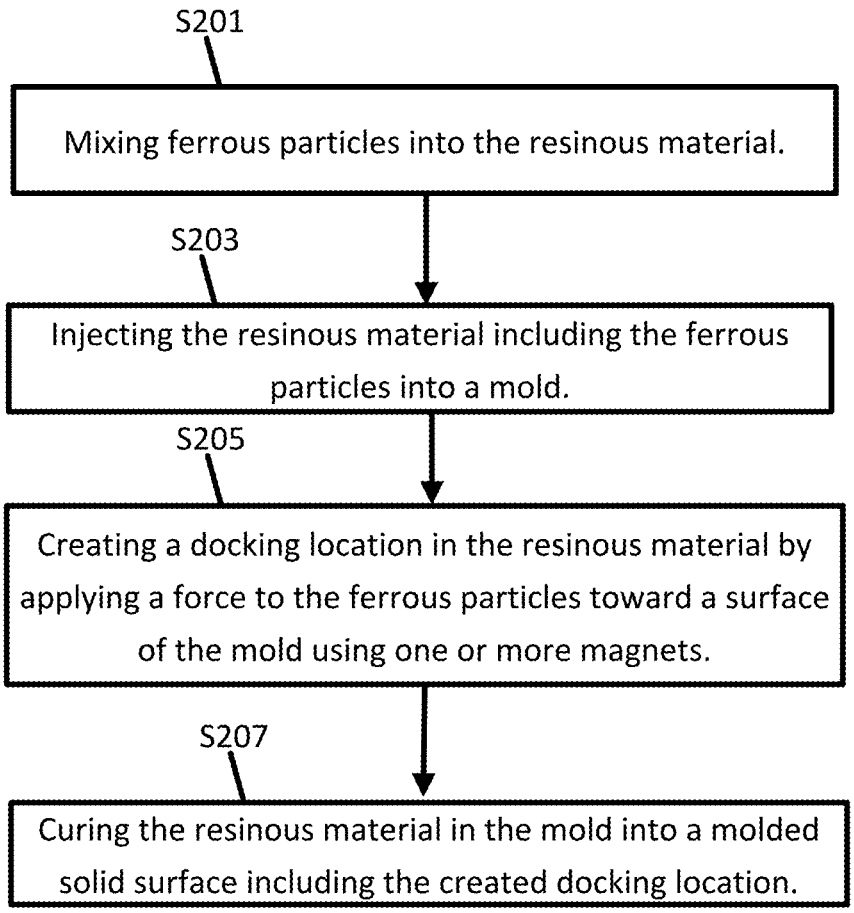
FIG. 4 illustrates a flow chart for manufacturing a molded solid surface according to an exemplary embodiment of the present disclosure.

FIG. 4 illustrates a flow chart for manufacturing a molded solid surface according to an exemplary embodiment of the present disclosure. The various systems and apparatuses disclosed herein may employ the method of FIG. 4. Additional different or fewer acts may be provided.

At act S201, ferrous particles are mixed into the resinous material. The ferrous particles and resinous material may be the same as those discussed above with respect to FIGS. 1-3. In some embodiments, act S201 may be the same as act S101 discussed above with respect to FIG. 3.

At act S203, the resinous material including the ferrous particles is injected into a mold. The mold may be the same as the mold discussed above with reference to FIG. 3. In some embodiments, the act S203 may be the same as the act S103 discussed above with respect to FIG. 3.

At act S205, a docking location is created in the resinous material by applying a force to the ferrous particles toward the surface of the mold using one or more magnets. The one or more magnets may be provided in one of the upper mold half and the lower mold half or proximate to one of the upper mold half and the lower mold half. The one or more magnets may be one of permanent magnets and electromagnets. In some embodiments, the one or more magnets may move toward and/or away from one of the upper mold surface and the lower mold surface to create the docking location. In some embodiments, the one or more magnets may move along a surface of one of the upper mold surface and the lower mold surface or along a plane perpendicular to a surface of one of the upper mold half and the lower mold half to create the docking location.

The one or more magnets may be configured to apply a magnetic force to the ferrous particles in the resinous material toward a surface of one of the upper mold half and the lower mold half. The one or more magnets may be configured to apply a magnetic force to the ferrous particles so that the ferrous particles accumulate at one or more locations forming the docking location. The one or more magnets may have specific intensities (e.g., create a magnetic field of a certain strength) and be placed at specific locations relative to the mold such that the docking location is created in the resinous material (and subsequently the molded solid surface) by moving (e.g., pulling, pushing, drawing) the ferrous particles toward a surface of the mold using the applied magnetic force. The one or more magnets may be configured to apply a force the ferrous particles such that the ferrous particles remain a specified distance away from a surface of the mold. The magnets may be configured to apply a force to the ferrous particles such that a magnet in an accessory may secure the accessory to the ferrous particles of a cured molded solid surface. In some embodiments, the resinous material may be transparent or semitransparent when cured.

At act S207, the resinous material including the ferrous particles is cured into the molded solid surface including the docking location. In some embodiments, the act S207 may be the same as the act S107 discussed above with respect to FIG. 3. The resinous material may cure into the molded solid surface such that a magnet included in an accessory is attracted to the ferrous particles in the molded solid surface such that the accessory is secured to the molded solid surface. The resinous material may be configured such that the cured molded solid surface has desirable surface characteristics (e.g., stain resistance, heat resistance, abrasion resistance, and the like). In some embodiments, the docking location may be visible within the molded solid surface.

In some embodiments, the method of manufacturing a molded solid surface further includes separating the upper mold half and the lower mold half and removing the molded solid surface from one of the upper mold half and the lower mold half.

Figure 5:
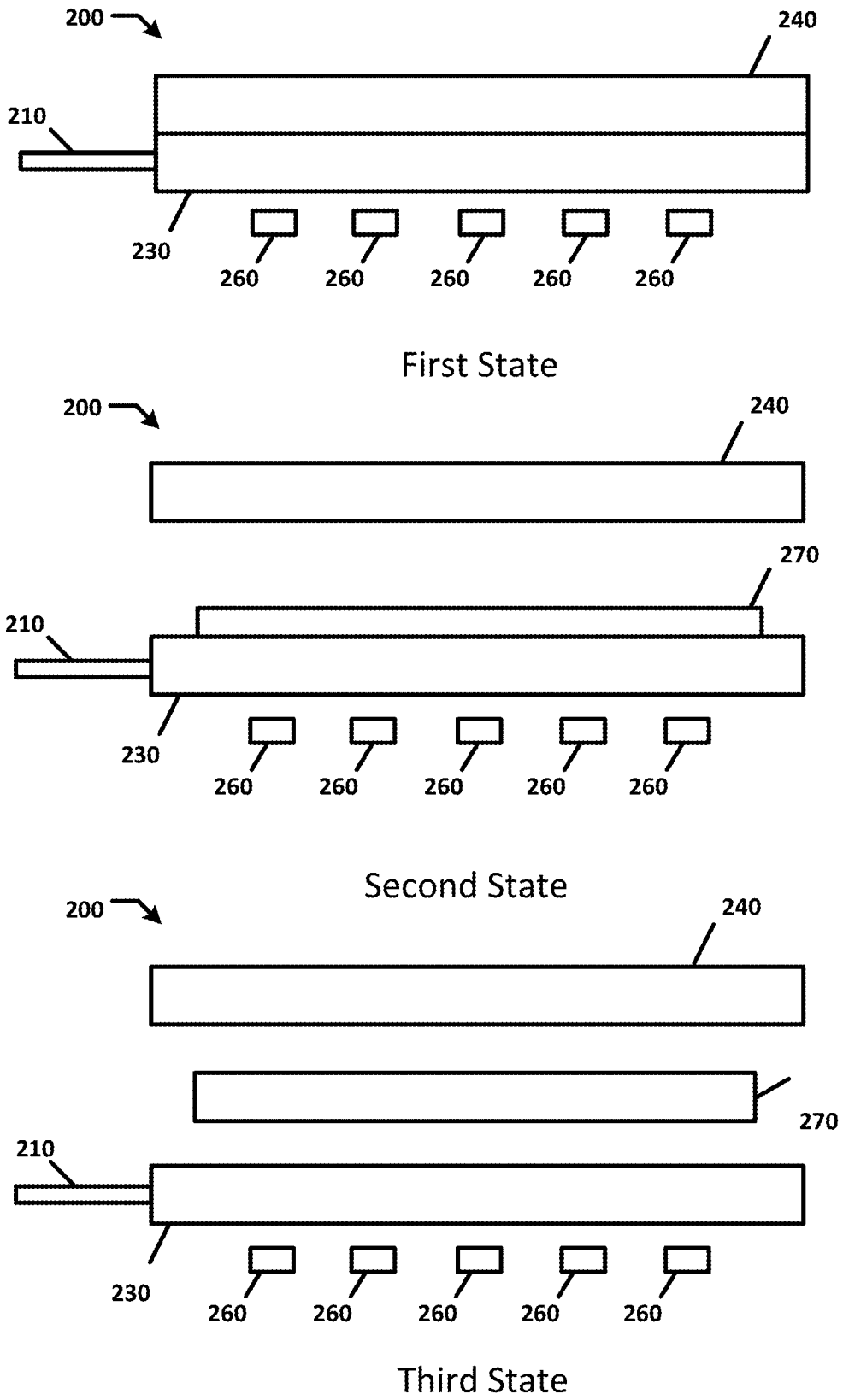
FIG. 5 illustrates a method for manufacturing a molded solid surface according to an exemplary embodiment of the present disclosure.

FIG. 5 illustrate one non-exclusive exemplary method of manufacturing a molded solid surface according to an exemplary embodiment of the present disclosure. The system 200 for manufacturing a molded solid surface as illustrated in FIG. 5 includes an injection channel 210, mold lower half 230, mold upper half 240, magnets 260, and molded solid surface 270. The injection channel 210 may be fluidly coupled to one of the lower mold half 230 and the upper mold half 240. The injection channel may be configured to supply a flow of resinous material including ferrous particles to one of the lower mold half 230 and the upper mold half 240. The lower mold half 230 and the upper mold half 240 may be removably coupled to one another. When coupled together, the lower mold half 230 and the upper mold half 240 may form a sealed, enclosed interior. The sealed, enclosed interior of the lower mold half 230 and the upper mold half 240 may form a desired shape of the molded solid surface. The desired shape of the molded solid surface may be one of a countertop, tile, wall, floor, toilet, and the like. The magnets 260 may be configured to apply a force to the ferrous particles toward a surface of one of the lower mold half 230 and the upper mold half 240. The magnets 260 may be configured to create a predetermined pattern and/or a docking location in the resinous material (and subsequently the molded solid surface after curing of the resinous material).

FIG. 5 illustrates the system 200 for manufacturing a molded solid surface including ferrous particles in a first state. In the first state, the lower mold half 230 and the upper mold half 240 are coupled to one another forming the sealed, enclosed interior having the desired shape of the molded solid surface. As illustrated in FIG. 1, the injection channel is fluidly coupled to the lower mold half 230. In other embodiments, the injection channel may be fluidly coupled to either the upper mold half 240 or both the lower mold half 230 and the upper mold half 240. In the first state, a mixture of resinous material and ferrous particles is supplied (e.g., injected) to the mold (i.e., the lower mold half 230 and the upper mold half 240) through the injection channel. The mixture of resinous material and ferrous particles may be supplied to the mold under pressure, filling the entire interior of the lower mold half 230 and the upper mold half 240 coupled to one another.

Additionally, in the first state, after the interior of the mold has been filled with the mixture of resinous material and ferrous particles, a predetermined pattern and/or a docking location comprising the ferrous particles may be formed in the resinous material. The magnets 260 may apply a magnetic force to the ferrous particles, moving (e.g., pushing, pulling) the ferrous particles toward a surface of the mold. As described above with respect to acts S105 and S205 of FIGS. 3 and 4 respectively, a magnetic force may be applied by the magnets during the first state, creating a predetermined pattern and/or a docking location in the resinous material.

Finally, in the first state, after a predetermined pattern and/or a docking location has been formed in the resinous material, the resinous material may cure into the molded solid surface including the predetermined pattern and/or the docking location. The resinous material may cure into the molded solid surface as described with respect to acts S107 and S207 of FIGS. 3 and 4 respectively. In some embodiments, one of the lower mold half and the upper mold half may further include heating elements configured to heat the lower mold half 230 and/or upper mold half 240. In some embodiments, the lower mold half 230 and/or the upper mold half 240 may be heated to increase the rate at which the resinous material cures. In other embodiments, one of the lower mold half 230 and/or the upper mold half 240 may be heated to increase the ductility of the resinous material entering the mold. In other embodiments, the resinous material may cure at room temperature. In some embodiments, a UV light may be applied to the resinous material to facilitate curing of the resinous material.

FIG. 5 illustrates the system 200 for manufacturing a molded solid surface including ferrous particles in in a second state. In the second state, the lower mold half 230 and the upper mold half 240 are no longer coupled to one another. In the second state, the molded solid surface 270 including the predetermined pattern and/or docking location formed (e.g., manufactured) in the first state is visible. In the second state, a portion of the molded solid surface 270 is in the mold lower half 230. The resinous material may be configured such that the molded solid surface 270 may have desirable surface characteristics (e.g., visible predetermined pattern, stain resistance, heat resistance, abrasion resistance, and the like).

FIG. 5 illustrates the system 200 for manufacturing the molded solid surface including ferrous particles in the third state. In the third state, the molded solid surface 270 has been removed from the mold lower half 230. As illustrated in the system 200, the molded solid surface 270 is planar. The molded solid surface 270 as illustrated in the embodiment of FIG. 5 may be one of a countertop, a tile, a wall, a floor, and the like. In other embodiments, the molded solid surface may be one of a toilet and a faucet. In other embodiments, the molded solid surface may be any surface capable of being molded using the resinous material.

Figure 6:
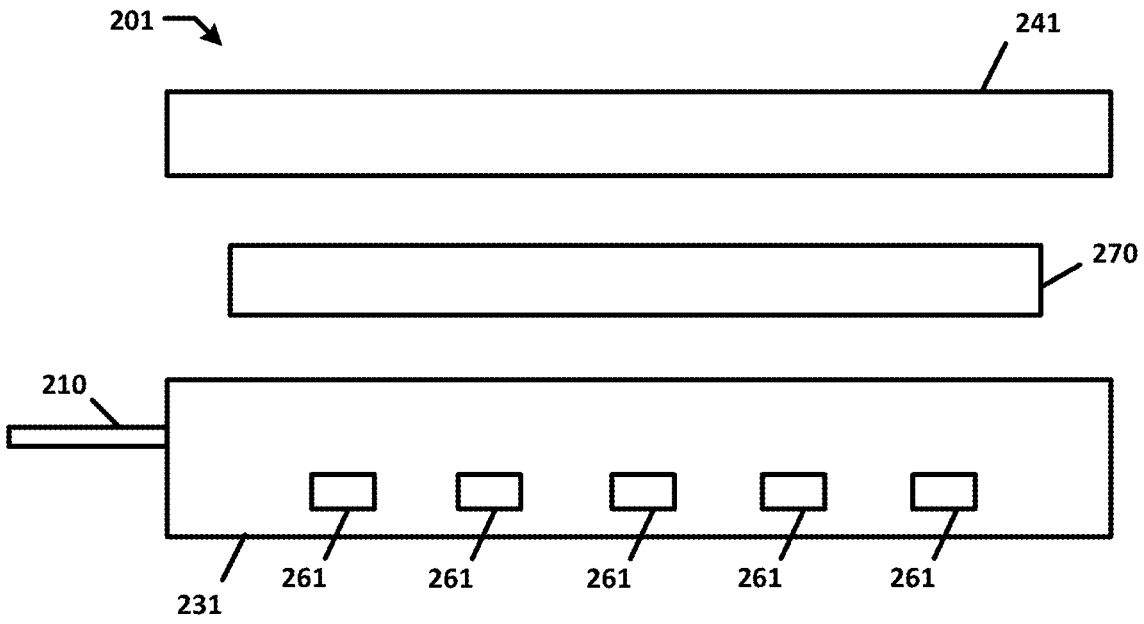
FIG. 6 illustrates a system for manufacturing a molded solid surface according to an exemplary embodiment of the present disclosure.

FIG. 6 illustrates a system 201 for manufacturing a molded solid surface including ferrous particles according to an embodiment of the present disclosure. The system 201 incudes injection channel 210, mold lower half 231, mold upper half 241, magnets 261, and molded solid surface 270. The injection channel 210, mold upper half 241, and molded solid surface 270 of FIG. 6 may be the same as those discussed above with respect to FIG. 5. The mold lower half 231 as illustrated in the embodiment of FIG. 6 includes magnets 261. The magnets 261 in the embodiment of FIG. 6 may be permanent magnets. The mold lower half 231 may include a gridwork in which the magnets 261 are inserted. The gridwork may include various location at which magnets may be inserted to create different predetermined patterns and/or docking locations in the molded solid surface.

Figure 7:
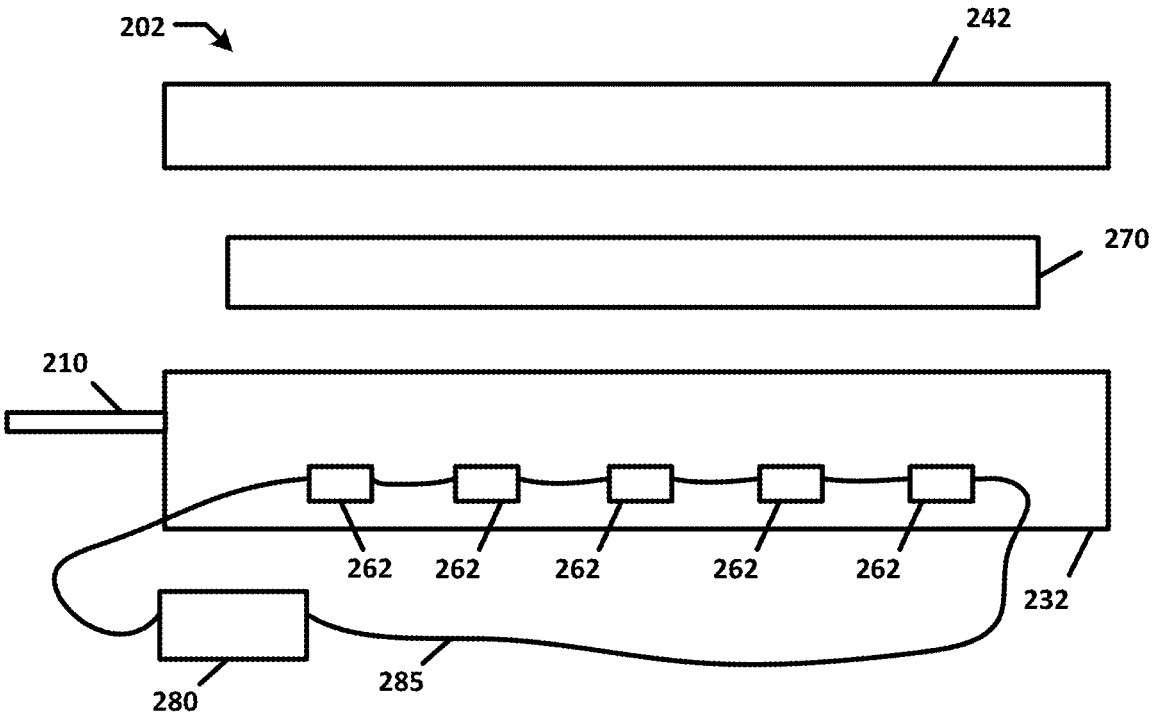
FIG. 7 illustrates a system for manufacturing a molded solid surface according to an exemplary embodiment of the present disclosure.

FIG. 7 illustrates a system 202 for manufacturing a molded solid surface including ferrous particles according to an embodiment of the present disclosure. The system 202 incudes injection channel 210, mold lower half 232, mold upper half 242, magnets 223, power source 280, wire 285, and molded solid surface 270. The injection channel 210, mold upper half 242, and molded solid surface 270 of FIG. 7 may be the same as those discussed above with respect to FIG. 5. FIG. 7 further includes mold lower half 232 including magnets 262, power source 280 and wire 285. In other embodiments, the magnets 261 may be located in the mold upper half 241.

The lower mold half 322 in the embodiment of system 202 includes magnets 262. The magnets 262 in the embodiment of system 202 may be electromagnets. The electromagnets 262 may be connected to one another and power source 280 by wire 285. The power source 280 may be configured supply a specific current or range of currents to the electromagnets so that the electromagnets have a desired intensity (e.g., create a magnetic field of a desired strength). In some embodiments, the power source may be one supplying either direct or alternating current. In some embodiments, the power source may be a battery. In other embodiments, wire 285 may be plugged into a power source such as a wall outlet. In some embodiments, the lower mold half may include two or more electromagnetic circuits configured to create different predetermined patterns and/or docking locations in the molded solid surface 270. In some embodiment, the magnets 262 connected to the power source 280 via wire 285 may be in the mold upper surface 252.

Figure 8:
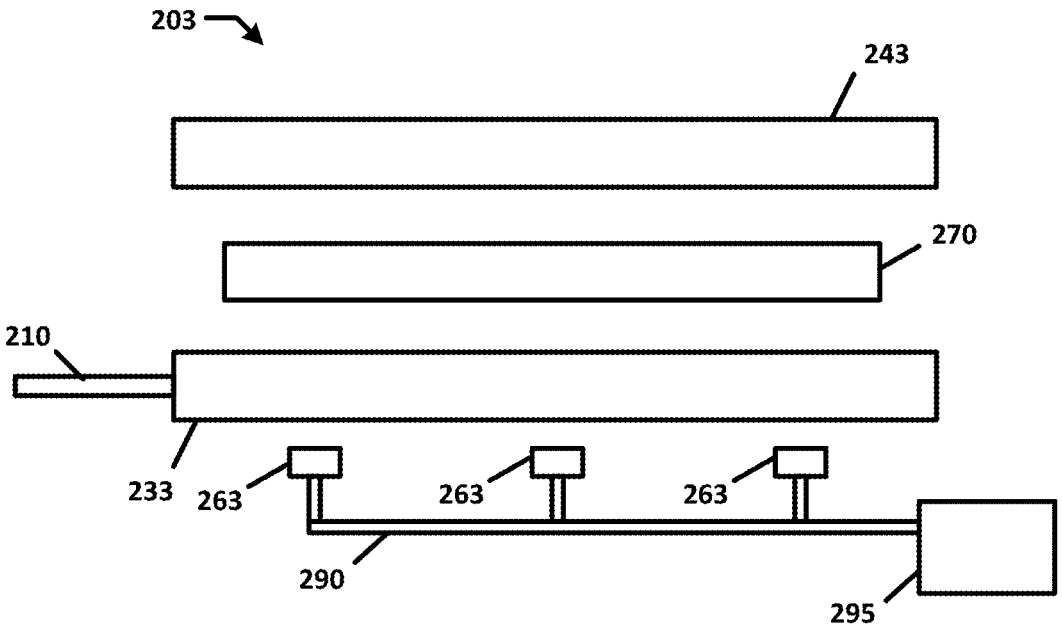
FIG. 8 illustrates a system for manufacturing a molded solid surface according to an exemplary embodiment of the present disclosure.

FIG. 8 illustrates a system 203 for manufacturing a molded solid surface including ferrous particles according to an embodiment of the present disclosure. The system 203 incudes injection channel 210, mold lower half 233, mold upper half 243, magnets 263, arm 290, and actuator 295. The injection channel 210, mold lower half 233, mold upper half 243, and molded solid surface 270 may be the same as those discussed above with respect to FIG. 5. The system 203 further includes arm 290 connecting magnets 263 and actuator 295. The magnets 263 in the embodiment of system 203 may be one of permanent magnets and electromagnetic magnets. The actuator 295 may be one of a motor or a solenoid. The actuator 295 is configured to move the arm 290 and thus the magnets 263 relative to the mold lower half 233 and the mold upper half 233. For example, the actuator 295 may move the arm 290 and thus the magnets 263 through a prescribed path to create a predetermined pattern and/or docking location by applying a force to the ferrous particles toward a surface of the mold as the magnets 263 move along the prescribed path. In some embodiments, the magnets 263, arm 290, and actuator 295 may be located on the other side of the mold near the mold upper half 243. In some embodiments, the actuator 295 may be configured to move the arm 290 and magnets 263 towards and/or away from the lower mold half 233. In some embodiments the actuator 295 may be configured to move the magnets 263 along a plane that is parallel to a surface of the lower mold half 233. The system 203 may create a predetermined pattern and/or a docking location in the resinous material (and subsequently the molded solid surface) as the actuator moves the magnets relative to the mold.

Figure 9:
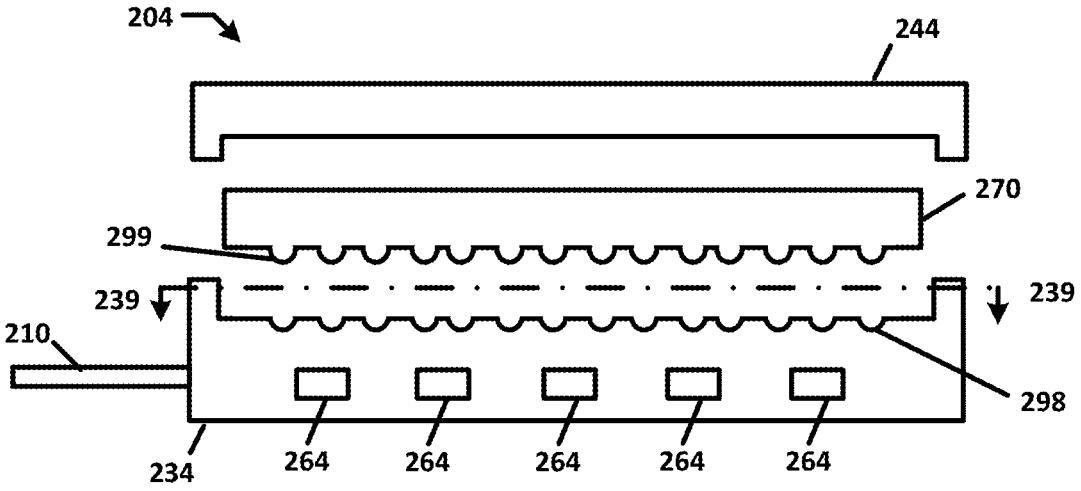
FIG. 9 illustrates a cross section of a system for manufacturing a molded solid surface according to an exemplary embodiment of the present disclosure.

FIG. 9 illustrates a cross section of a system for manufacturing a molded solid surface including ferrous particles according to an exemplary embodiment of the present disclosure. The system 204 includes injection channel 210, mold lower half 234, mold upper half 244, and magnets 264. The injection channel 210 and magnets 264 may be the same as those discussed above with respect to FIG. 5. As shown in FIG. 9, the mold lower half includes dimples 298 formed therein. In some embodiments, the dimples 298 may be formed in the upper mold half 244. In other embodiments, the dimples 298 may be formed in both the lower mold half 234 and the upper mold half 244. The dimples 298 may correspond to protrusions 299 formed in the molded solid surface 270.

In the system 204, the magnets may cause the ferrous particles to move into the dimples formed in the lower mold half 234 and/or the upper mold half 244. In some embodiments, the magnets 264 may push the ferrous particles into the dimples 298. Accordingly, after the resinous material cures, a relatively high concentration of ferrous particles may be located in the protrusions 299 formed in the molded solid surface 270. The protrusions 299 may have a relatively dark shade due to the high concentration of ferrous particles in the protrusions 299. In other embodiments, the magnets 264 may pull the ferrous particles into the dimples 298. In some embodiments, the magnets 264 may be located within the lower mold half 234 and/or the upper mold half 244. In other embodiments, the magnets 264 may be located proximate to the lower mold half 234 and/or the upper mold half 244.

Figure 10:
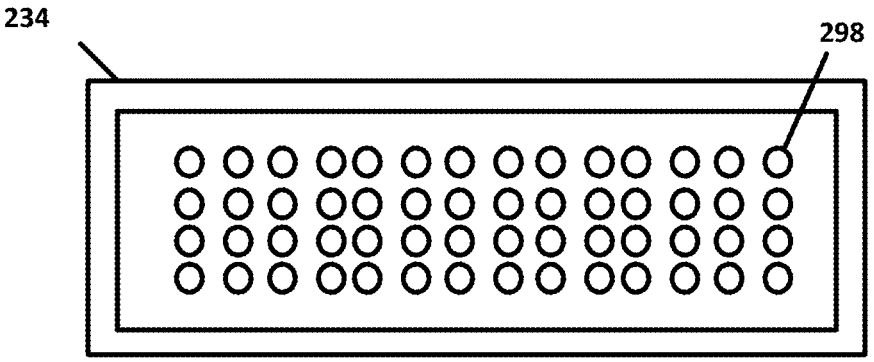
FIG. 10 illustrates a cross section view of the system of FIG. 9.

FIG. 10 illustrates a cross section view of the system 204 of FIG. 9 taken along line 239. The dimples 298 formed in the lower mold half 234 and/or the upper mold half 244 may be configured to create a preconfigured texture and/or geometric pattern in the molded solid surface 270. As shown in FIG. 10, the location of the dimples 298 formed in the lower mold half 234 and/or the upper mold half 244 may correspond to the preconfigured texture and/or geometric pattern in the molded solid surface. Accordingly, after the resinous material has cured, the ferrous particles in the protrusions 299 may form the preconfigured texture and/or geometric pattern.

Figure 11:
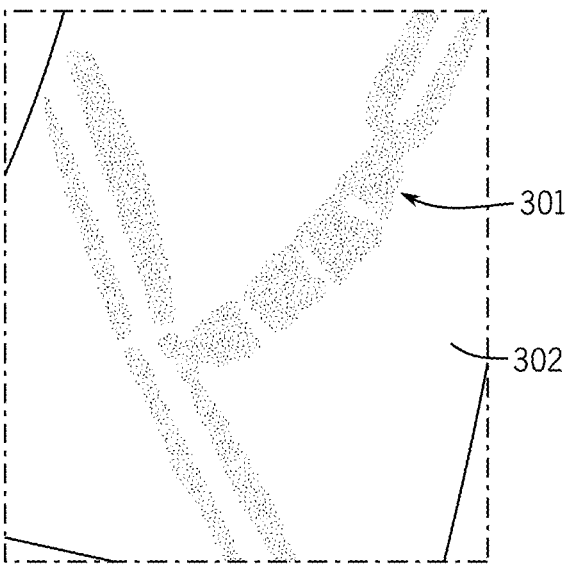
FIG. 11 illustrates a predetermined pattern on a molded solid surface and corresponding magnet configuration.
Figure 11:
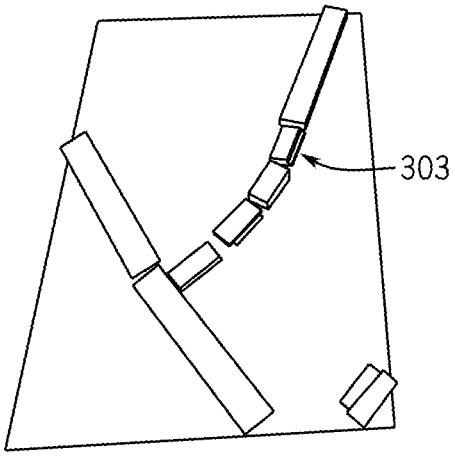

FIG. 11 illustrates a predetermined pattern 351 in a molded solid surface 302 according to an exemplary embodiment of the present disclosure. FIG. 11 further illustrates a magnet configuration 302 used to create the predetermined pattern 351 as illustrated in FIG. 9A.

Figure 12:
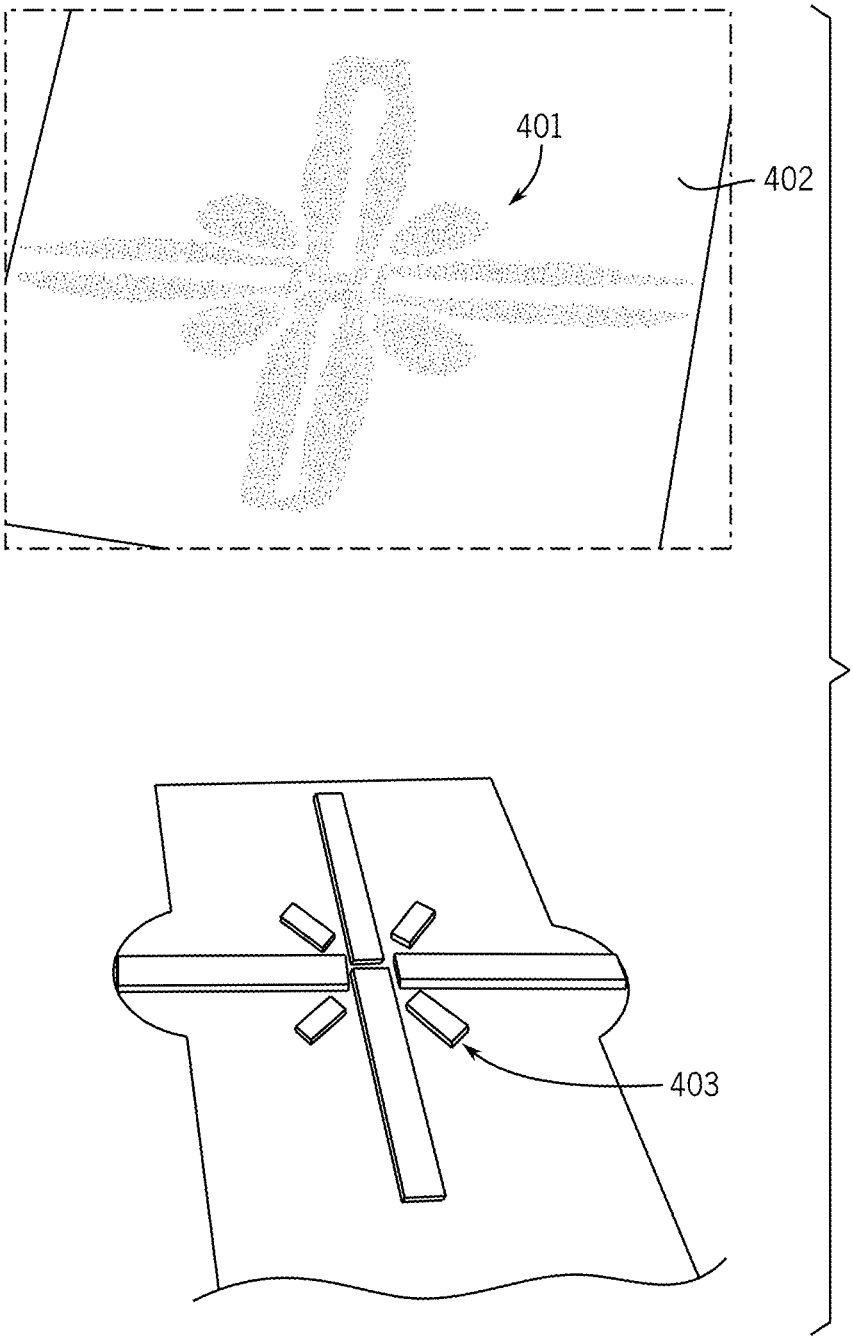
FIG. 12 illustrates a predetermined pattern on a molded solid surface a corresponding magnet configuration.

FIG. 12 illustrates a predetermined pattern 401 on a molded solid surface 402 according to an exemplary embodiment of the present disclosure. FIG. 12 illustrates a magnet configuration 403 used to create the predetermined pattern 401.

The example molded solid surface including ferrous particles according to any of the disclosed embodiments may be adapted for inductive heating. Foundry sand with the ferrous or magnetic material may be added to ceramic tiles that form a countertop for heating or another device or surface for heating. The ceramic tiles may be configured for operation as induction heaters. The molded solid surface including ferrous particles may be adapted for use in other heat-able surfaces such as of bath surfaces, shower surfaces, toilet seats, bidets, and shower seats.

An electric coil beneath ceramic tiles (e.g., within the countertop) generates an electromagnetic field that travels through the ferrous particles in the tile. The ferrous material may be heated through eddy currents, joule heating, and/or hysteresis losses. The ceramic tile may operate as a stovetop or other heating surface to heat pots or pans. That is, the ceramic tile is heated through induction heating, and the heat is applied to one or more objects placed in contact with the ceramic tile. The ceramic tile may operate as a warming tray to keep items warm. The ceramic tile may be used to dry the surface or other object (e.g, towels or clothes). The ceramic tile may be used to heat wax, potpourri, or other scented materials.

In another example, at least one magnet beneath the molded solid surface including ferrous particles (e.g., within the ceramic tile) includes an electromagnet. The electromagnet is powered to generate inductive heat via an electromagnetic field. The electromagnetic field is applied to an object placed on the molded solid surface in order to heat the object. The object may be a pot or pan adapted for inductive heating.

When a component, device, element, or the like of the present disclosure is described as having a purpose or performing an operation, function, or the like, the component, device, or element should be considered herein as being "configured to" meet that purpose or perform that operation or function.

Cleaning Robot

The following embodiments describe a magnetic cleaning system for a surface in a bathroom setting or a kitchen setting. The magnetic cleaning system includes a robot or a device configured to carry out a series of tasks as designated by a computer. The cleaning robot may be a motorized vehicle capable of traversing the surfaces in the bathroom or kitchen settings. In some examples, the cleaning robot is guided by a magnetic path. In some examples, the cleaning robot is attached to (e.g., held against) the surface (e.g., vertical surface or underside of a horizontal surface) through the aid of magnets. The surface of the bathroom fixture may include a pattern of magnets configured to hold the robot cleaning device to the surface of the bathroom fixture. In some examples, the cleaning robot is driven under magnetic force. In some examples, the cleaning robot includes cleaning brushes or other devices that are driven through magnets. In some examples, a manual cleaning device is held to the surface through magnets. In some examples, such a manual device may also include cleaning brushes or other devices that are driven through magnets.

Figure 13:
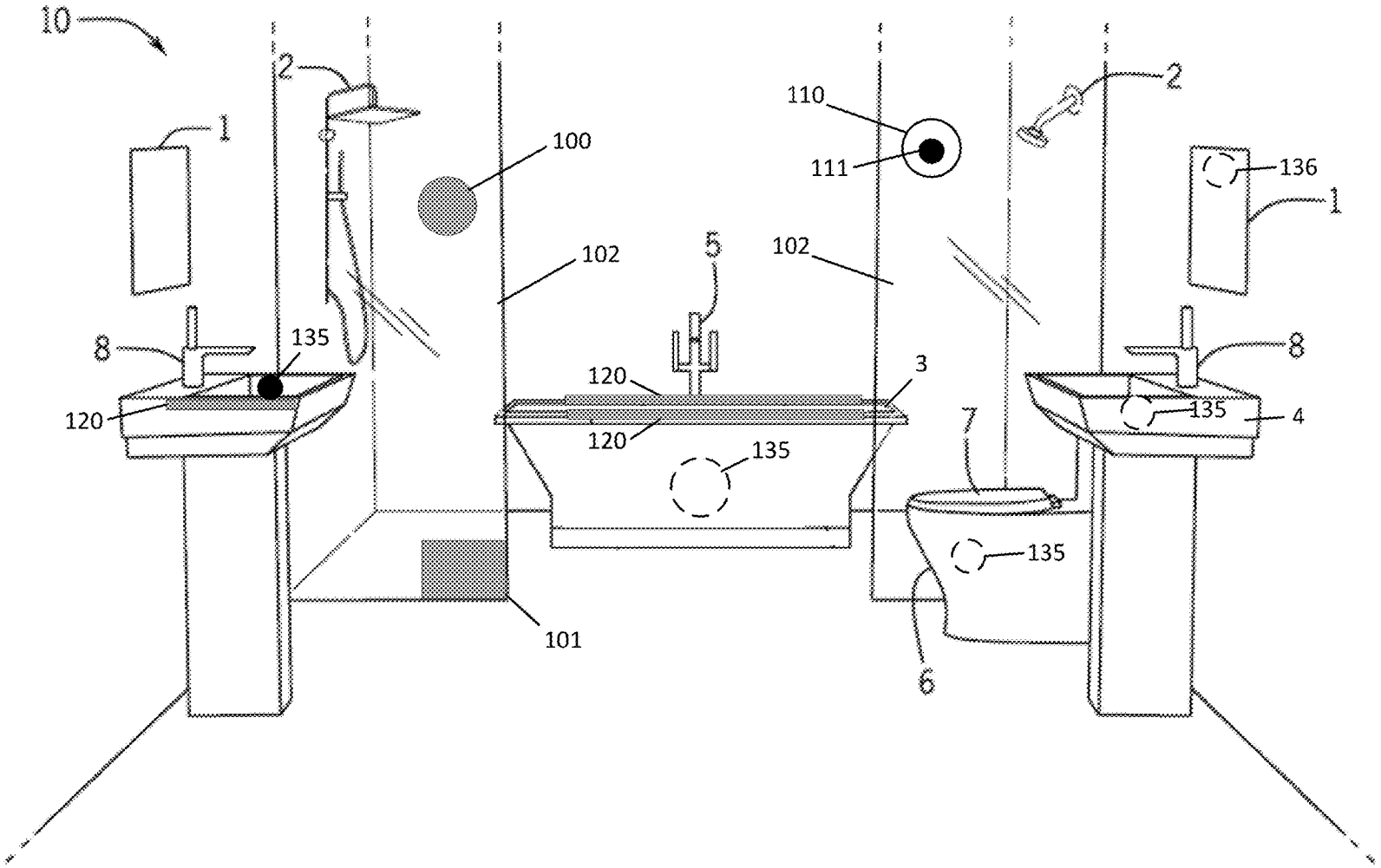
FIG. 13 illustrates a robotic cleaning system.

FIG. 13 illustrates example robotic cleaning systems in a bathroom setting 10. The bathroom setting 10 that includes multiple appliances or bathroom devices including one or more mirrors 1, one or more shower heads 2, a bathtub 3, one or more sinks 4, a bathtub faucet 5, a toilet 6, a toilet seat 7, a sink faucet 8 and other devices.

A variety of example robotic cleaning system are illustrated. The robot cleaning device may include a cleaning robot 100 configured to traverse the surface of the bathroom fixture. The cleaning robot is configured to clean a sink 4 including a magnetic drain stopper according to any of the examples herein.

The cleaning robot 100 is configured to clean a shower wall 102. The shower wall 102 may include a glass door, a glass wall, or a tiled wall. The shower wall 102 may include tiles with surface patterns imparted through imbedded ferrous particles as described herein. The cleaning robot 100 may be automated. The cleaning robot 100 may be configured to interact with a docking station 101 attached to the bathroom fixture. The docking station 101 may provide one or more services to the cleaning robot 100 such as charging the cleaning robot 100 or providing cleaning solution or water to the cleaning robot 100.

Figure 14:
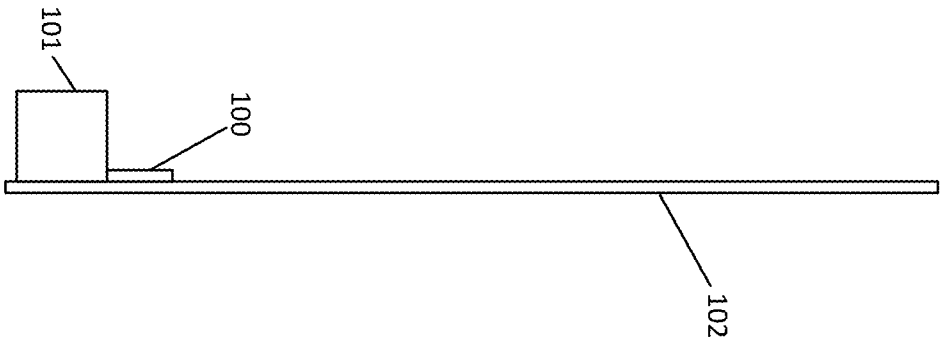
FIG. 14 illustrates a side view of the robotic cleaning system.

FIG. 14 illustrates a side view of the robotic cleaning system. The cleaning robot 100 may traverse the shower wall 102 to engage the docking station 101. The cleaning robot 100 may travel inside a housing of the docking station 101. The docking station 101 may include a power supply for charging the cleaning robot 100. The docking station 101 may include one or more tanks for housing water or cleaning solution that the docking station 101 replenished in the cleaning robot 100.

As an alternative to a robot, a manual cleaner may be used. For example, the cleaner 110 and handle 111 may each include magnets that allow the cleaner 110 to be moved in response to movement of the handle 111. The cleaner 110 may include magnets that are opposite the shower wall 102 to the handle 111. As the user moves the handle 111, the cleaner 110 is pushed or pulled by the magnets (translational force). The cleaner 110 may include a brush, a pad, or an absorbent surface that is in contact with the shower wall 102.

A driving device including at least one driving magnet positioned to attract the driven magnet and guide the cleaning device to clean the bathroom surface with the scrubbing brush. In one example, the cleaner 110 includes at least one rotator wheel and at least one driven magnet. As the user moves the handle 111, the motion off the handle 111 moves the cleaner 110. Friction between the cleaner 110 and the bathroom surface or the shower wall 102 may turn a gear (e.g., worm gear) that rotates a ring gear coupled to the scrubbing brush and driven by the gear to provide the rotational force to the scrubbing brush.

In one example, the handle 111 may be replaced by a cleaning robot 100. That is, the cleaning robot 100 may run on a first side of the shower wall 102 and apply forces from magnets to cleaner 110.

In one example, a cleaning robot 135 may be configured to traverse the inside surfaces of a bathtub 3, a sink 4 or a toilet 6. In one example, the cleaning robot 100, 135 may be configured to transition from one surface to another. For example, the cleaning robot 100 may traverse the shower wall, travel along the floor and then up the wall to the mirror 1. Alternatively, the cleaning robot may transition to (travel between) other devices such as the bathtub 3, the sink 4, and/or the toilet 6.

Figure 15:
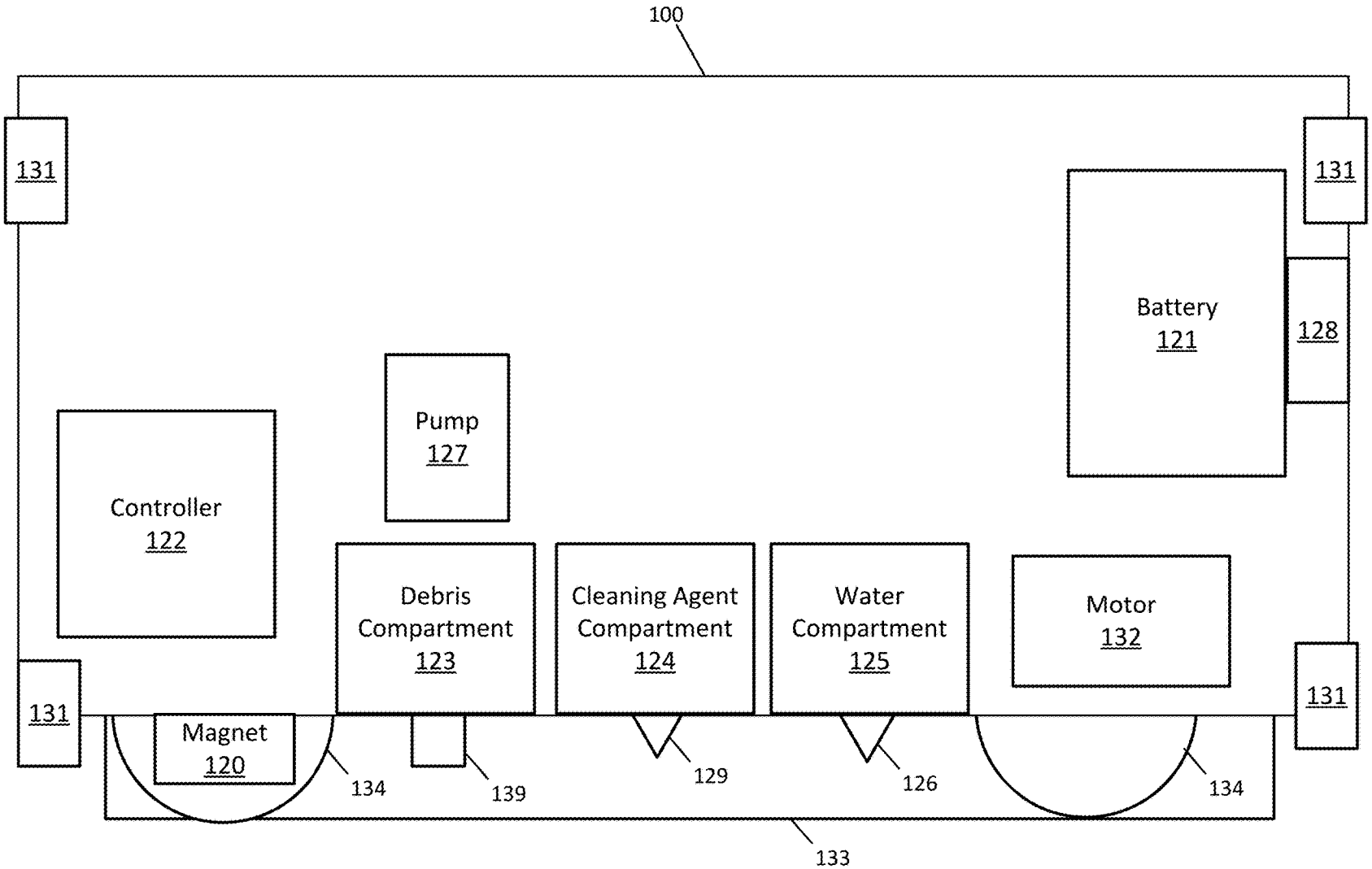
FIG. 15 illustrates a block diagram for a cleaning robot.

FIG. 15 illustrates a block diagram for the cleaning robot 100. The cleaning robot 100 may include an electrical system including a battery 121, one or more sensors 131, and a controller 222. The battery 121 may be charged via a charging contact 128 or charging port. The charging contact 12 may be exposed through the housing of the cleaning robot 100 so that the cleaning robot 100 can directly dock with a charging receptacle in the docking station 101.

The cleaning robot 100 may include a cleaning system including a scrubber 133, a debris compartment 123, a cleaning agent compartment 124, and a water compartment 125.

The scrubber 133 may be a cleaning pad mounted on the bottom side of the cleaning robot 100. In some examples, the scrubber 133 is moistened with water from the water compartment 125 of the cleaning robot 100. Capillary action may supply water from the water compartment 125 to the scrubber 133. The pump 127 may be used. A damp or wet scrubber 133 may improve the cleaning action of the scrubber 133 against the shower wall 102 or other bathroom surface. In this example, the docking station 101 may include a water tank. When docked in the docking station 101, the water compartment 125 of the cleaning robot 100 may be refilled with water (e.g., through nozzle 126).

In some examples, in addition or in the alternative to water, the scrubber 133 may be supplied with a cleaning solution or cleaning compound from the cleaning agent compartment 124. The cleaning solution may be a cleaning compound dissolved in water. The cleaning solution may be supplied to the scrubber through nozzle 129. Capillary action may supply the cleaning solution from the cleaning agent compartment 124 to the scrubber 133. The pump 127 may be used. Cleaning solution on the scrubber 133 may improve the cleaning action of the scrubber 133 against the shower wall 102 or other bathroom surface.

In some examples, in addition or in the alternative to water and/or the cleaning solution, debris may be removed from the scrubber 133. The debris is dirt or other particles picked up from the shower wall 102 by the scrubber 133. The scrubber may rotate (e.g., a belt or roller), and debris may be removed on a side opposite from the shower wall 102. The debris may be removed by a rigid member 139 or wiper blade that deposits the debris into the debris compartment 123.

In some examples, the water compartment 125 may include water that is removed from the scrubber 133. The cleaning robot 100 may include a pinch member or squeegee that removes wastewater from the scrubber 133 and deposits it into the water compartment 125.

The cleaning robot 100 may include a drive system including a motor 132 and one or more wheels 134. The motor 132 may be powered by the battery 121. The motor 132 may drive one or more gears or drive axles to rotate one or more wheels 134. The controller 222 may generate drive commands or drive signals to cause the motor 132 to rotate the wheels 134.

In some examples, the wheels 134 may include magnets 120. The magnets 120 may hold the cleaning robot 100 to the shower wall 102. The magnet force may be sufficient to support the cleaning robot on a vertical surface, substantially vertical surface, a partially vertical surface. In some examples, a partially vertical surface is a surface at an angle such that the vertical component is greater than the horizontal component (e.g, at an angle equal to or greater than 45 degrees).

Figure 16:
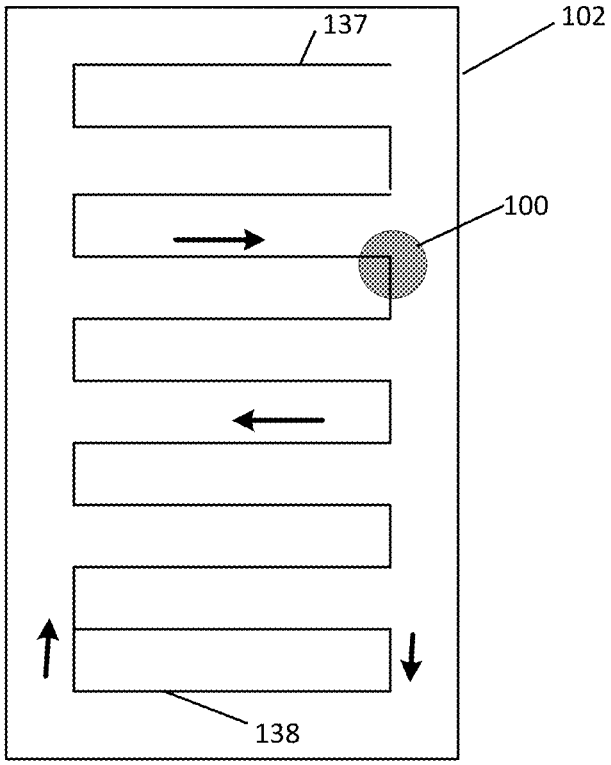
FIG. 16 illustrates a magnetic path for the cleaning robot.

FIG. 16 illustrates a magnetic path 137 for the cleaning robot 100. As illustrated the magnetic path 137 is integrated with the shower wall 102. However, any of the bathroom surfaces described may include the magnetic path 137. The magnetic path 137 may include a series of magnets or a strip of metal or ferrous material. The cleaning robot 100 is configured to follow the magnetic path 137.

The cleaning robot 100 may include a sensor 131 that detects the magnetic path 137. The sensor 131 may be a magnetic sensor that scans a predetermined angle (e.g., magnetic viewing angle) in from of the cleaning robot 100. An array of values for the viewing angle are output from the magnetic sensor. The cleaning robot 100 is steered toward the highest magnetic field as indicated by the array of values so that the cleaning robot 100 follows the path 137.

The cleaning robot 100 may include magnet 120 that is attracted to the magnetic path 137. The force on the magnet 120 may steer the cleaning robot 100. The cleaning robot 100 may include a belt. For example, rather than wheels 134, the scrubber 133 and the magnet 120 may be mounted on a belt that is rotated by the motor 132. The magnet 120 along the belt attracts the magnetic path 137. As the belt rotates, the cleaning robot 100 is driven along the magnetic path.

Indicia may also be used in the magnetic path 137. The sensor 131 may collect optical data for the indicia. The indicia may indicate a direction of travel (e.g., the indicia may be on the left side of the magnetic path 137 and the optical sensor may be on the left side of the cleaning robot 100).

The magnetic path 137 may include a loopback section 138 where the magnetic path 137 loops back on itself so that the cleaning robot 100 returns to its origin after traversing the magnetic path 137.

Figure 17:
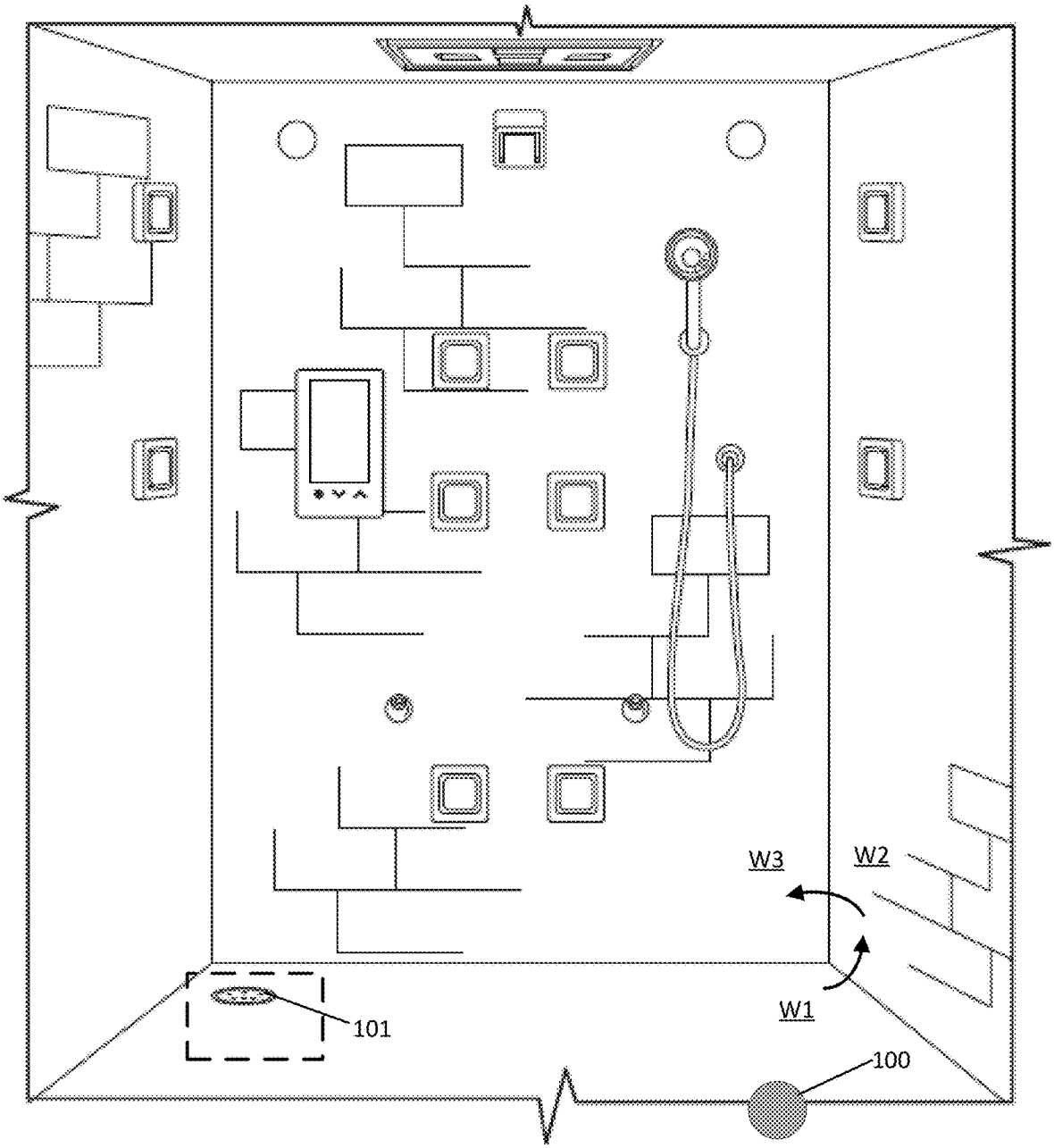
FIG. 17 illustrates an example shower for the cleaning robot.

FIG. 17 illustrates an example shower for the cleaning robot 100. The cleaning robot 100 may traverse all of the surfaces of the shower using a magnetic path and/or magnetic forces from the shower that hold the cleaning robot 100 against the walls. The cleaning robot 100 may include a side roller on the side of the cleaning robot 100 housing that allows the cleaning robot to grip an adjacent wall while traveling on the first wall. In other words, the side roller allows the cleaning robot 100 the travel from a first wall to a second wall perpendicular to the first wall. For example, the cleaning robot 100 may traverse the shower floor W1 until it abuts against wall W2, where the side roller grips wall W2 and allows the cleaning robot 100 to climb from floor W1 to wall W2. Likewise the cleaning robot 100 may traverse wall W2 until it abuts against wall W3, where the side roller grips wall W2 and allows the cleaning robot 100 to climb from wall W2 to wall W3.

The docking station 101 may be integrated with a drain of the shower. For example, the docking station 101 may be above the drain or under the drain of the shower surface. The cleaning robot 100 may travel to the docking station 101 at the drain to release materials such as wastewater or debris. An additional docking station 101 may be located outside of the shower for charging the cleaning robot 100.

Figure 18:
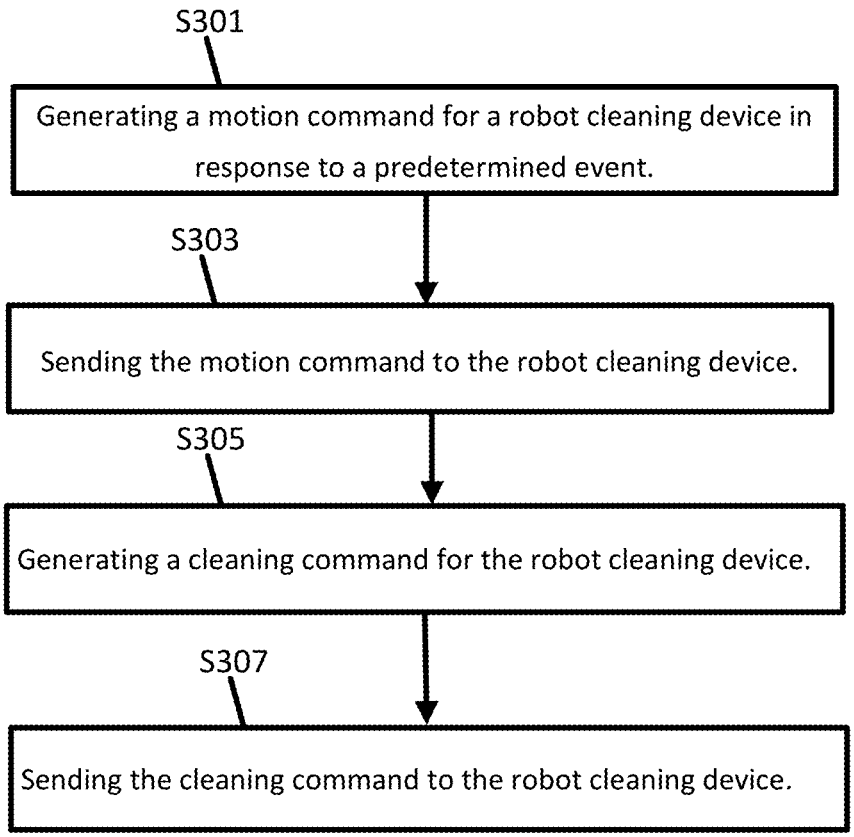
FIG. 18 illustrates a flow chart for the cleaning robot.

FIG. 18 illustrates a flow chart for the cleaning robot 100 cleaning a surface of a bathroom fixture. Additional, different, or fewer components may be used.

At act S301, the controller 222 generates a motion command for a robot cleaning device in response to a predetermined event. At act S303, the controller 222 sends the motion command to the robot cleaning device. The motion command may instruct a motor to turn one or more wheels to drive the robot cleaning device. The motion command may instruct a motor to steer one or more wheels to change a direction of the robot cleaning device. The motion command may instruct different motors to turn different wheels to drive the robot cleaning device in a particular direction. The motion command may be sent as a code or a pulse width modulated signal to specify the number of rotations, speed, and direction for driving the robot cleaning device.

At act S305, the controller 222 generates a cleaning command for the robot cleaning device. At act S307, the controller 222 sends the cleaning command to the robot cleaning device. The cleaning command may instruct the robot cleaning device to raise or lower a cleaning pad. The cleaning command may instruct the robot cleaning device to dispense water or a cleaning solution. The cleaning command may instruct the robot cleaning device to remove debris from a cleaning pad.

Act S301-S307 may be repeated in response to sensor data collected in the environment of the robot cleaning device. The sensor data may include obstacles (e.g., shower head, sprayer, shower valves, bottles) or contours of the shower (e.g., other walls, ceiling, floor). The sensor data may describe a predetermined path for the robot cleaning device. The sensor data may identify surfaces that require cleaning. The sensor data may identify whether the shower is in operation or not. The motion commands and cleaning commands may be adjusted according to the sensor data.

Levitating Shower Door

Figure 19:
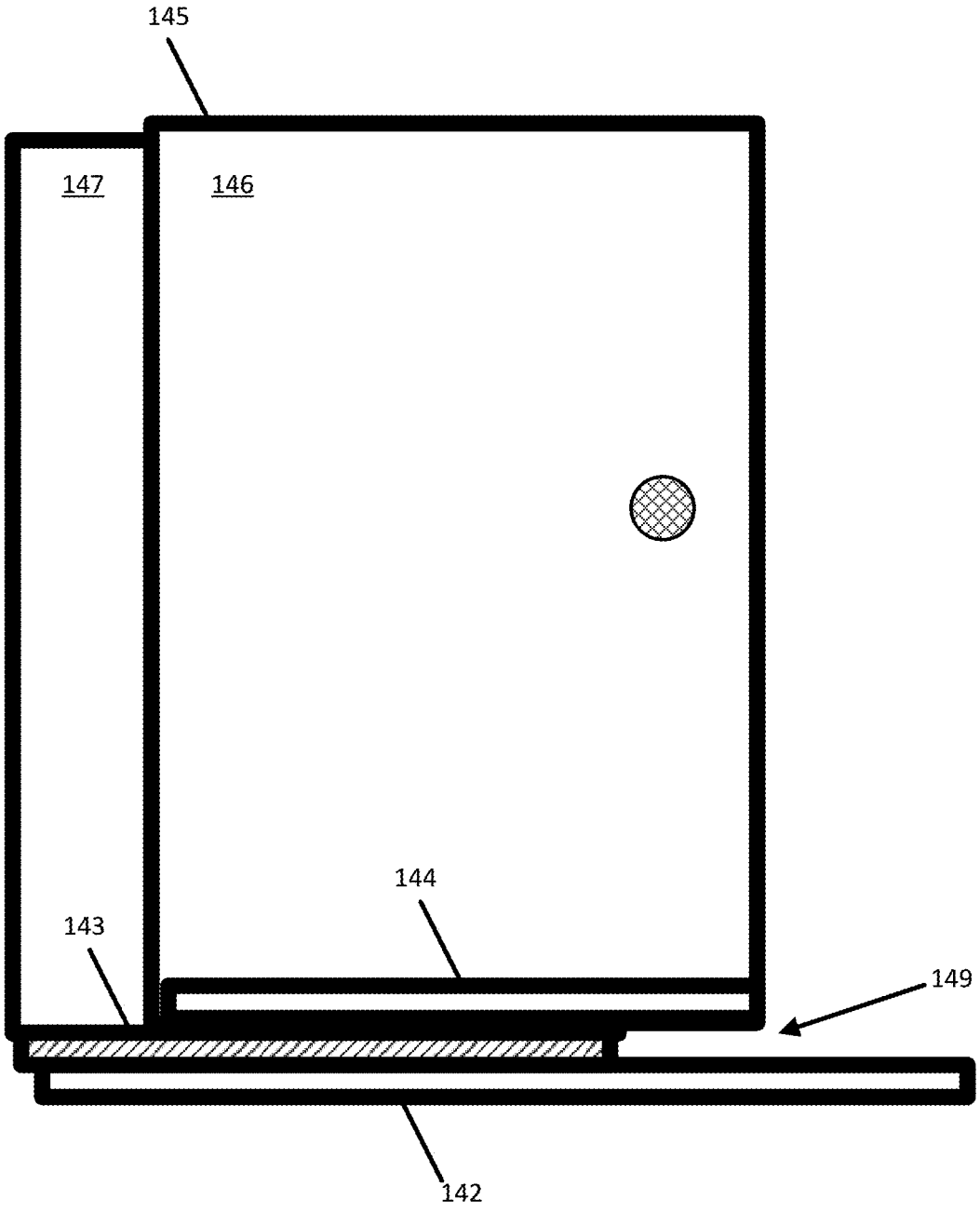
FIG. 19 illustrates an example magnetic shower door.

FIG. 19 illustrates an example magnetic shower door 145. The door 145 may include two panels, such as stationary panel 147 and levitating panel 146. Each of the panels may be glass, plastic, or another material. The stationary panel 147 may be rigidly supported by a support 143. The support 143 may be secured to the floor. Any of the cleaning robot examples may be combined with the magnetic shower door 145.

The levitating panel 146 includes an array of magnets 144. The levitating panel 146 may not be rigidly secured to the support 143. The levitating panel 146 may be supported by magnet support 142. The magnet support 142 provides a vertical force to the levitating panel 146 across magnet gap 149. The vertical distance of the magnet gap 149 may be small such as 0.1 centimeters, 1/16 of an inch, or another distance. The distance in FIG. 18 is for illustrative purposes and dimensions may not be to scale.

The levitating panel 146 may be laterally supported by the stationary panel 147. The magnet gap 149 provides the vertical support of the levitating panel 146 and the stationary panel 147 prevents the levitating panel 146 from falling or leaning.

Magnetic Water Purification

Figure 20:
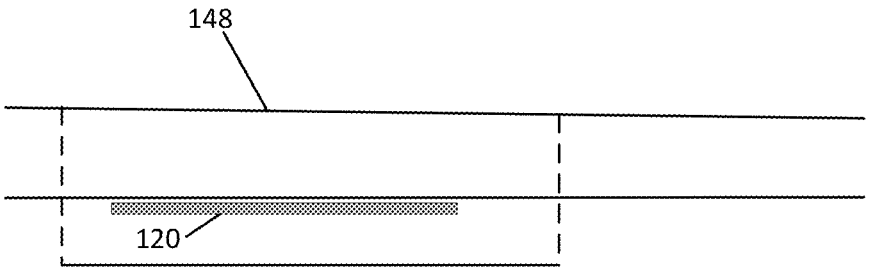
FIG. 20 illustrates a magnetic purification system.

FIG. 20 illustrates a magnetic purification system. A magnet 120 is mounted near or on the exterior of a water pipe 148. The magnet 120 may include an electromagnet and corresponding power source, etc. The magnet 120 generates a magnetic field that places magnetic forces on the water inside the water pipe 148. A section of the water pipe 148 may be formed of a nonferrous material such as plastic to allow the magnetic field to impact the water inside the water pipe 148.

The magnetic field may purify water through polarization. The magnetic field may be imposed on the water pipe 148 and water therein at a predetermined field strength, gradient, or rate of change to remove particles from the water. For some particles, the magnetic field may cause them to precipitate. The particles may be deposited on a surface of the water pipe 148 and/or may be more easily filtered after application of the magnetic field.

In some examples, such as when the magnet 120 is an electromagnet, the magnet 120 is excited to trap particles on the interior surface of the water pipe 148 and subsequently turned off so that the particles can be flushed from the water pipe 148 at a specified time.

In some examples, the water pipe 148 may include a magnetic jacket that is excited by an electromagnetic field. The treated water may be less viscous after treatment by the magnetic field. The treated water may create softer water and/or a more luxurious shower or bathing experience.

The magnet 120 may also be used to clean spills. Certain kitchen, laundry, cooking oil/grease spills may be treated with an iron oxide particles that are modified to attract hydrocarbons. The iron oxide particles mixed with the water will absorb the hydrocarbon or other waste. When traveling through the pipe 148, the magnet 120 can trap the iron oxide and spill together, releasing cleaned water.

Magnetically Responsive Water

Figure 21:
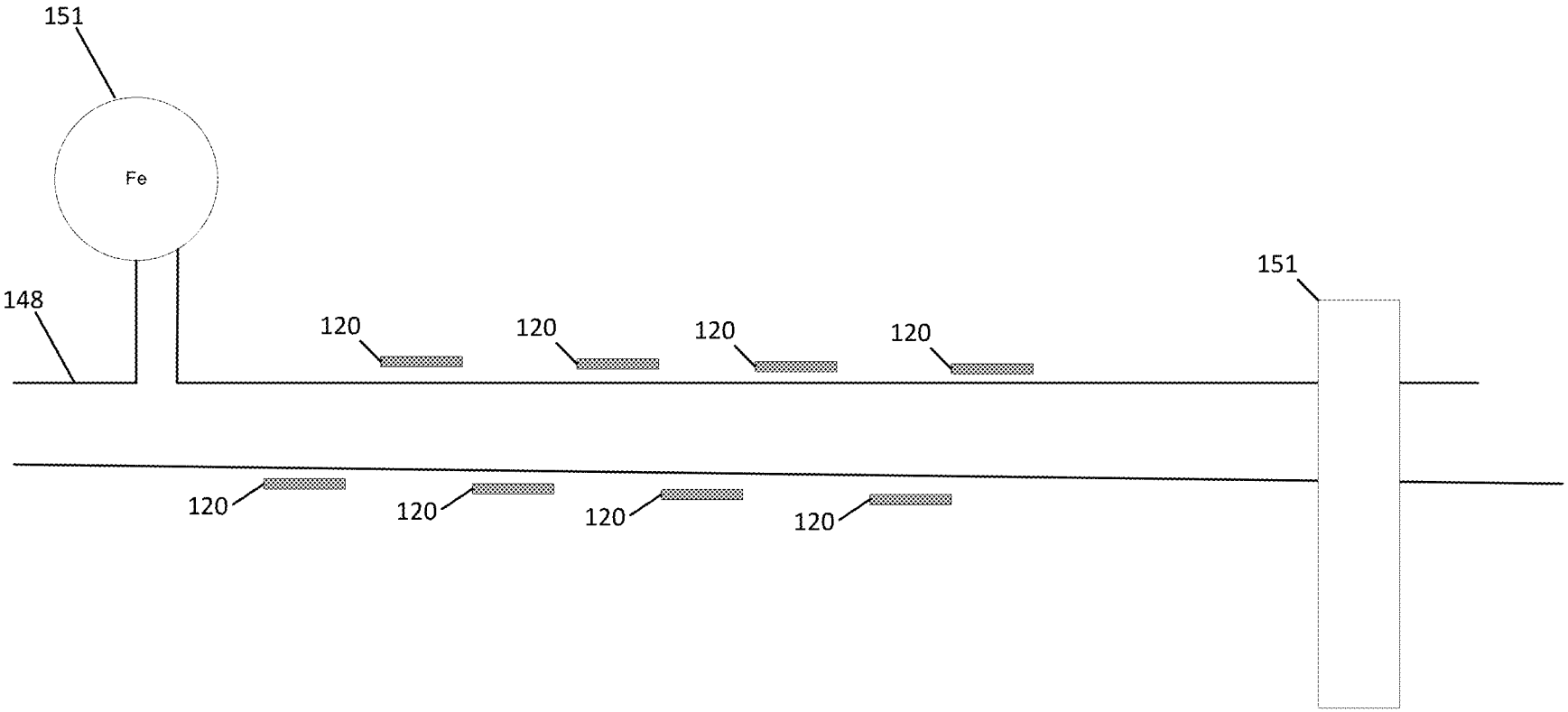
FIG. 21 illustrates a magnetic water drive system.

FIG. 21 illustrates a magnetic water drive system including a magnetic particle chamber 151, a water pipe 148, and multiple magnets 120. The magnets 120 may be aligned with the water pipe 148. In some examples, the magnets 120 are permanent bar magnets parallel with the direction of flow of water through the water pipe 148. In other examples, the magnets 120 include ring magnets that encircle the water pipe 148. That is, the water pipe may be install through the ring magnets and/or support the ring magnets. In other examples, the magnets 120 may be stationary electromagnets. In other examples, the magnets 120 may be solenoids with magnetic pistons. As the solenoids are actuated, the magnetic pistons move as do the corresponding magnetic fields, which propels the water through the water pipe 148. The solenoids and/or electromagnets may be controlled through power signals or electrical pulses generated by a controller 222.

The magnetic particle chamber 151 may include iron. The iron may be iron oxide, iron particles, or another form of iron. The magnetic particle chamber 151 releases the iron into the water, which increases the impact of the magnetic field from magnets 120 on the water. The magnets 120 then apply forces on the iron particles which helps move the water through the water pipe 148. Similarly, a stationary electromagnet or solenoids with magnetic pistons may propel the water with suspended magnetic particles through the water pipe 148. The water with suspended magnetic particles may be referred to as magnetically responsive water.

Figure 22:
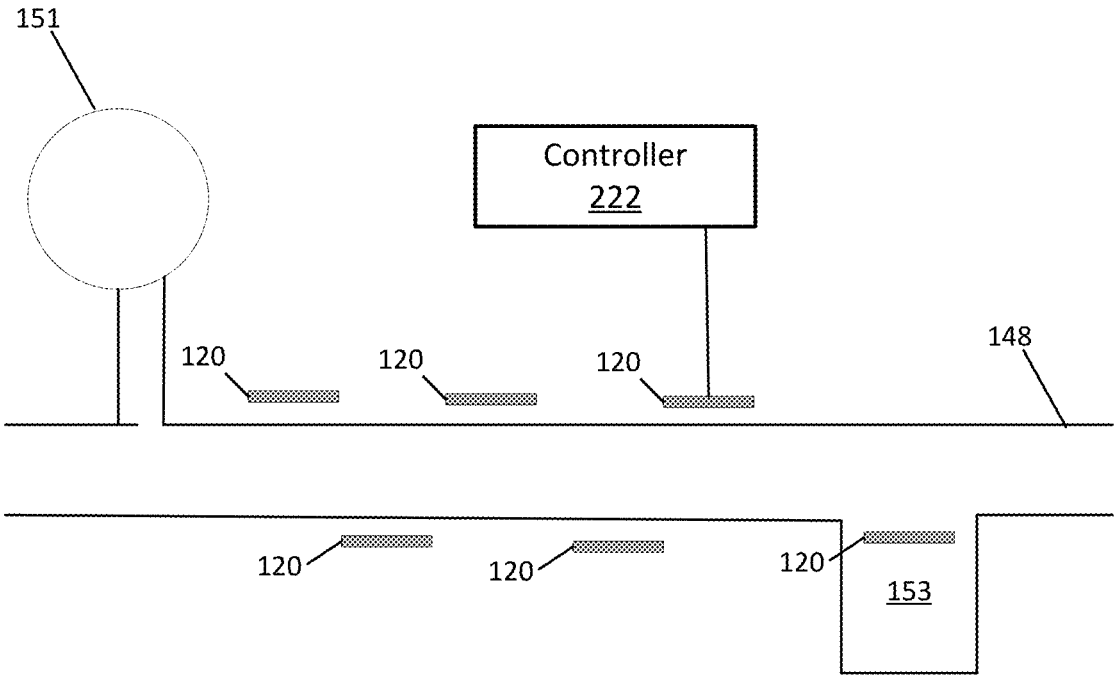
FIG. 22 illustrates a magnetic water drive system and magnetic trap.

FIG. 22 illustrates a magnetic water drive system and a magnetic trap 152. The magnets 120 may be a stationary electromagnet or solenoids with magnetic pistons may propel the water as the controller 222 turns the electromagnets or the solenoid on and off. The control signal from the controller 222 to the magnet 120 may be a stairstep function or pulse. The frequency of the control signal may control the speed of the water.

The magnetic trap 152 includes another magnet 153. The magnet 153 may attract the magnetic particles into the magnetic trap 152. Additional filtering may be used to remove the magnetic particles from the water.

Figure 23:
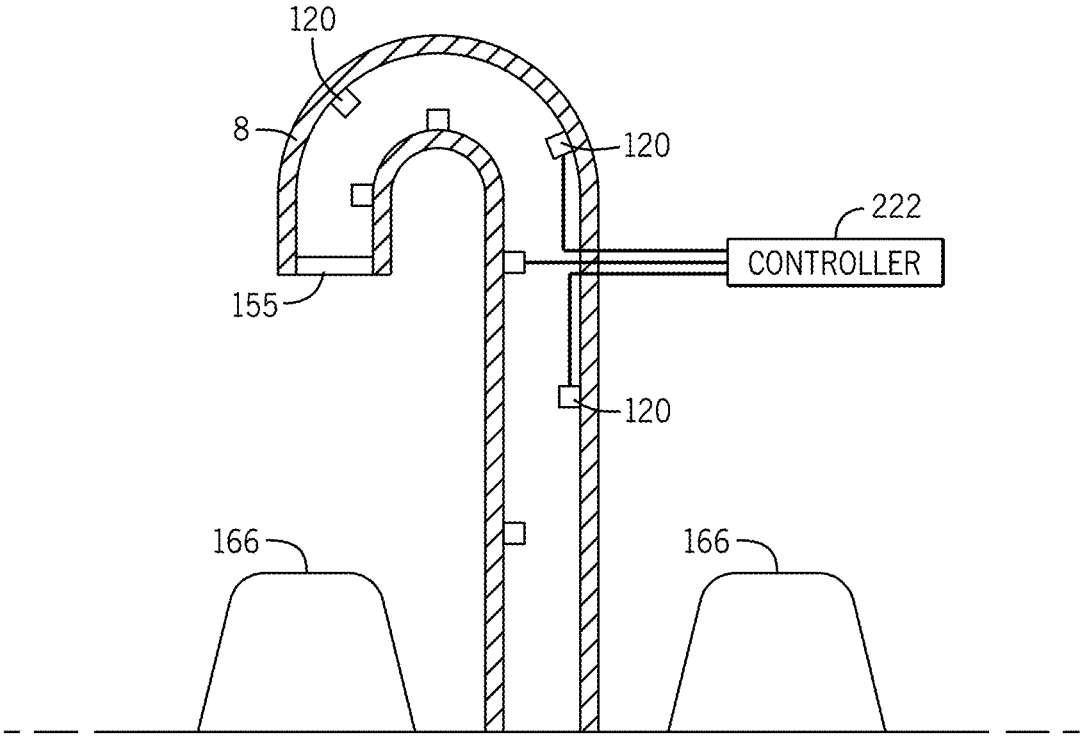
FIG. 23 illustrates a magnetic water drive system in a faucet.

FIG. 23 illustrates a magnetic water drive system in a faucet 8. The magnetic water drive systems includes magnets 120 aligned with a passage in the faucet 8. In some examples, the magnets 120 are permanent bar magnets parallel with the direction of flow of water through the faucet 8. In other examples, the magnets 120 include ring magnets that encircle the passage through the faucet 8. In other examples, the magnets 120 may be stationary electromagnets. In other examples, the magnets 120 may be solenoids with magnetic pistons. As the solenoids are actuated, the magnetic pistons move as do the corresponding magnetic fields, which propels the water through the passage of the faucet 8. The water in the faucet 8 may include magnetic particles from a magnetic particle chamber 151, as described above. The magnetic particles may be removed internally in the faucet 8 by the filter 155.

The faucet 8 with the magnetic water drive system may be combined with a magnetic stopper system described herein. In addition, an adjacent basin 165 or countertop may include surface patterns caused imbedded ferrous particles described above. Various hardware such as knob handles 166 may be connected magnetically.

Figure 24:
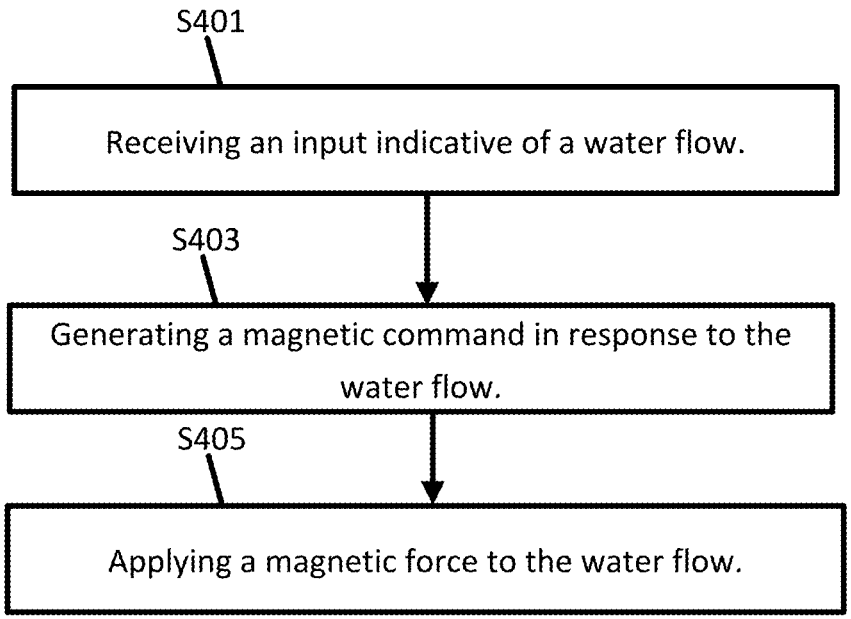
FIG. 24 illustrates a flow chart for the magnetic water drive system.

FIG. 24 illustrates a flow chart for the magnetic water drive system. Additional, different or fewer acts may be used.

At act S401, the controller 222 receives an input indicative of water flow. The input may be received by a touchscreen, capacitive switch, button, keypad or other electronic device connected to the controller 222. The input may be received wirelessly at the controller 222 from a connected device (e.g., phone, tablet, computer) or from a network or the Internet.

At act S403, the controller 222 generates a magnet command in response to the input indicative of water flow. The magnet command may activate a power supply to turn on the electromagnet or solenoid outside of a water pipe. At act S405, a magnetic force from the electromagnet or solenoid is applied to the water flow.

Magnetic Hardware Mounting

Figure 25:
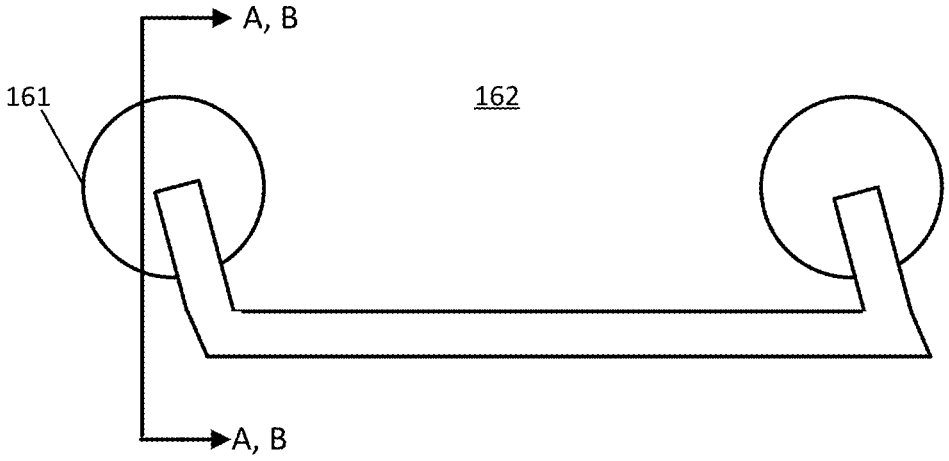
FIG. 25 illustrates a magnetic anchor for a wall mount.
Figure 25:
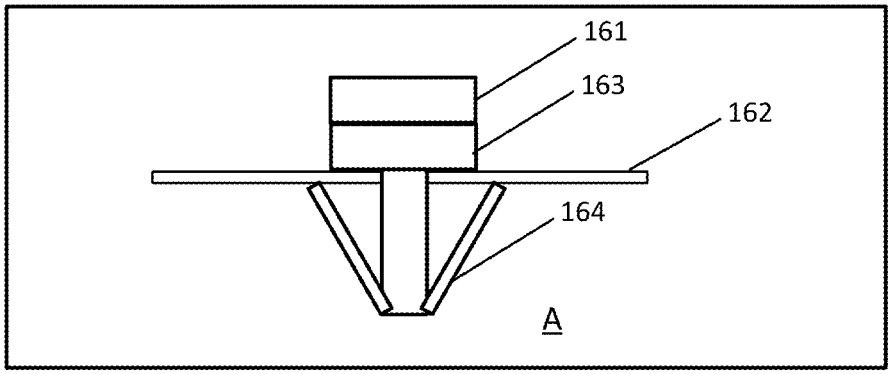
Figure 25:
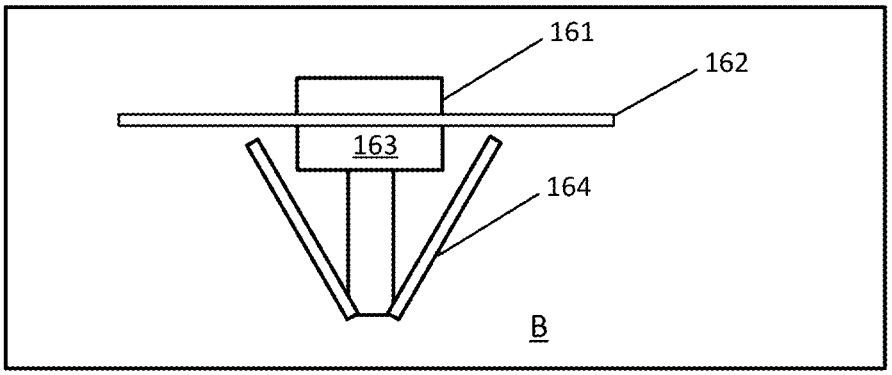

FIG. 25 illustrates a magnetic anchor for a wall mount. A magnetic accessory may be a towel rack, or another device such as a hook, a container, or a shelf, includes a magnetic fastener 161. The magnetic fastener 161 includes a magnet that is configured to be coupled to a magnetic anchor 163. The magnetic anchor 163 may be one of a plurality of magnets arranged in a grid or other predetermined pattern as described below. The magnetic anchor 163 may be combined with the tiles with aesthetic patterns from internal ferrous particles as described herein.

Two alternative cross sections A and B are illustrated in FIG. 25. In cross section A, the magnetic anchor 163 is outside of the wall 162 the magnetic anchor 163 makes direct contact with the magnetic fastener 161. In cross section B, the magnetic anchor 163 is inside the wall 162 and the magnetic anchor 163 attracts the magnetic fastener 161 through the wall 162. In either case, an internal fastener 164 may secure the magnetic anchor 163 to the wall.

Figure 26:
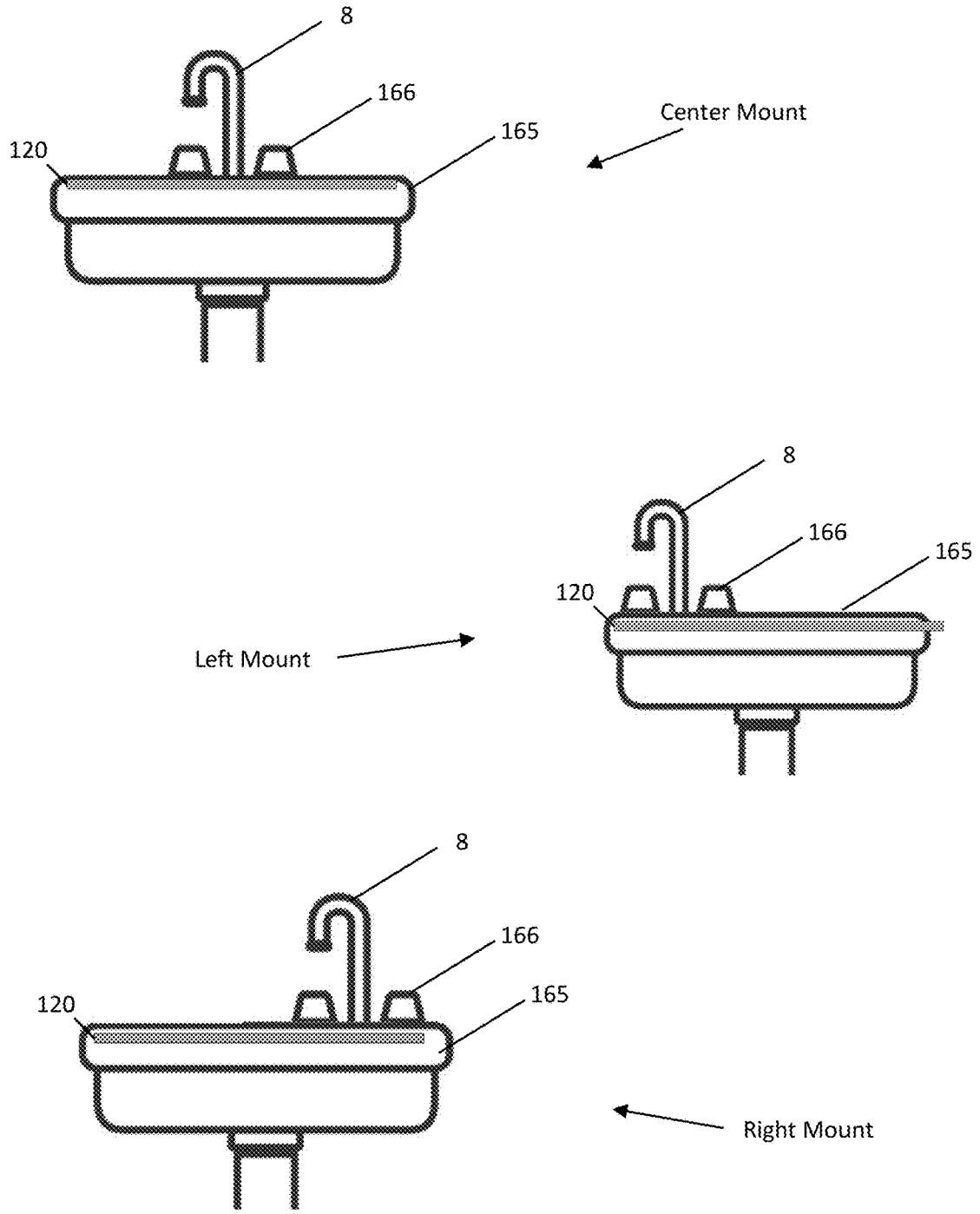
FIG. 26 illustrates a magnetic coupling for a faucet.

FIG. 26 illustrates a magnetic coupling for a faucet 8. The magnetic anchor or base is integrated or coupled to the sink and may include a grid of placement locations for a faucet or a handle. Additional, different or fewer components may be connected using the magnetic anchors. The faucet 8 may be combined with any of the magnetic stopper embodiments described herein.

FIG. 26 includes a center mounting configuration for the faucet 8, a left mounting configuration for the faucet 8, and a right mounting configuration for the faucet 8.

The faucet 8 and/or valve handles 166 may be held in place by a magnetic anchor (e.g., magnet 120) that is in the sink or under the sink. The faucet 8 and/or valve handles 166 include magnets attracted to the magnetic anchor. The faucet 8 and/or valve handles 166 may slide across the sink in a slot so that the user can slide them to various locations, and secure them via the magnets.

Figure 27:
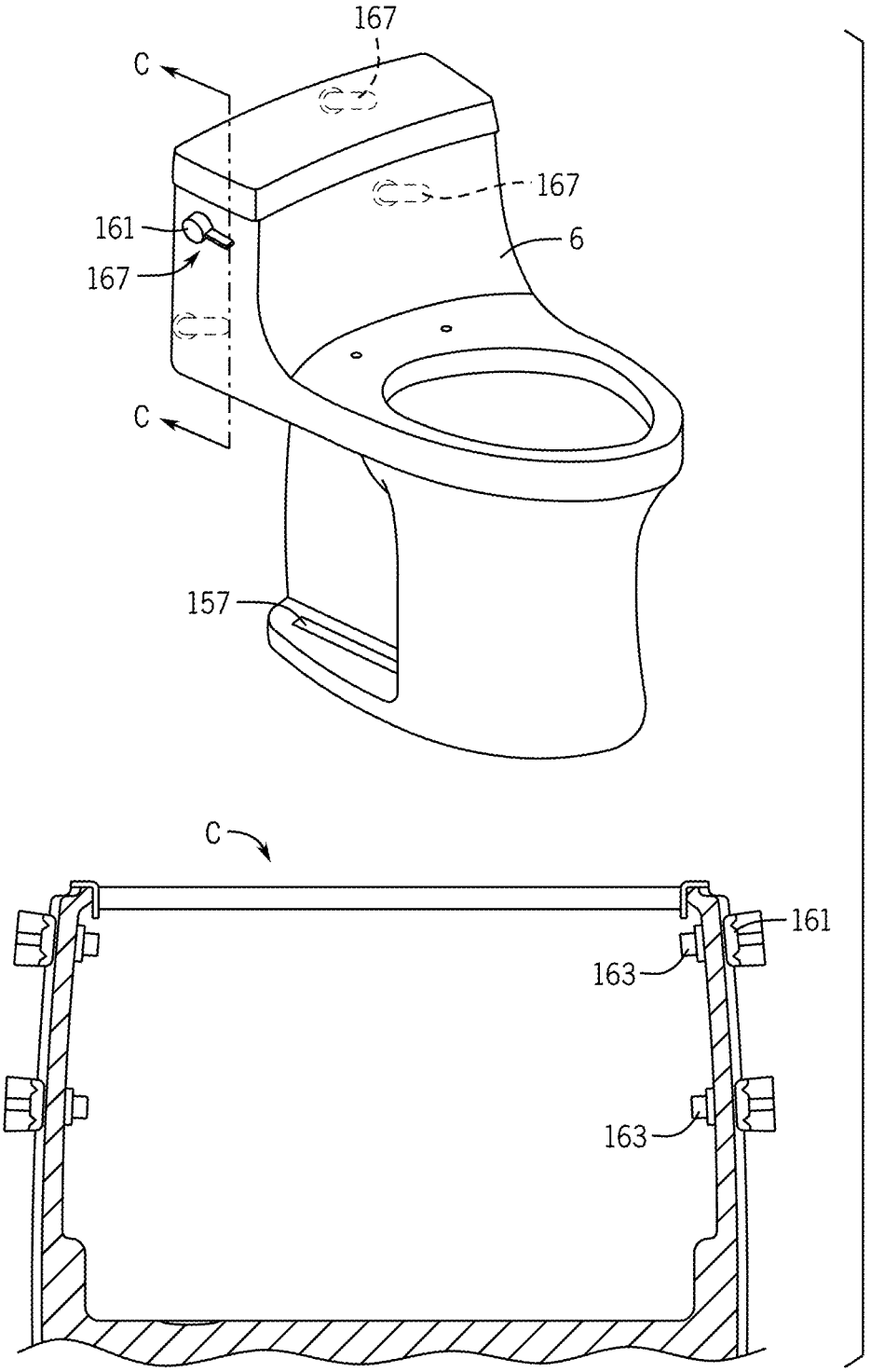
FIG. 27 illustrates a magnetic coupling for a toilet lever.

FIG. 27 illustrates a magnetic coupling for a toilet lever 167 of toilet 6. The toilet lever 167 may include magnetic fastener 161. Inside the tank, or another portion of the problem, may be a magnetic anchor 163 that attracts the toilet lever 167 and holds the toilet lever 167 in place. Though omitted from FIG. 27 for ease of illustration, the magnetic anchor 163 may be configured to rotate in response to operation of the toilet lever 167, and the magnetic anchor 163 may be connected to a lever arm attached to a flapper or another type of flush valve. In other examples, the toilet lever 167 may include a wireless transmitter that communicates with a flush valve. The toilet lever 167 may include a gesture sensor, an accelerometer, or another sensor that detects movement of the toilet lever 167 or user gesture near the toilet lever 167. A wireless signal is sent from the toilet lever 167 to the flush valve based on the sensor data.

The magnetic anchor 163 may be movable within the tank. That is, to move the position of the toilet lever 167, the magnetic anchor 163 could be moved to any location inside the tank and the toilet lever 167 would be attracted to a corresponding position on the outside of the tank. The dotted lines on toilet 6 illustrate several possible locations for the toilet lever 167.

Cross section C illustrates the inside of the tank of the toilet 6. In some examples, multiple magnetic anchors 163 are arranged on the inside of the tank. The multiple magnetic anchors 163 may be located in predetermined positions and/or in a grid have a series of magnetic anchors 163 in rows and/or columns.

FIG. 27 also illustrates an installation guide 157. The installation guide 157 may be a magnet attached to the toilet 6 for aiding the alignment of the toilet 6 during installation.

For example, a skirted toilet may be installed on a separate trapway including a trapway magnet (not shown). The separate trapway is bolted to the floor flange and, then the toilet is placed on the trapway and connected using a set of brackets. It may be difficult to alight the toilet 6 with the internal brackets of the trapway. The magnet of the installation guide 157 may help align the toilet with the magnet of the separate trapway. That is, the two magnets may attract each other at the point where guide holes in the toilet are aligned with the bracket.

Other bathroom appliances may include magnets for alignment purposes. For example, faucet handles may be aligned with a predetermined angle using guide magnets. A shower wall may be aligned with a shower floor. A toilet seat may be aligned with a toilet using guide magnets.

Figure 28:
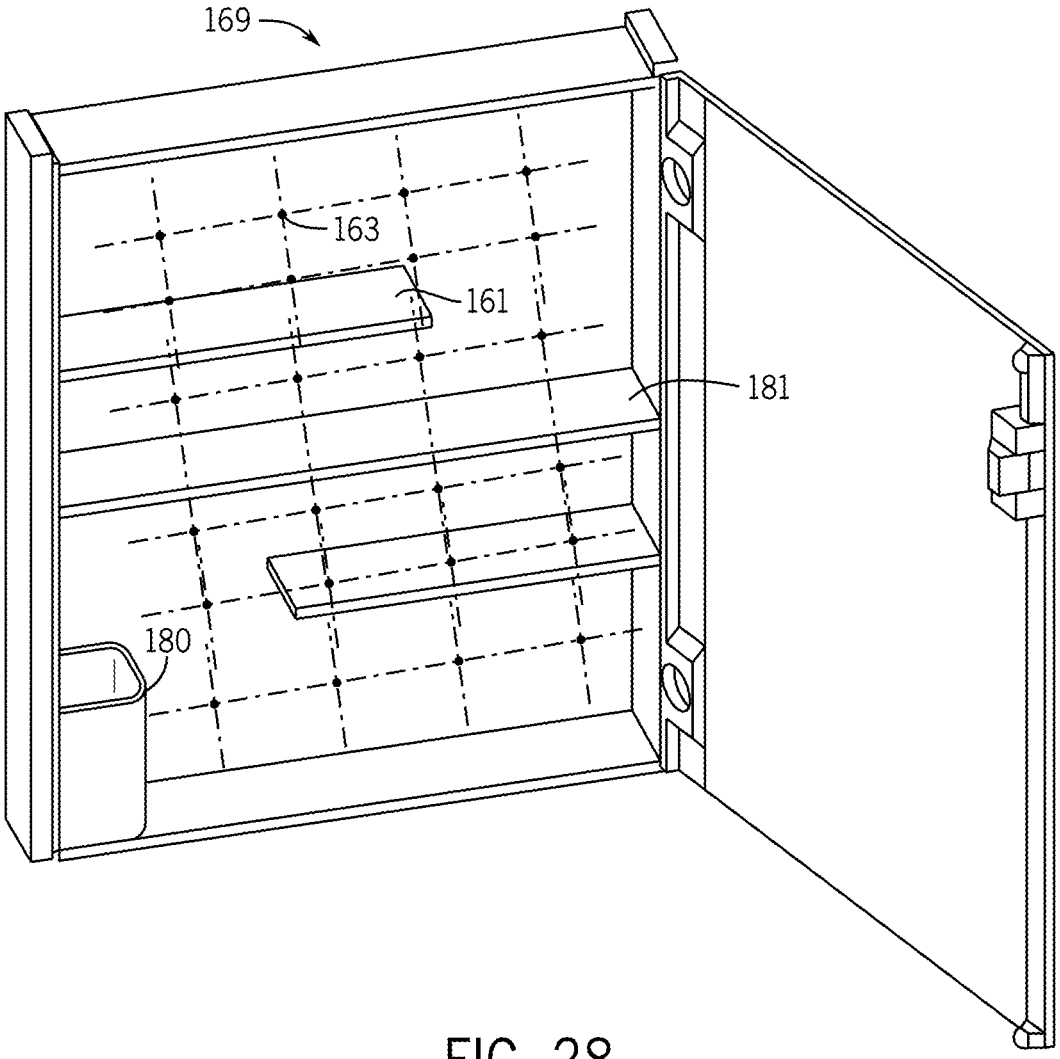
FIG. 28 illustrates a magnetic coupling for a cabinet.

FIG. 28 illustrates a magnetic coupling for a cabinet 169. The cabinet 169 includes multiple magnetic anchors 163, which may be arranged in a grid. Various accessories may be mounted within the cabinet 169 using a magnetic fastener 161 that is attached to the accessories. The user may arrange the accessories in various positions based on the magnetic anchors 163.

Example accessories may include the container 180 and shelves 181 as illustrated in FIG. 28. Other example accessories may include a sensor assembly, a camera, a communication module, or a light. The sensor assembly may include sensors for measuring the ambient environment (e.g., temperature, humidity, light) or health properties of the user (e.g., temperature, coloring, blood pressure, blood sugar). The camera may detect health properties of the user, identify the user, or detect gestures of the user. The communication module may include wireless communication radios.

Figure 29:
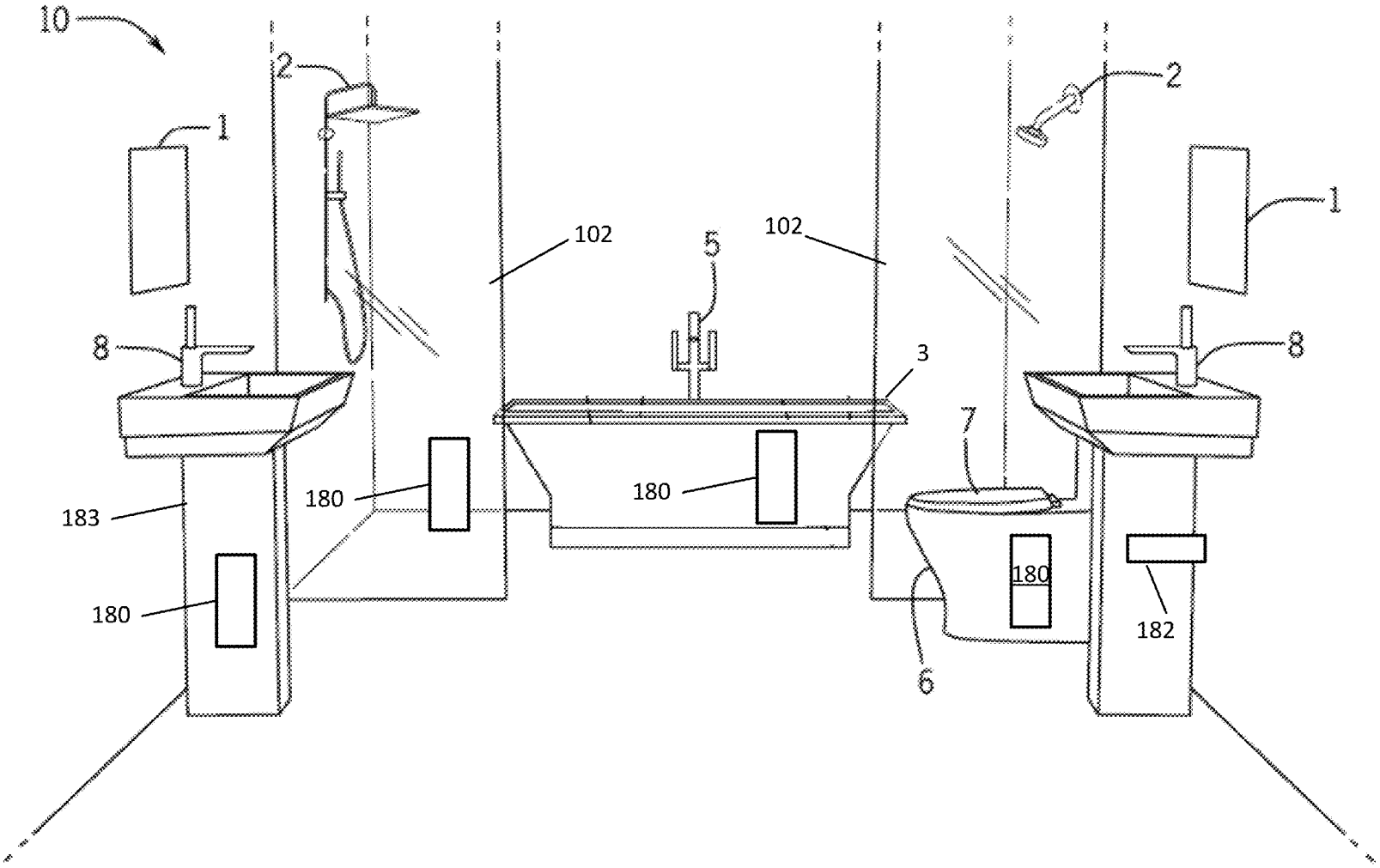
FIG. 29 illustrates a magnetic coupling for bathroom storage.

FIG. 29 illustrates a magnetic coupling for bathroom storage. The storage container 180 may include a magnetic fastener 161 and even of the bathroom surfaces or devices may include a magnetic anchor 163. Such devices may include one or more walls, bathtub 3, pedestal or vanity 183, shower wall 102, toilet 6, or other devices.

Figure 30:
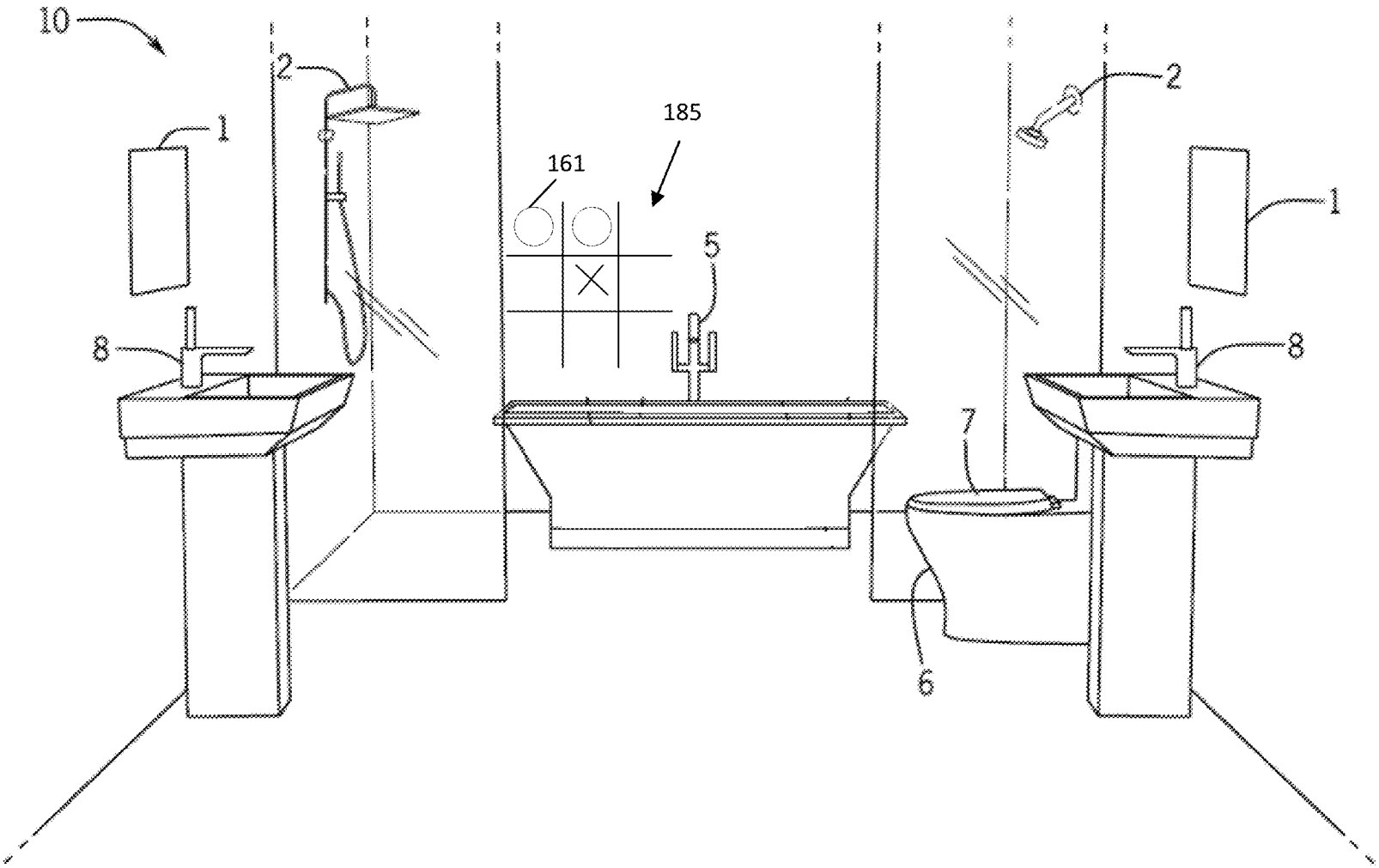
FIG. 30 illustrates a magnetic coupling for a game.

FIG. 30 illustrates a magnetic coupling for a game 185. Pieces for the game may include the magnetic fastener 161 and inside the wall or another bathroom surface is a magnetic grid including magnetic anchors 163 in a predetermined pattern for the game. Illustrated in FIG. 30 is a tic tac toe game. The grid may have nine magnetic anchors corresponding to each of the positions of the board. The X's and O's include magnetic fasteners 161.

Figure 31:
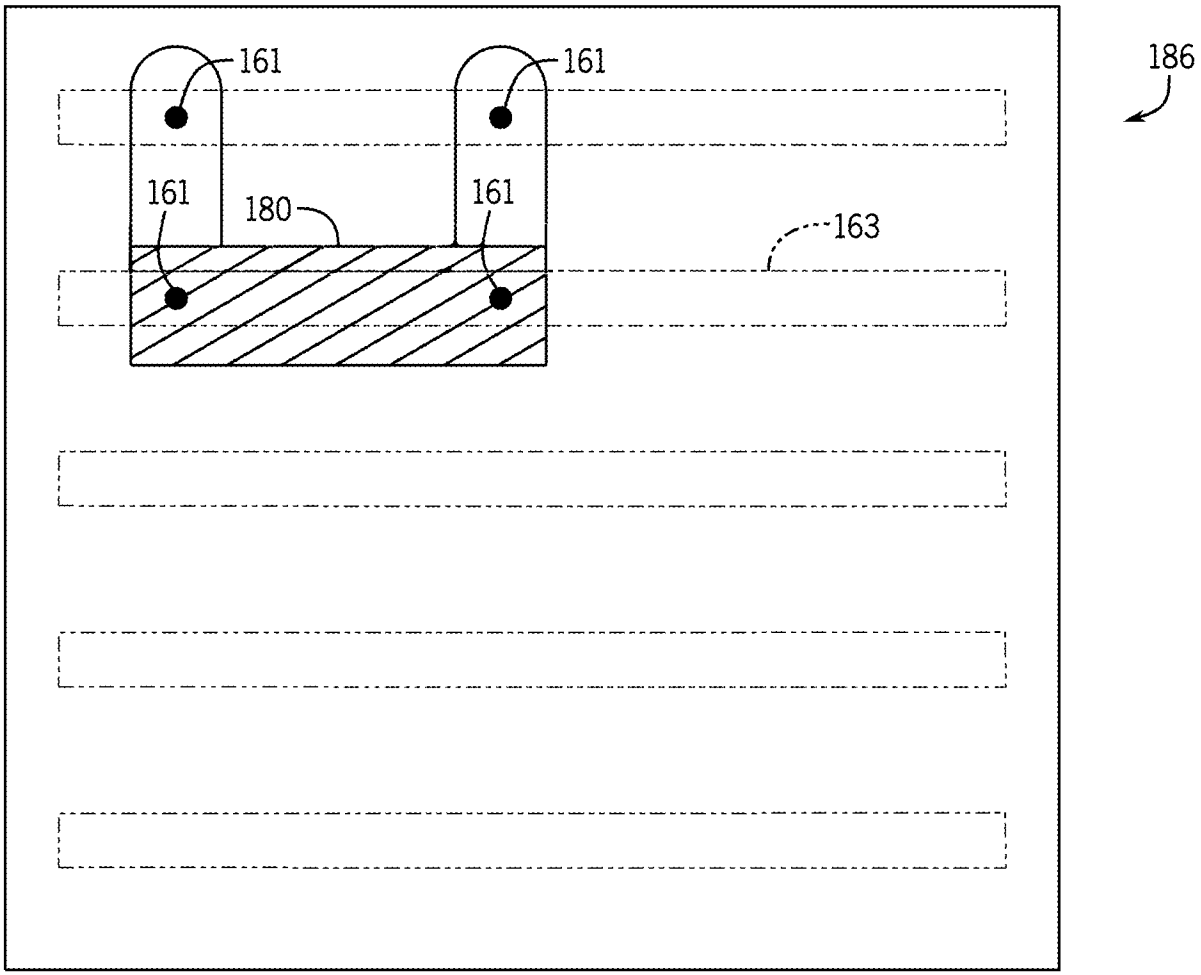
FIG. 31 illustrates a magnetic coupling grid.

FIG. 31 illustrates a magnetic coupling grid. Any of these implementations of the anchor 163 in FIGS. 25-30 may involve a magnetic grid 186. The magnetic grid is a base mounted to a wall or plumbing fixture. The magnet base includes spaced magnets including multiple rows of magnets or multiple columns of magnets. For example, FIG. 30 illustrates rows of magnet anchors 163.

A magnetic accessory (e.g., container 180, shelving, sensors, camera, dispensers, lights, controllers, batteries) may be configured to be mounted to the cabinet via the magnetic base in a plurality of positions. A magnetic accessory may be configured to be mounted to the wall or the plumbing fixture via the magnetic base in multiple positions. Each of the positions may span at least two of the multiple rows of magnets or at least two of the multiple columns of magnet anchors 163.

The magnetic grid 186 may include at least one magnet with a first polarity facing the wall and at least one magnet with a second polarity facing the wall. Certain accessories may have opposite polarities to attached to specific rows or columns of the magnetic anchors. For example, shelving may only be attachable to every other row of magnetic anchors. A camera may only be attachable in a specific location.

The magnetic accessory 180 may be configured to attach to the at least one magnet with a first polarity facing the wall and not configured to attach to the at least one magnet with a second polarity facing the wall. A second magnetic accessory configured to attach to the at least one magnet with a second polarity facing the wall and not configured to attach to the at least one magnet with a first polarity facing the wall. In one example, at least two rows of magnets have a first polarity facing outward and the at least two columns of magnets have a second polarity facing outward so that the accessory connects to the magnetic base in a predetermined orientation.

Acoustic Shower Tile

Figure 32:
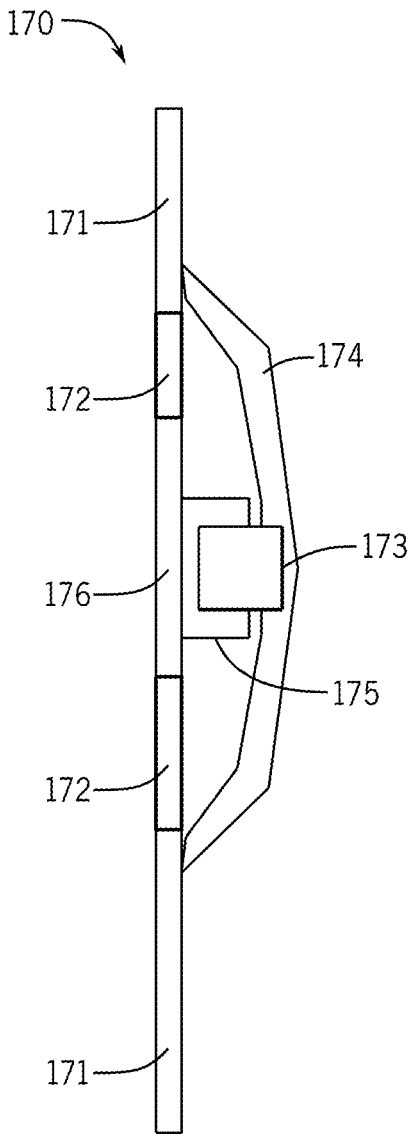
FIG. 32 illustrates an example acoustic shower tile.

FIG. 32 illustrates an example acoustic shower tile 170. The acoustic shower tile 170 may include a magnet 173, a speaker frame 174, a drive coil 175, and a tile. The tile may include three different components: a standard tile component 171, a flexible tile component 172, and a speaker component 176. When the speaker is off, the surfaces of the components of the tile are substantially even or flush. The acoustic shower tiles 170 may be circular, square, or rectangular. The acoustic shower tiles 170 may have a standard tile dimension (4 inch square, 8 inch square, 12 inch square, 4 inch by 8 inch rectangle). Additional, different or fewer parts may be included in the acoustic shower tile 170.

The drive coil 175 receives an audio input from an audio source. The audio source may be incorporated into controller 222. The audio source may be connected to the acoustic shower tile 170 using a speaker wire (pair of wires). The audio source may be connected to the acoustic shower tile 170 wirelessly.

The space within the speaker frame 174 may have a predetermined volume. The predetermined volume may define a frequency range for the acoustic shower tile 170. The space within the speaker frame 174 may perform one or more functions of a speaker cone; however, there are no cones included in the acoustic shower tiles 170.

In response to the audio signal, the acoustic shower tile 170 generates sound (e.g., vibrations that travel from the acoustic shower tile 170 to the surrounding air). The drive coil 175 may be mounted to the speaker component 176, and the magnet 173 is mounted to the speaker frame 174, which may be rigidly mounted directly, or indirectly through one or more other shower tiles, to a building, such that the magnet 173 is stationary and the drive coil 175 moves. Alternatively, the drive coil 175 may be rigidly mounted to the speaker frame 174, which may be rigidly mounted to the standard tile component 171, which may be rigidly mounted directly, or indirectly through one or more other shower tiles, to a building.

The drive coil 175 may be energized by a baseline current which establishes a baseline position of the drive coil 175 and the magnet 173. The audio signal is added to the baseline current and causes the relative position of the drive coil 175 and the magnet 173 to change. The drive coil 175 pushes against the magnet (or is pulled into the magnet) according to the waveform off the audio signal. The drive coil 175 moves the speaker component 176 of the tile as it flexes from the standard tile component 171 as permitted by the flexible tile component 172.

The audio signal may be provided from an amplifier (e.g., via speaker wire). The audio signal may be provided wirelessly (e.g., Wifi, Bluetooth, or another protocol). The audio signal may represent white noise (e.g., sound having multiple frequency components at substantially the same power level). The audio signal may include low frequency sounds below a predetermined frequency (e.g., 10, 20, or 50 hertz). The audio signal may be selected according to relaxation or sounds of nature (e.g., ocean waves, whale sounds)). In one example, a microphone is configured to detect ambient sounds of the shower and the audio signal is substantially the inverse of the detected ambient sounds.

When the audio signal is provided wirelessly, or a local component such as the microphone is used to generate an audio signal, the acoustic shower tile 170 may be powered. That is, the acoustic shower tile 170 may be connected to a power supply. In some examples, the acoustic shower tile 170 may be wires to a standard outlet or house wiring. In some examples, acoustic shower tile 170 may include a battery. The batteries may be removable. In some examples, the batteries may be charged inductively through the acoustic shower tile 170.

Other alternatives for charging the batteries or otherwise providing the power supply may include solar power and water flow generated power. In the case of solar power, the acoustic shower tile 170 may include a window (e.g., transparent portion) where light passes to one or more photovoltaic cells (solar cells). The photovoltaic cells convert light energy to stored energy in the batteries. In the case of water flow generated power, a flow capture device is turned or otherwise actuated under the force of water. The flow capture device may be located near a plumbing fixture near the acoustic shower tile 170. The plumbing fixture may be the shower head. Water flows through the shower head, turns the flow capture device, and generates energy that is stored in the battery and later used to power the acoustic shower tile 170.

The flexible tile component 172 may be formed of a plastic, an elastomer, a thermoplastic elastomer, or another waterproof and flexible material. The flexible tile component 172 may include a thin layer of ceramic or porcelain. The standard tile component 171 may include stone, ceramic, or porcelain. The speaker component 176 may include stone, ceramic, or porcelain. The flexible tile component 172 may be attached to the standard tile component 171 and/or the speaker component 176 using adhesive. The materials for the each of the components of the acoustic shower tile 170 may be waterproof and resistant to cleaning compounds. The surfaces of each of the components of the acoustic shower tile 170 may be painted together (e.g., with a pattern) during manufacturing.

Figure 33:
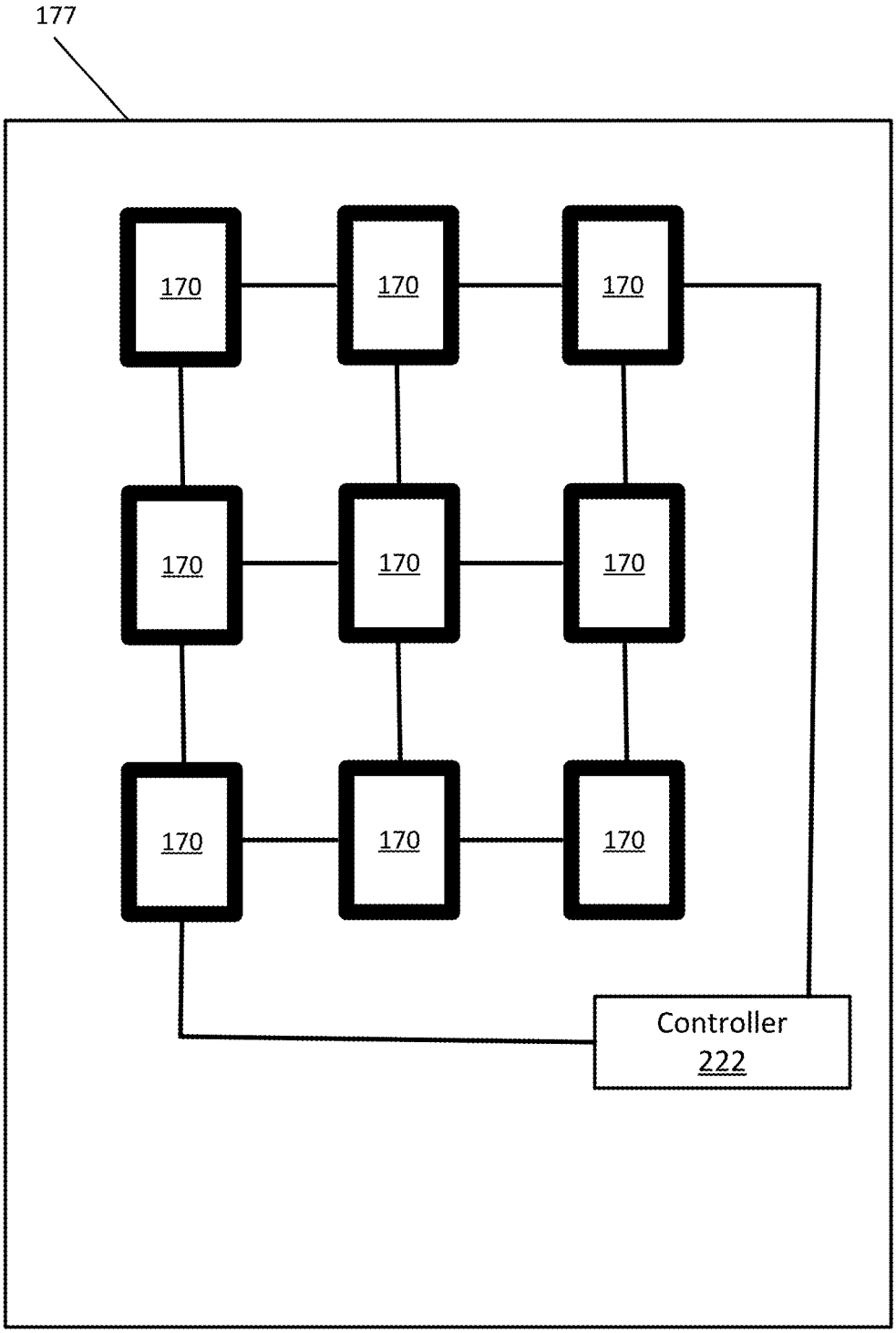
FIG. 33 illustrates an example shower wall with acoustic tiles.

FIG. 33 illustrates an example shower wall 177. The shower wall 177 includes multiple acoustic shower tiles 170 as described above. The acoustic shower tiles 170 may be arranged in a predetermined pattern. In some examples, the acoustic shower tiles 170 are "tiled" along with other tiles using grout or adhesive. In other examples, the shower wall 177 with multiple acoustic shower tiles 170 is installed as an integrated unit. The shower wall 177 may include aesthetic patterns derived from imbedded ferrous particles as described in embodiments herein. Other hardware of the shower wall 177 may be connected magnetically. The shower wall 177 may be combined with any magnetic stopper embodiments described herein. Additional, different or fewer components may be included.

An amplifier may be connected to the drive coil 175 to provide the audio signal to energize the drive coil 175. The output of the amplifier may be selected based on the impedance of the acoustic shower tiles 170. The amplifier may be implemented by controller 222. The controller 222 may instruct a power supply electrically coupled to the drive coil 175.

The acoustic shower tiles 170 in the tile wall 177 may be connected in a variety of patterns. One or more acoustic shower tiles 170 may be connected in parallel. One or more acoustic shower tiles 170 may be connected in series. It should be noted that two 8 ohm speakers in parallel will have a 4 ohm impedance from the perspective of the amplifier while two 8 ohm speakers in series swill have a 16 ohm impedance from the perspective of the amplifier. Therefore, in order to impedance match the acoustic shower tiles 170 to the amplifier, the acoustic shower tiles 170 may be arranged in a N by N pattern so that the N tiles in series are placed in parallel with N other series.

The controller 222 may receive an amplifier signal from an amplifier (e.g., stereo, head unit, television, WiFi speaker network, wireless network). The controller 222 may modify the amplifier signal for the acoustic shower tile 170. For example, the controller 222 may filter the amplifier signal according to an abbreviated frequency range of the acoustic shower tile 170 (e.g., 50 Hz-1 kHz). In another example, the controller 222 may modify the amplifier signal according to the impedance of the network of acoustic shower tiles 170.

The controller 222 may include a communication module electrically coupled to the drive coil. The communication module is configured to communicate with a network of acoustic shower tiles. The acoustic shower tiles 170 may include an integrated wire that connect adjacent tiles 170 when they are mounted together.

Figure 34:
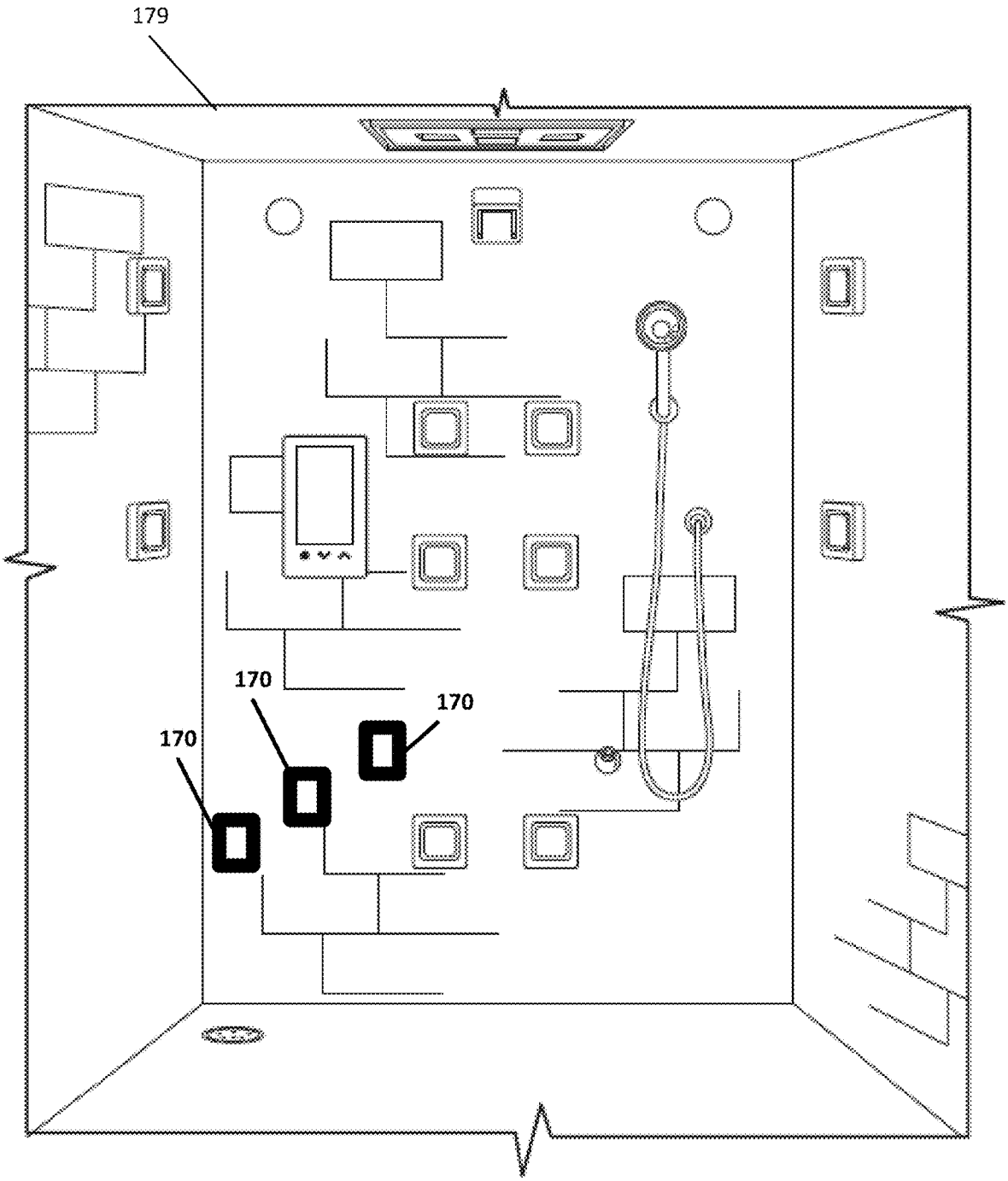
FIG. 34 illustrates an example shower with acoustic shower tiles.

FIG. 34 illustrates an example shower 179 including multiple acoustic shower tiles 170. One or more entire shower walls may be tiled using the acoustic shower tiles 170. Alternatively, selected positions may be used.

Figure 35:
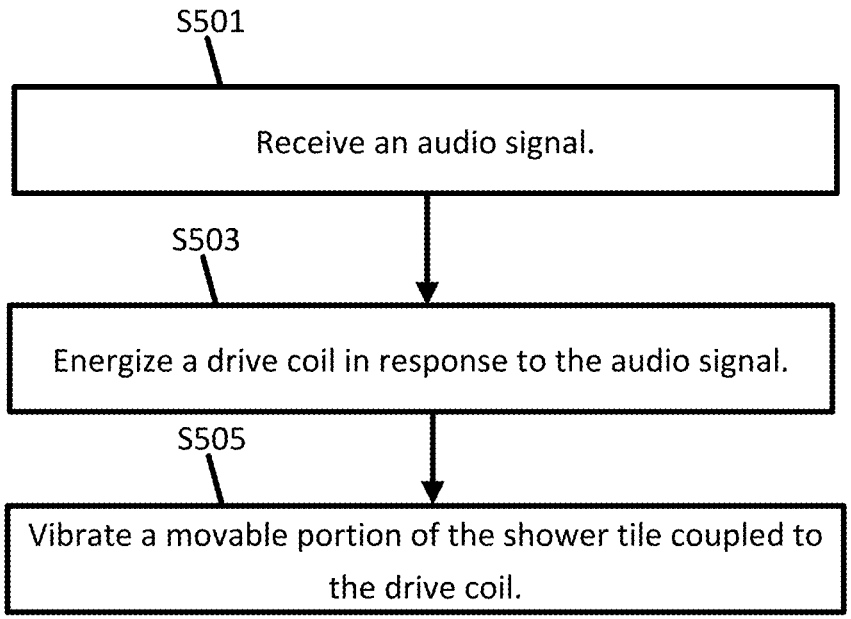
FIG. 35 illustrates an example flow chart for operation of an acoustic shower tile.

FIG. 35 illustrates an example flow chart for operation of the acoustic shower tile 170 to provide audio in a shower. Additional, different or fewer acts may be included.

At act S501, an audio signal is received at the acoustic shower tile 170. The audio signal may be received from an adjacent tile through an electrical contacts internal to the acoustic shower tile 170. The audio signal may be received from an amplifier via speaker wire. The audio signal may be received from wireless signal.

At act S503, a drive coil in the acoustic shower tile 170 is energized in response to the audio signal. Current from the audio signal, or through a separate power supply, energized the drive coil.

At act S505, a movable portion of the acoustic shower tile 170 coupled to the drive coil vibrates. The movable portion of the acoustic shower tile 170 is coupled to the drive coil. An adjacent portion of the acoustic shower tile 170 is flexible to allow movement in the movable portion of the acoustic shower tile 170.

Magnetic Washing

Figure 36:
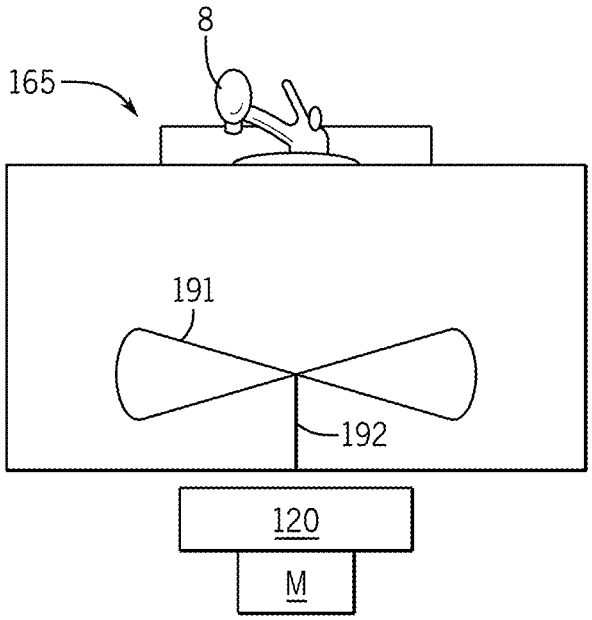
FIG. 36 illustrates a magnetically driven washer.

FIG. 36 illustrates a magnetically driven washer. A washing blade 191 may be placed in a basin 165 (e.g., kitchen sink). Below the basin 165 is a magnet 120 coupled with a motor M. The motor rotates the magnet 120 and the corresponding magnetic field pulls the washing blade 191. The speed may be relatively low (e.g., 20 to 100 revolutions per minute). The basin 16 with the washing blade 191 may serve as a gentle washing cycle for delicate clothes or other items. The washing blade 191 may be mounted on a support 192. The support 192 may also be magnetic and couple with a metal basin 165.

Figure 37:
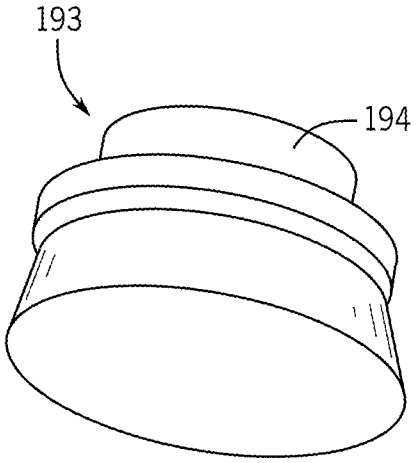
FIG. 37 illustrates a magnetically driven scrubber.

FIG. 37 illustrates a magnetically driven scrubber 193 including a magnetic drive system 194. The magnetic drive system 194 may include a rotating magnet (e.g., driven by a motor and rechargeable batteries). The rotating magnet may move sections of bristles or individual bristles under the magnetic field from the rotating magnet. The bristles may move due to water adhered to the bristles. The magnetically driven scrubber 192 may be used in kitchen sink, or in bathroom surfaces.

Magnetic In-Drain Stopper

Figure 38:
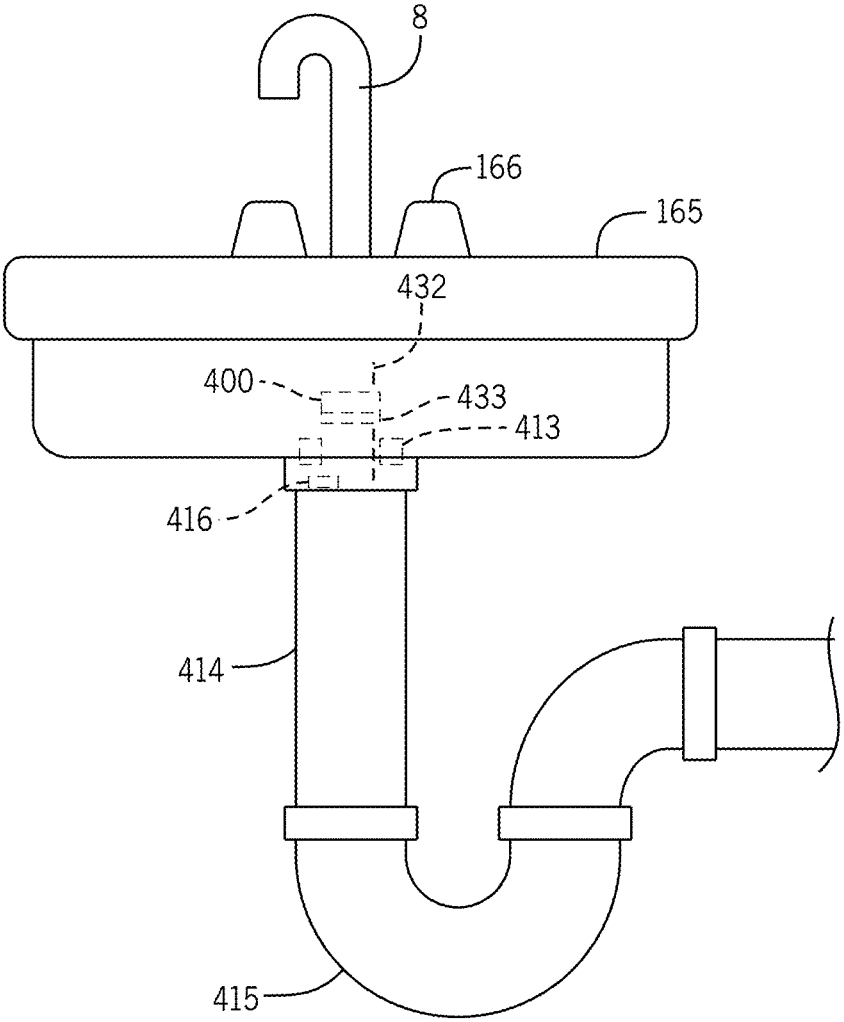
FIG. 38 illustrates a magnetic drain.

FIG. 38 illustrates a magnetic drain assembly including a magnetic stopper 400 having at least one magnet 433, and at least one drain magnet 413 positioned within or near a drainpipe 414 coupled to a plumbing system such as P-trap 415. In some examples, the magnetic stopper 400 may be stabilized or otherwise guided by guide 432. Additional, different, or fewer components may be included. The embodiments of FIGS. 38-44 may include a magnetic stopper 400 taking the form (relative size and shape) and positioning of magnets 433 as shown in FIG. 45.

The at least one drain magnet 413 may apply a magnetic force on the magnets 433 to open the magnetic stopper 400. Thus, by default, the drain remains open. The guide 432 may keep the magnetic stopper 400 aligned above the drainpipe 414. The magnetic stopper 400 includes an opening and the guide 432 extends through the opening. The guide 432 may be a stiff wire, a metal rod, or a plastic rod. The guide 432 may not be connected or coupled to the magnetic stopper 400. The magnetic stopper 400 may be removed by lifting the magnetic stopper 400 off of the guided 432.

To close the magnetic stopper 400, the user may press down on the magnetic stopper 400 against the force from the drain magnets 413. The magnetic stopper 400 slides along the guide 432 and makes contact with latch 416. The latch 416 grips the magnetic stopper 400 to hold the magnetic stopper 400 and the drainpipe 414 closed. Pressing the magnetic stopper 400 again releases the magnetic stopper 400 to return to the open position under the force from the at least one magnet.

Figure 39:
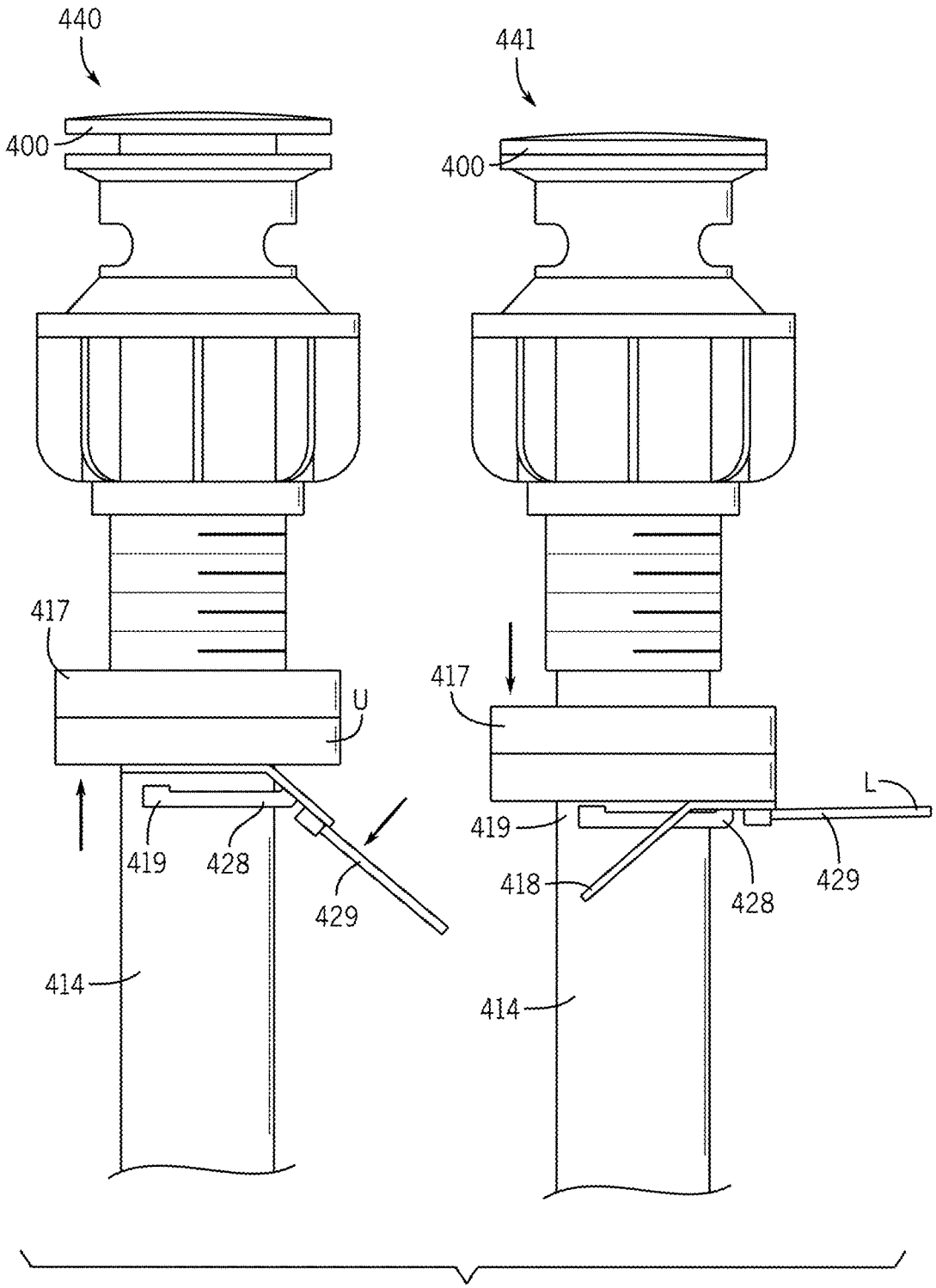
FIG. 39 illustrates a hinge actuator for a magnetic stopper.
Figure 40:
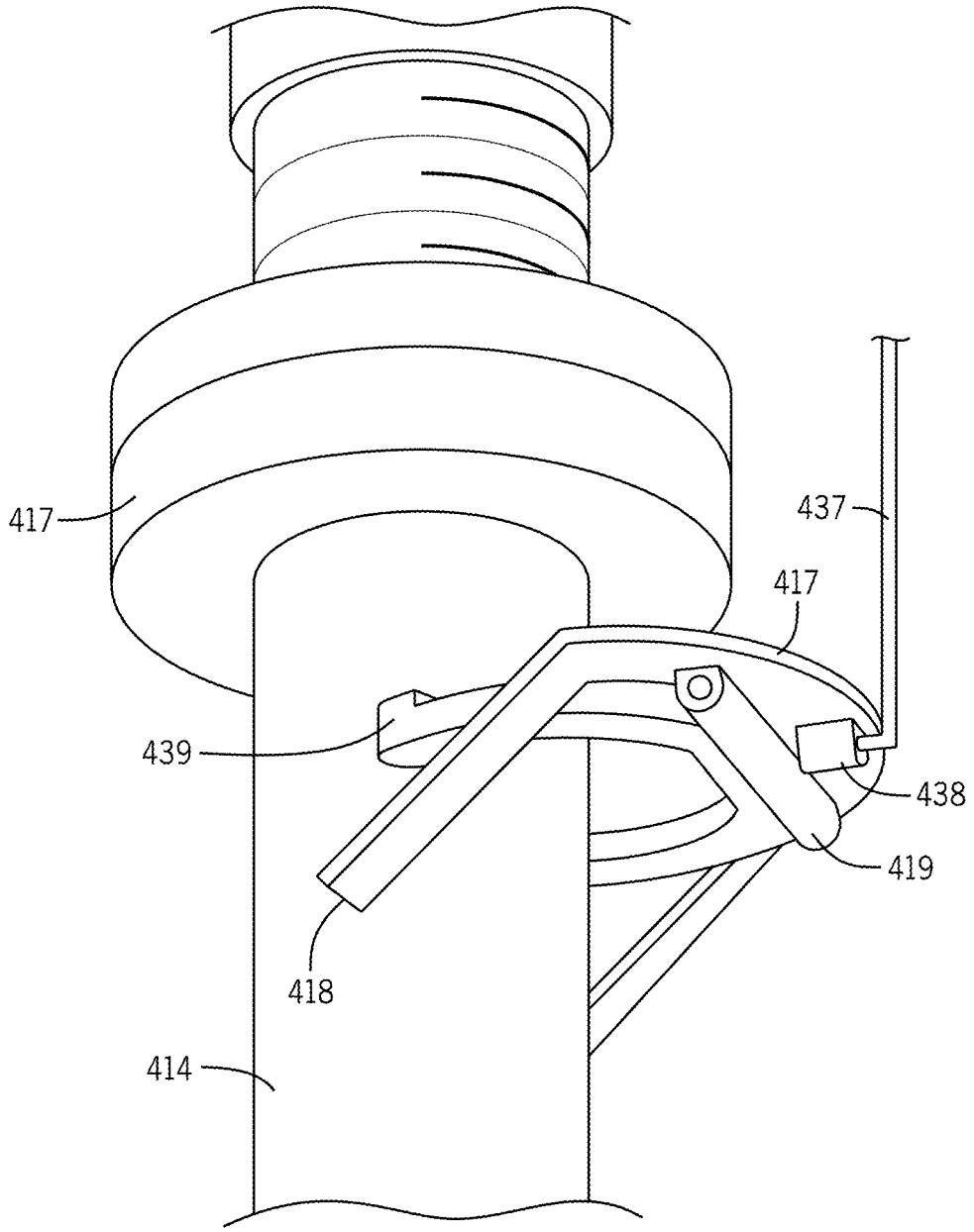
FIG. 40 illustrates another view of the hinge actuator.

FIGS. 39 and 40 illustrate a lifting mechanism for a magnetic stopper 400. The magnetic drain assembly is illustrated in open state 440 and closed state 441. The magnetic drain assembly may include a lift mechanism including hinge 428. Additional, different, or fewer components may be included.

The lift mechanism has a first planar surface 429 and a second planar surface 418. The hinge 428 is connected to the first planar surface 429 or the second planar surface 418. As illustrated in FIGS. 39 and 40, the hinge is 428 is connected to the first planar surface 429. The hinge 428 allows the first planar surface 429 to rotate relative to the second planar surface 418. As shown in FIG. 40, a tension fastener 439 holds the lift mechanism to the drainpipe 414. The tension fastener 439 may fit into an indent or groove in the drainpipe 414.

The lift mechanism may include a connector 438 that is connected to a pull rod 437 that extends above the sink or counter or extends through the faucet 8 (not shown). As the user moves the pull rod, the hinge 428 is rotates between the open position (open state 440 of the drain assembly) and the closed position (closed state 441 of the drain assembly). When the pull rod 437 is pushed down, a force is applied to the first planar surface 429. As the hinge 428 rotates, the second planar surface 419 also rotates to push the magnets 417 upward to an upper height U. As the magnets 417 move upward, the magnetic force is applied to the magnetic stopper 400 inside the drainpipe 414 and the drain is opened.

When the pull rod 437 is pulled up, the first planar surface 429 is rotated upward and the second planar surface 418 is rotated downward. Thus, as shown in closed state 441, the magnets 417 rest on the first planar surface 429 at the lower height L. During the close state 441, the second planar surface 418 is not in contact with the magnets 417. As the magnets 41 move downward, the magnetic stopper 400 inside the drainpipe 414 is closed. In some examples, the magnetic stopper 400 is pulled closed by the magnetic force. In some examples, the magnetic stopper 400 falls under gravity to the closed state 441.

The open position of the lift mechanism corresponds to the upper height U height for the magnet 417. The closed position of the lift mechanism corresponds to the lower height for the magnet 417. The vertical difference between the upper height U and the lower height L is smaller than the distance moved by the pull rod 437 between the first position and the second position. The vertical difference between the upper height U and the lower height L may be set according to the position of the hinge 428 along the second planar surface 429. In other examples the hinge 428 may be placed along the first planar surface 429 and the vertical difference between the upper height U and the lower height L may be greater than the distance moved by the pull rod 437 between the first position and the second position.

As an alternative to the connection with the pull rod 437, the connector 438 may be connected to a solenoid or other powered actuator. The powered actuator may receive a drive signal based on a user input (e.g., capacitive sensor in the basin or faucet). In response to the drive signal, the powered actuator rotates the lifting mechanism to transition the magnetic stopper 400 between the open state 440 and the closed state 441 and vice versa.

Figure 41:
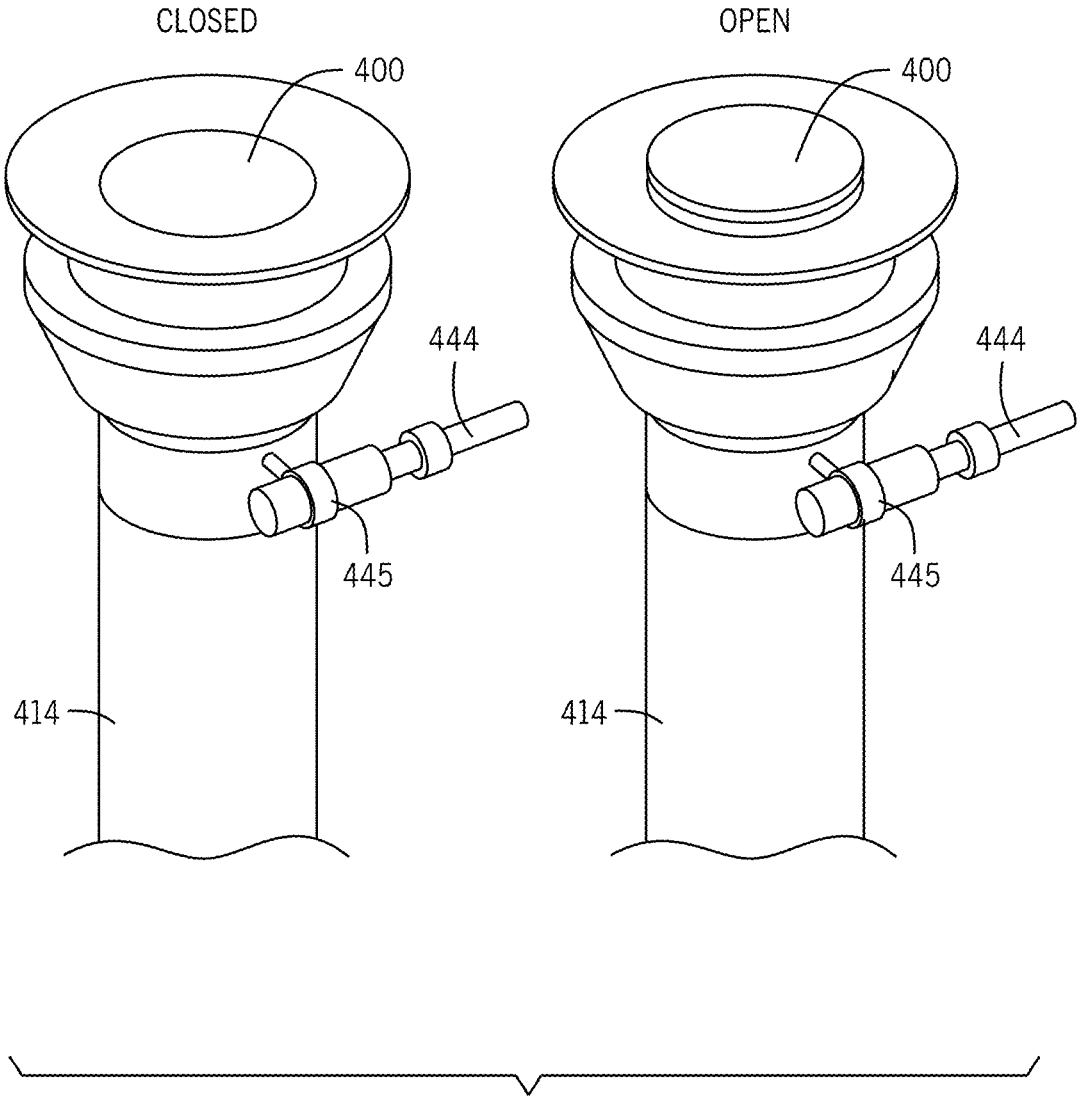
FIG. 41 illustrates a rotating actuator for a magnetic stopper.

FIG. 41 illustrates a rotating actuator for the magnetic stopper 400 such that the first and second positions of the drain are rotational positions of the magnetic stopper 400. The magnetic stopper 400 may include an inclined plane or be seated in a screw vane such that the magnetic stopper 400 is raised and/or lowered through rotation. For example, clockwise rotation of the magnetic stopper 400 may close the magnetic stopper 400 and counterclockwise rotation of the magnetic stopper 400 may open the magnetic stopper 400.

Alternatively, a lifting mechanism 445 on the outside of the drainpipe 414 may move up and down under rotational motion. The lifting mechanism 445 may include at least one magnet movable with respect to the drainpipe 414 and external to the drain pipe 414. In a first position, the lift mechanism 445 lifts the at least one magnet to open the magnetic stopper 400. In a second position, the lift mechanism 445 lowers the at least one magnet to close the magnetic stopper 400.

The lifting mechanism 445 may ride on an inclined plane or be seated in a screw vane such that the lifting mechanism 445 is raised and/or lowered through rotation. For example, clockwise rotation of the lifting mechanism 445 may lower the lifting mechanism 445 to close the magnetic stopper 400 by magnetic force and counterclockwise rotation of the lifting mechanism 445 raise the lifting mechanism to open the magnetic stopper 400.

The lifting mechanism 445 may be movable by an extension rod 444. The extension rod 444 may be connected to a cam that is drive by a pull rod such that vertical motion of the pull rod translates to horizontal motion of the extension rod 444. Thus, when the user lifts the pull rod, the cam is rotated, and the extension rod 444 rotates the lifting mechanism 445 to open the magnetic stopper 400.

Figure 42:
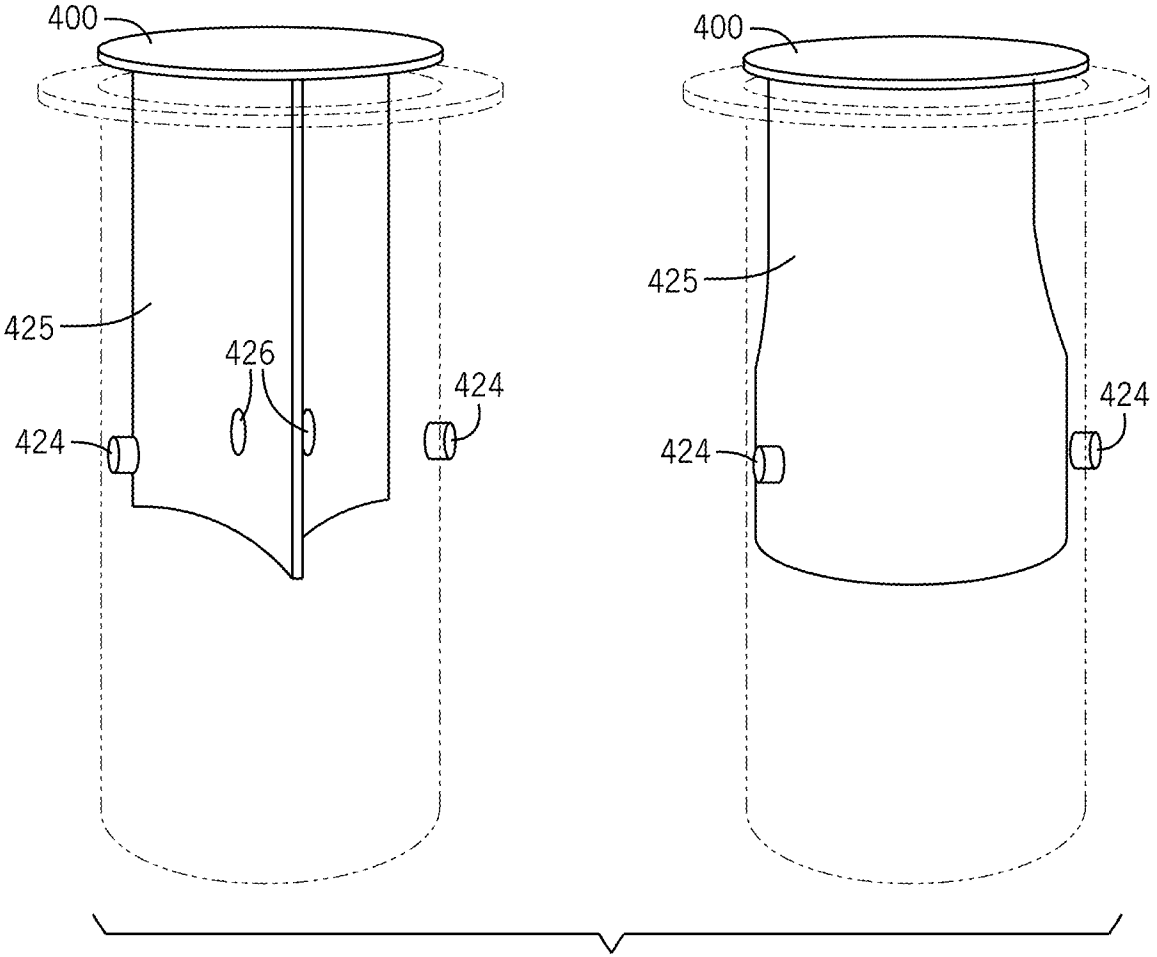
FIG. 42 illustrates a flexible membrane for the magnetic stopper.

FIG. 42 illustrates a flexible membrane 425 for the magnetic stopper 400. The flexible membrane 425 includes magnets 426. The flexible membrane 425 may be biased through a spring or natural elasticity to partially be folded within the drainpipe 414 so that the drain pipe 414 is open. When magnets 424 on the exterior of the drainpipe 414 are activated (e.g., an energized electromagnet), the magnets 426 are attracted to the magnets 424 and the flexible membrane 425 is unfolded to close the drain pipe 414.

Figure 43:
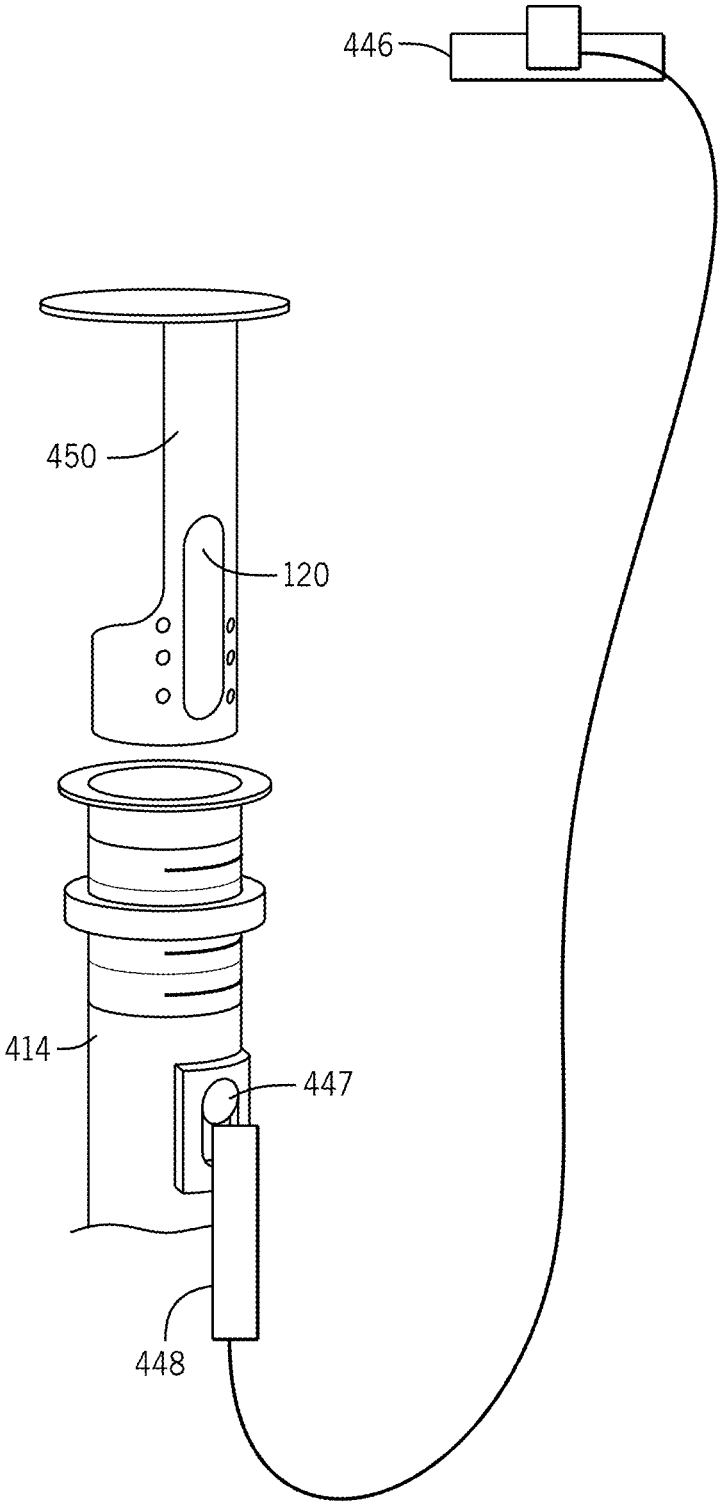
FIG. 43 illustrates a sliding actuator for a magnetic stopper.

FIG. 43 illustrates another magnetic stopper 450 including a magnet 120 that fits within the drainpipe 414 and is configured to selectively open and close the drain. The magnet 120 of the magnetic stopper aligns with a sliding actuator 447. The sliding actuator 447 includes a magnet that is slidable with respect to the drainpipe 414 and external to the drain pipe 414.

The actuator 447 is another example lift mechanism operable in the first position moves the magnet 120 to open the magnetic stopper 450 or in the second position the moves the magnet 120 to close the magnetic stopper 450.

The actuator 447 may include a solenoid 448, a motor, or another driven device configured to slide the magnet up and down under a signal from a switch 447. The switch may open and close an electrical connection to drive the solenoid 448 or the motor. The switch 447 may include a level that moves a cable to drive the actuator 447 up and down.

Figure 44:
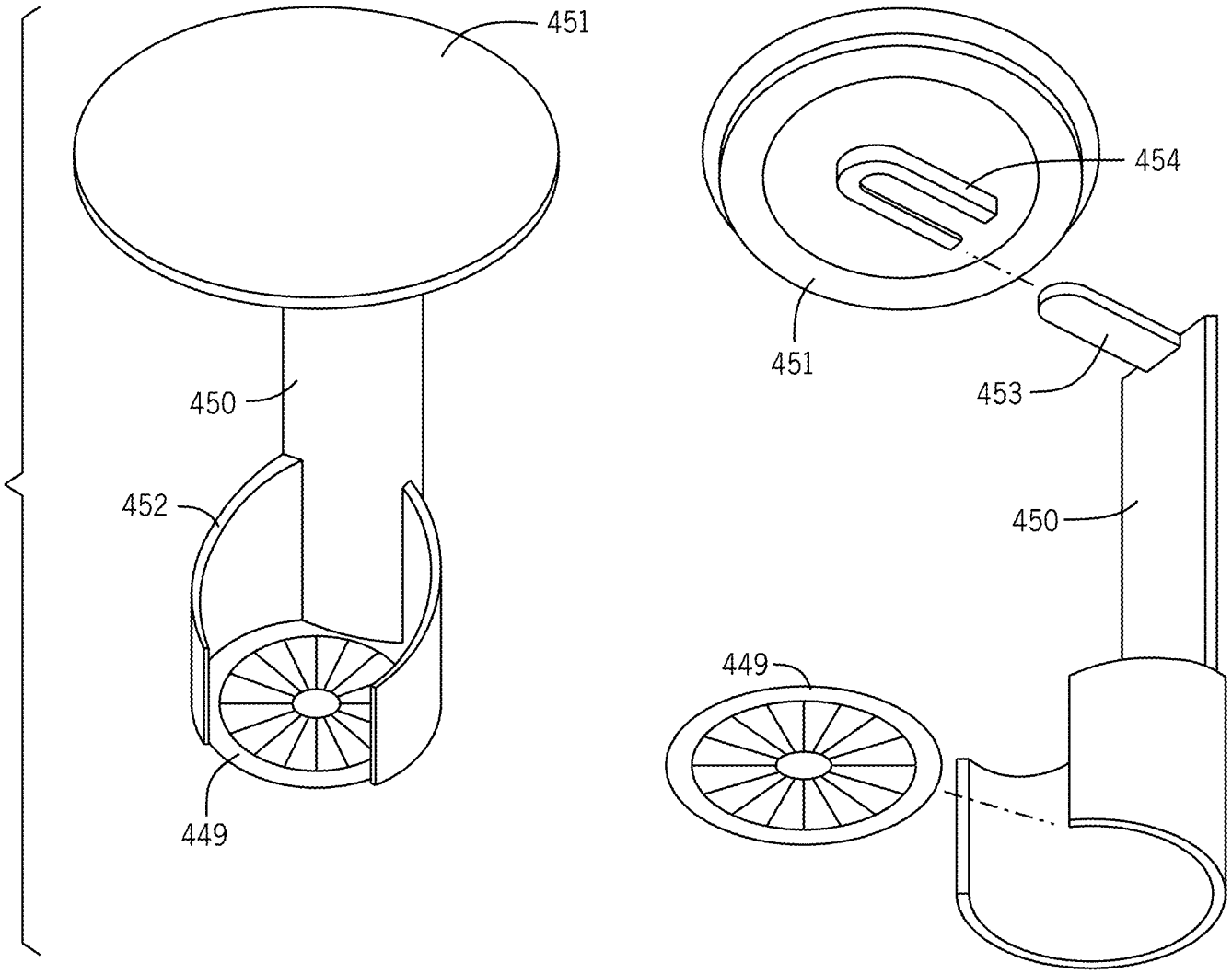
FIG. 44 illustrates a catcher for the magnetic stopper.
Figure 45:
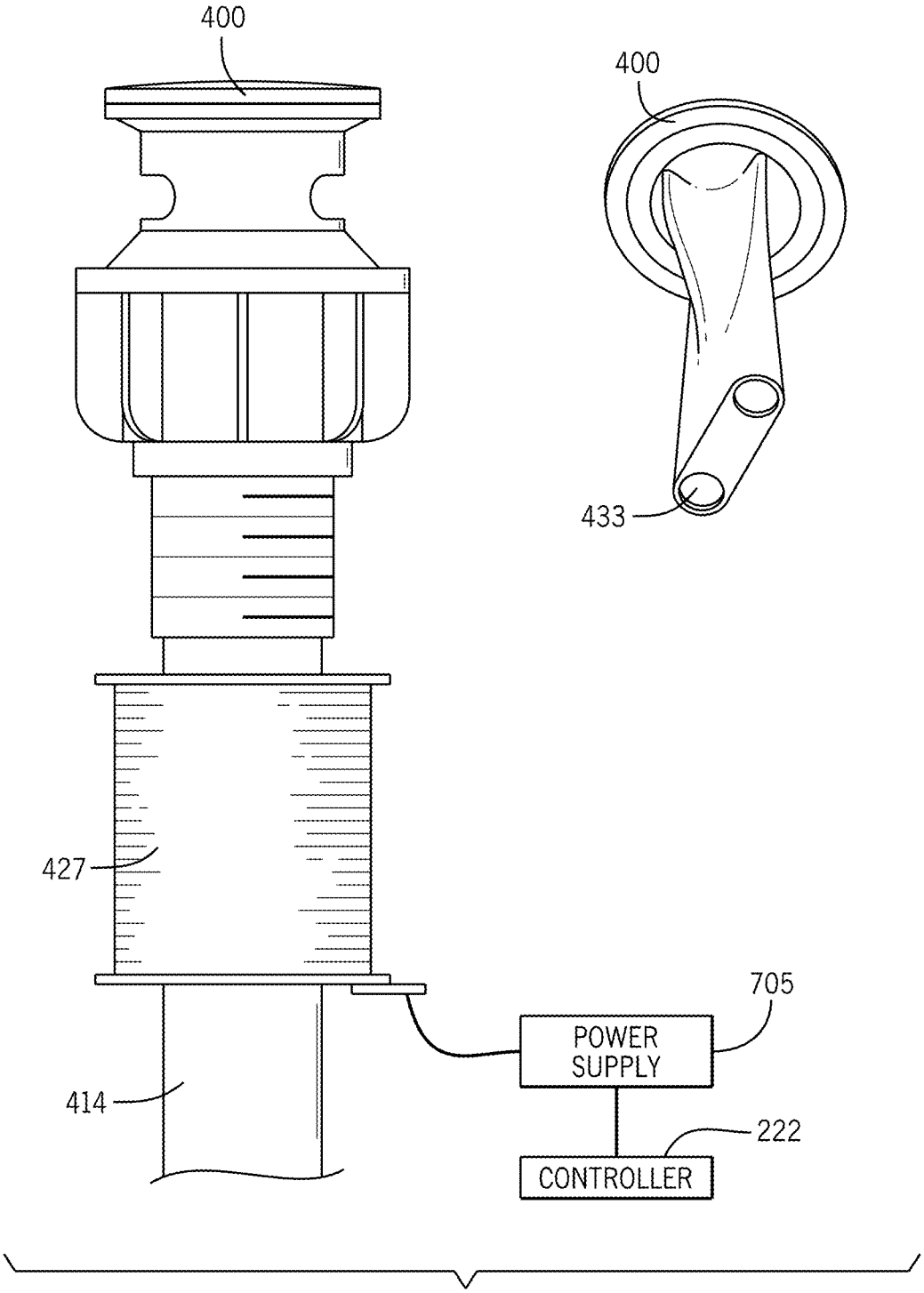
FIG. 45 illustrates an electromagnetic actuator for the magnetic stopper.

FIG. 44 illustrates another embodiment for the magnetic stopper 450 including a catcher 449 and a cap or removable cover 451. Additional, different, or fewer components may be included. The catcher 449 is a debris catcher coupled to the magnetic stopper 450 that includes at least one opening have a size to allow water to pass but stop debris carried in the water. Example debris includes hair, rocks, wood, jewelry, or other objects.

The catcher 449 may include a filter, a plate, or a screen configured to remove debris from the water flow through the drainpipe 414. The catcher 449 may be removable. The magnetic stopper 450 may be lifted out of the drainpipe 414 and the catcher 449 is removable from a groove or snap-fit connection. The catcher 449 may be secured to the collar 452 of the magnetic stopper 450. The collar 452 is sized to fit in the drainpipe 414, which allows the magnetic stopper 450 to slide up and down the drain pipe 414 and maintain a substantially vertical orientation.

The magnetic stopper 450 may include a removable cover 451. The removable cover 451 may be swapped out to allow for different materials (e.g., chrome, brushed nickel) or colors. The removable cover 451 may include a slot 454 for connecting to the magnetic stopper 450. A protrusion 453 at the top of the magnetic stopper 450 may be received at the slot 454 for coupling the removable cover 451 to the magnetic stopper 450.

The protrusion 453 may also be a handle for removal of the magnetic stopper 450 from the drainpipe 414. That is, the user may list the magnetic stopper 450 out of the drainpipe 414 by gripping the handle. Upon removal of the magnetic stopper 450, the catcher 449 may be cleaned of debris.

FIG. 45 illustrates an electromagnetic actuator 427 for the magnetic stopper 400 in drainpipe 414. The electromagnetic actuator 427 may include a single electromagnet or multiple electromagnets. When multiple electromagnets are used, one electromagnet may be configured to raise the magnetic stopper 400 and another electromagnet may be configured to lower the magnetic stopper 400.

One example shape for the drain stopper 400 and integrated magnets 433 is illustrated. The electromagnetic actuator 427 is configured to generate a magnetic field operable to open the magnetic stopper 400 by applying a magnetic force to push the magnets 433 up and/or close the magnetic stopper 400 by releasing the magnetic force or applying an opposite magnetic force to pull the magnets down.

A power supply 705 configured to energize the coils of the electromagnet actuator 427. When the coils are energized, the electromagnetic actuator 427 pushes the magnetic stopper 400 to open the drain. In some examples, the power supply 405 may be configured to reverse polarity on the electromagnetic actuator 427 to reverse the magnetic force and cause the electromagnetic actuator 427 to pull the magnetic stopper 400 to close the drain.

A switch configured to receive a user input and energize or deenergize the electromagnet in response to the user input. The switch may be a button or electronic sensor configured to receive a user input. The controller 222 may operate as a switch. The controller 222 may operate the switch in response to sensor data. A sensor configured to detect a user touch or gesture may provide sensor data to the controller 222. The controller 222 energizes or deenergizes in response to the user touch or gesture. Alternatively, the user input is received from wireless communication.

In any of these examples, the magnetic drain stopper 400 may be combined with a sink including a valve that is attached to the sink using a magnetic coupling and/or a valve configured to open a water supply to basin in response to the user input.

Magnetic Levitating Stopper

Figure 46:
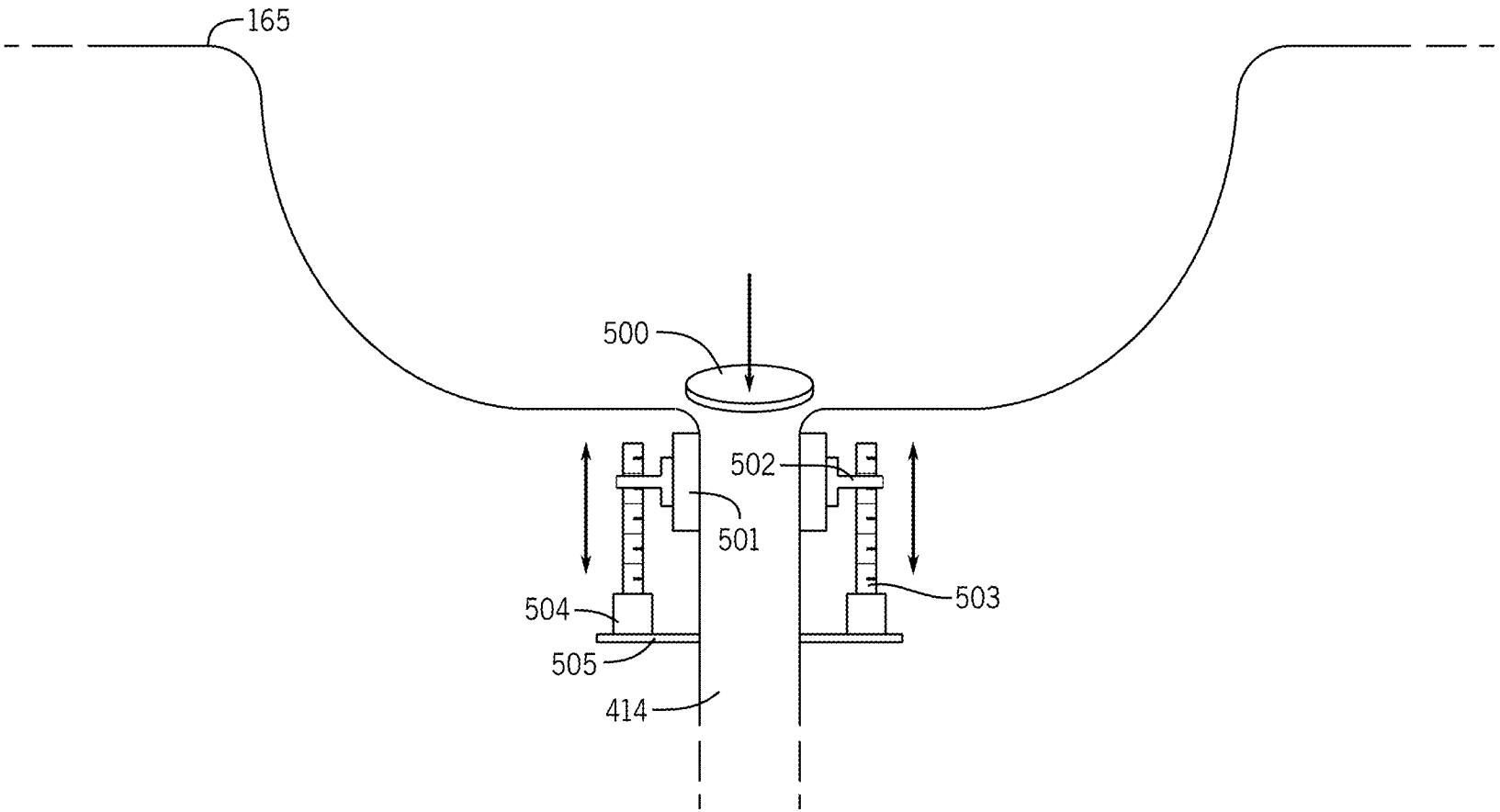
FIG. 46 illustrates a levitating drain stopper.
Figure 47:
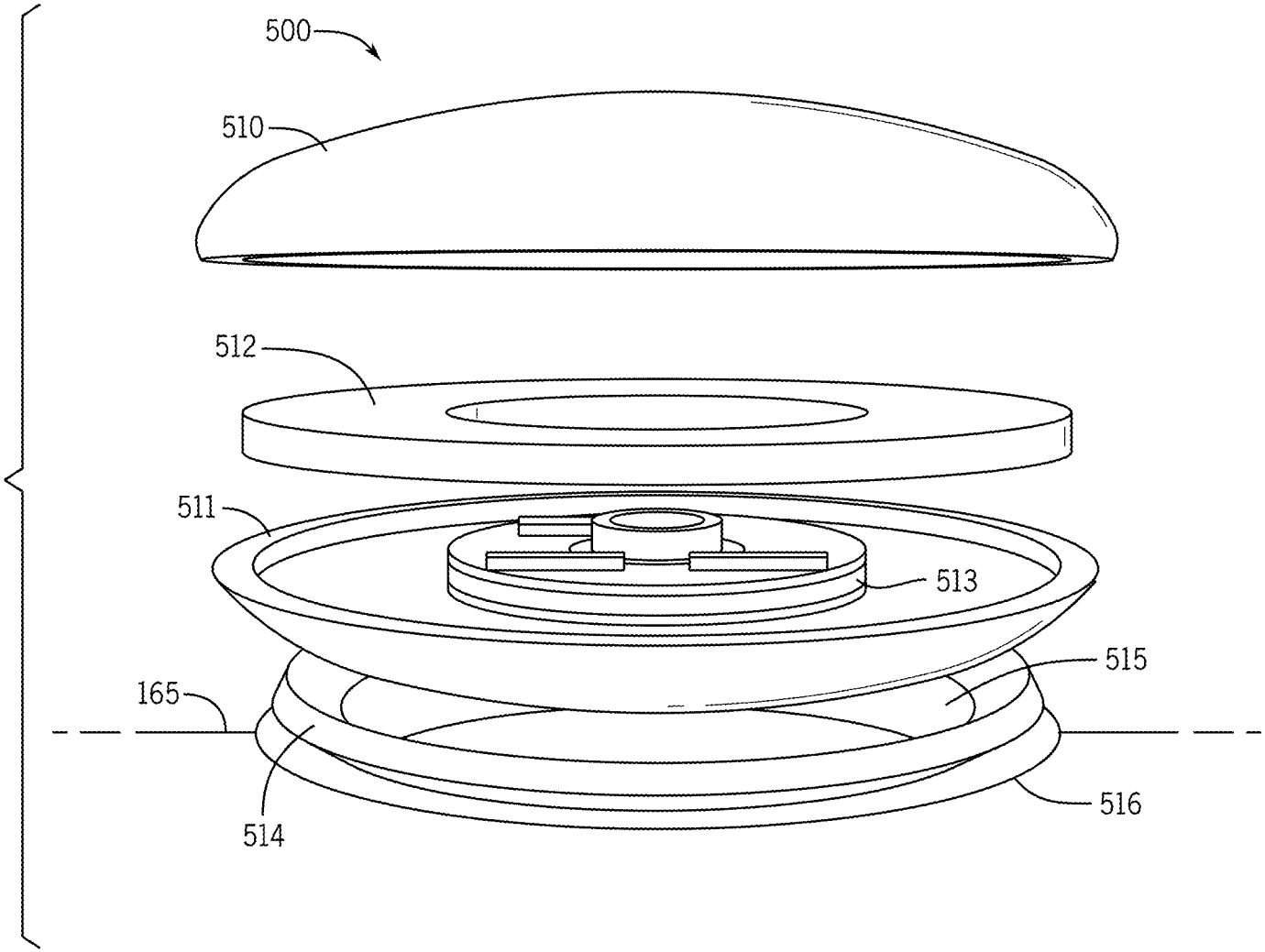
FIG. 47 illustrates an exploded view of the levitating drain stopper.

FIG. 46 illustrates a levitating drain stopper 500. FIG. 47 illustrates an exploded view of the drain stopper 500 including a shell top 510, a shell base 511, a magnet 512, a circuit board 513, a gasket 514, a light 515, and an electromagnet 516. The electromagnet 516 may be imbedded or otherwise contained with the basin 165. Additional, different or fewer components may be included.

The levitating drain stopper 500 is moved by the lifting mechanism in FIG. 46 including a support 505, a servomotor 504, a shaft 503, a magnet arm 502, and a magnet 501. The levitating stopper 500 includes a gasket 514 configured to seal an opening in the basin 165. The gasket 514 may be a rubber seal. The gasket 514 may be coupled to the shell base 511. The servomotor 504 is a motor configured to raise and lower the magnet arm 502 with respect to the basin 165. The magnetic arm 501 may also be configured in a mechanical, non-electrical fashion similar to FIGS. 39, 40, and 41.

The magnet arm 502 is configured to apply a force on the levitating drain stopper 500 to open the opening in the basin by levitating the levitating drain stopper 500 above the basin 165. In some examples, the magnet arm 502 is also configured to close the opening in the basin 165 by lowering the levitating drain stopper 500. In other examples, the levitating drain stopper 500 lowers only under the force of gravity (e.g., in the absence of the magnetic field).

The shell top 510 and the shell base 511 may form an enclosure that is airtight and water tight (e.g., hermetically sealed). The shell top 510 and the shell base 511 may be formed of a lightweight material such as plastic or resin. Other examples may be formed of stone or ceramic. The combined shell top 510 and shell base 511 may have a shape of a rounded cylinder, a sphere, a torus, a donut torus with no hole, or a horn torus. Such shape may be constructed by a parabola rotated about an axis tangent to the parabola.

The magnet 512 is housed between the top shell 510 and the shell base 511. The magnet 512 may be neodymium. The size of the magnet 512 may be selected to lift the other components off the levitating magnetic stopper 500. The exploded view in FIG. 47 shows a single permanent magnet, the stopper may be configured with a plurality of magnets. It may include a combination of permanent magnets and electromagnets.

The outside of the housing (e.g., shell base 511) may direct the light 515 toward the drain of the basin 165. The light 515 may provide aesthetic effect. The light 515 may allow the user to determine visually whether the levitating magnetic stopper 500 is open or closed. A speaker may be configured to provide an audible indication of whether the levitating magnetic stopper 500 is open or closed.

The circuit board 513 may be located between the top shell and the shell base. The circuit board 513 may include a battery for supplying power to the light 515 or the speaker. The light 515 and/or the speaker may be directly connected to the circuit board 513. The battery and electronic assembly may include inductive charging coil or other hardware to allow for wireless charging through the basin 165 below.

The electromagnet 516 may be coupled to a power supply and/or a controller 222. The electromagnet 516 may be a combination of permanent and electromagnets. A switch configured to energize or deenergize the electromagnet in response to a user input. The switch may operate directly from the user input. In other examples, the switch provides an input to controller 222 which sends the instruction to energize or deenergize the electromagnet.

The controller 222 may include a communication module configured to receive a wireless signal from a remote control, a phone, a tablet, a computer or the internet. The wireless signal instructs the controller 222 to send the instruction to energize or deenergize the electromagnet.

Figure 48:
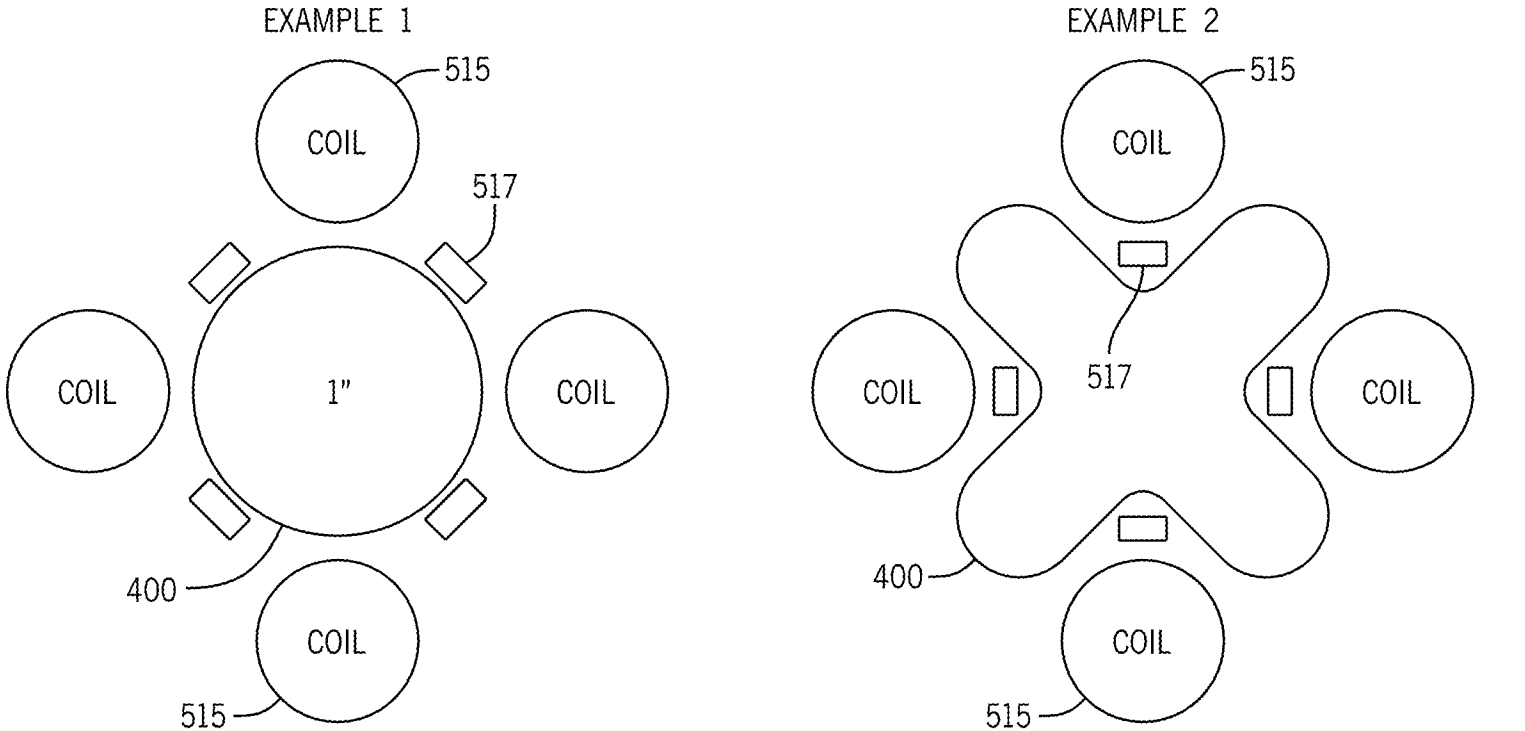
FIG. 48 illustrates sensor arrangements and drain stopper shapes.

FIG. 48 illustrates sensor arrangements and drain stopper shapes and sensor arrangements. A sensor 517, or a group off sensors 517, provides feedback for the operation of the magnetic stopper 400 (magnetic stopper 500 may be used in any of these examples). The sensor 517 may determine the position off the magnetic stopper 400. The sensor 517 may provide feedback to the controller 222 for stabilizing the magnetic stopper 400. The sensor 517 may determine whether the magnetic stopper 400 is higher or lower than the intended height. The sensor 517 may determine whether the magnetic stopper 400 is rotating in the horizontal plane. In some examples, the magnetic stopper 400 may rotate at a predetermined rate and the sensor data indicates whether the magnetic stopper 400 is rotating too slow or too fast to maintain stability. The sensor arrangements and/or drain stopper shapes may be applied to any of the magnetic stopper or levitating stopper embodiments.

FIG. 48 illustrates that the magnetic stopper 400 may include a cylindrical shape (as shown in example 1) or a ribbed shape (as shown in example 2). The sensors 517 and electromagnets 516 may be arranged based on the shape of the magnetic stopper 400. When the drain stopper 400 includes multiple ribs, the electromagnets 516 and the sensors 517 may be arranged between pairs of the ribs.

Figure 49:
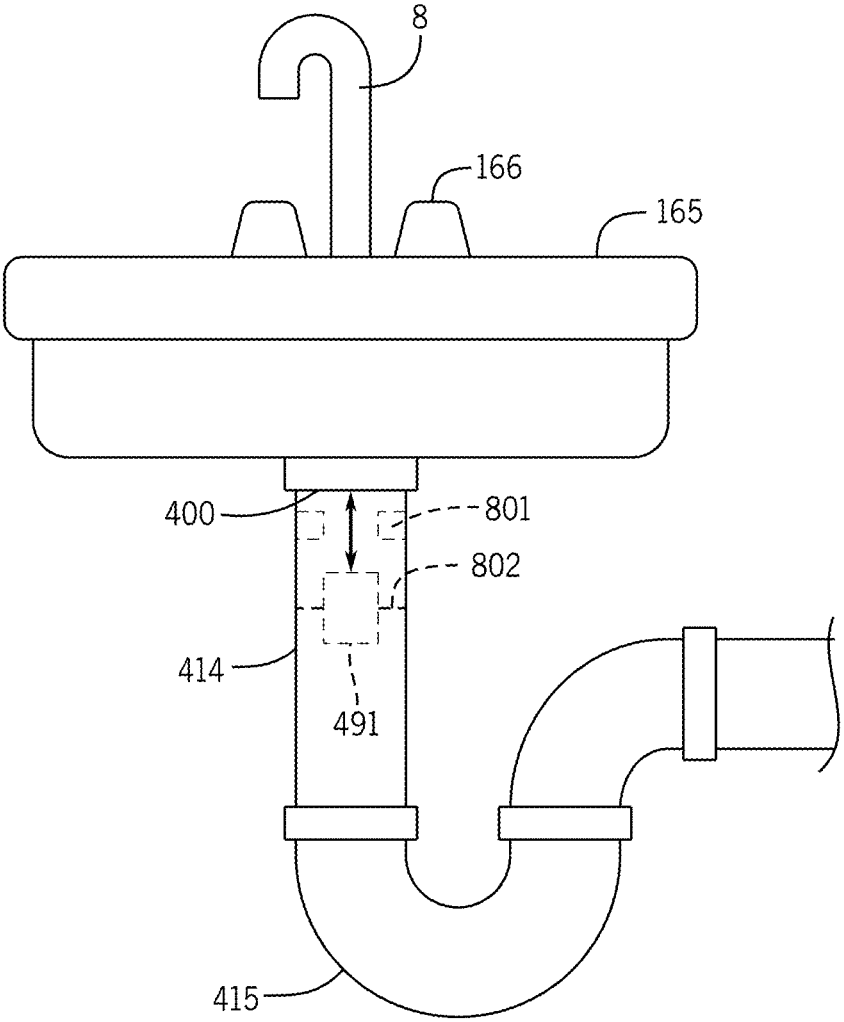
FIG. 49 illustrates another embodiment of a magnetic drain.

FIG. 49 illustrates another embodiment of a magnetic drain that opens down into the drain pipe 414. A tether 802 prevents a magnetic drain stopper 491 from falling below a lower limit. Magnets 801, corresponding to any of the other examples herein, provides a magnetic force to lift the magnetic drain stopper 491 and close the drain.

Figure 50:
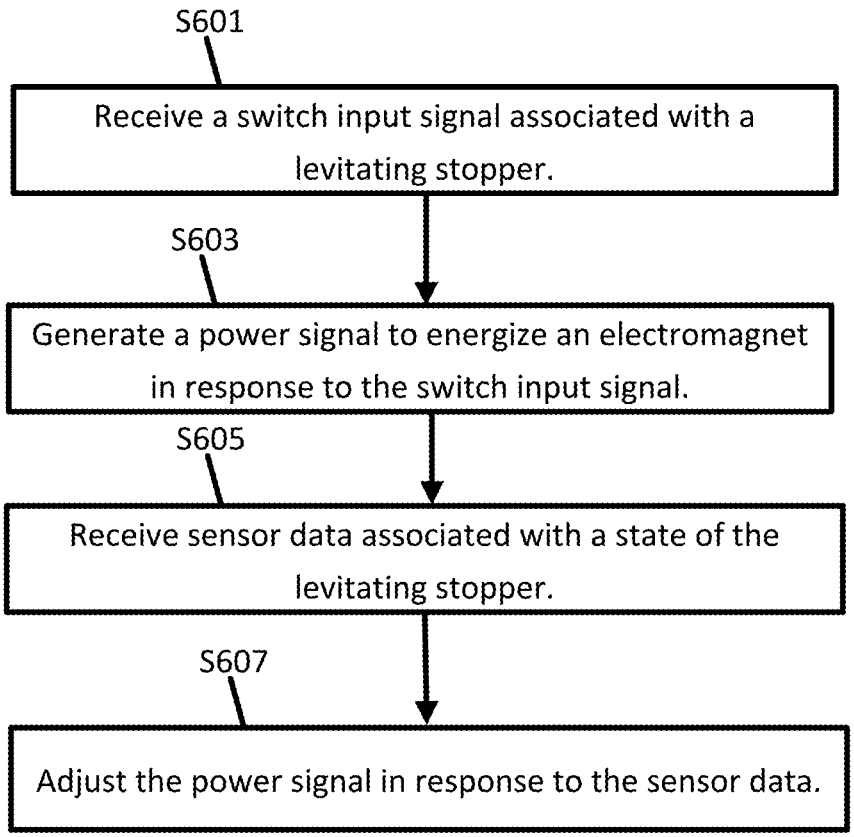
FIG. 50 illustrates a flowchart for operation of a magnetic drain.

FIG. 50 illustrates a flowchart for operation of a magnetic drain. Additional, different or fewer acts may be included.

At act S601, the controller 222 receives a switch input signal associated with a levitating stopper. The switch input may be a capacitive switch on a faucet or basin. The switch input may be activating by gesture. The switch input may be activated by the presence of the user at the faucet or basin. The switch input may be received from another device such as a mobile device.

At act S603, the controller 222 generates a power signal to energize an electromagnet in response to the switch input signal. The electromagnet applies a magnetic force on the levitating stopper to open the opening in the basin by levitating the levitating stopper above the basin.

The switch input may be an audio command. One example audio command may set a time period for closing the magnetic stopper. The audio command may be "fill for seconds." The controller 222 is configured to start a timer in response to the input. The controller 222 may adjust the power signal in response to the timer. For example, the controller may close the magnetic stopper for the designated duration then open the magnetic stopper. In another example, the audio commend may designate a position for the magnetic stopper. The audio command may be "open the magnetic stopper at 10% full height."

At act S605, the controller 222 receives sensor data associated with a state of the levitating stopper. The sensor data may describe the vertical position, the rotating position, or other property of the levitating stopper. At act S607, the controller 222 adjusts the power signal in response to the sensor data. Alternatively, the controller 222 may adjust the power signal in response to a subsequent user input. The user input may describe a height for the levitating stopper or an operation of a light included in the levitating stopper.

Magnetic Catch

Figure 51:
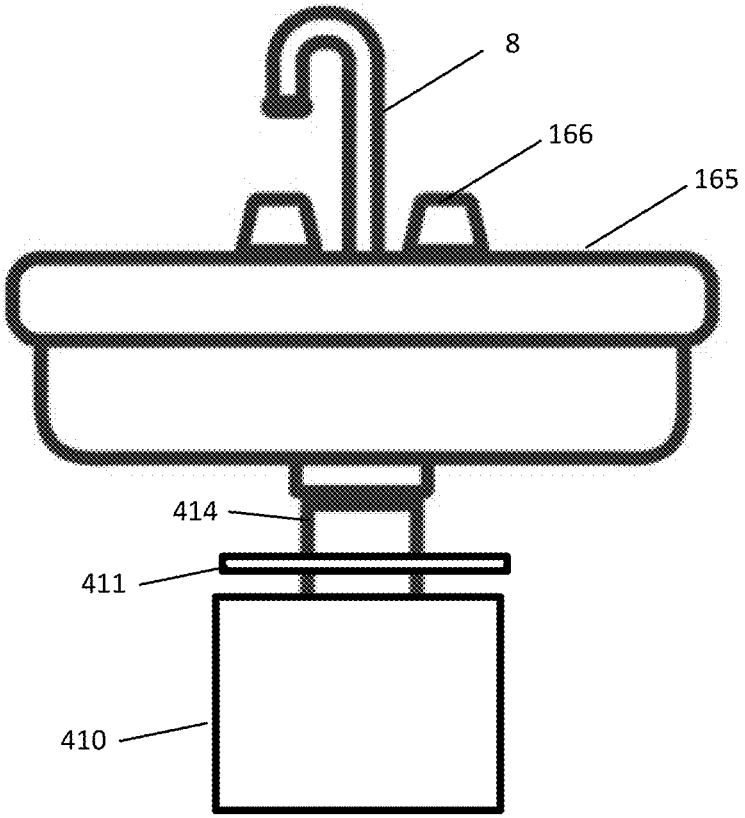
FIG. 51 illustrates a magnetic catch.

FIG. 51 illustrates a magnetic catch 411 for drain pipe 414. The magnetic catch 411 may be a circular magnet on the outside of the drain pipe 414 that catches metal object, ferromagnetic objects, or magnetic objects or that may fall into the drain of the basin 165. Examples include silverware and jewelry. The magnetic catch 411 generates a magnetic field that will cause the object to stick to the inside of the drain pipe 414 rather than fall into the garbage disposal 410.

Figure 52:
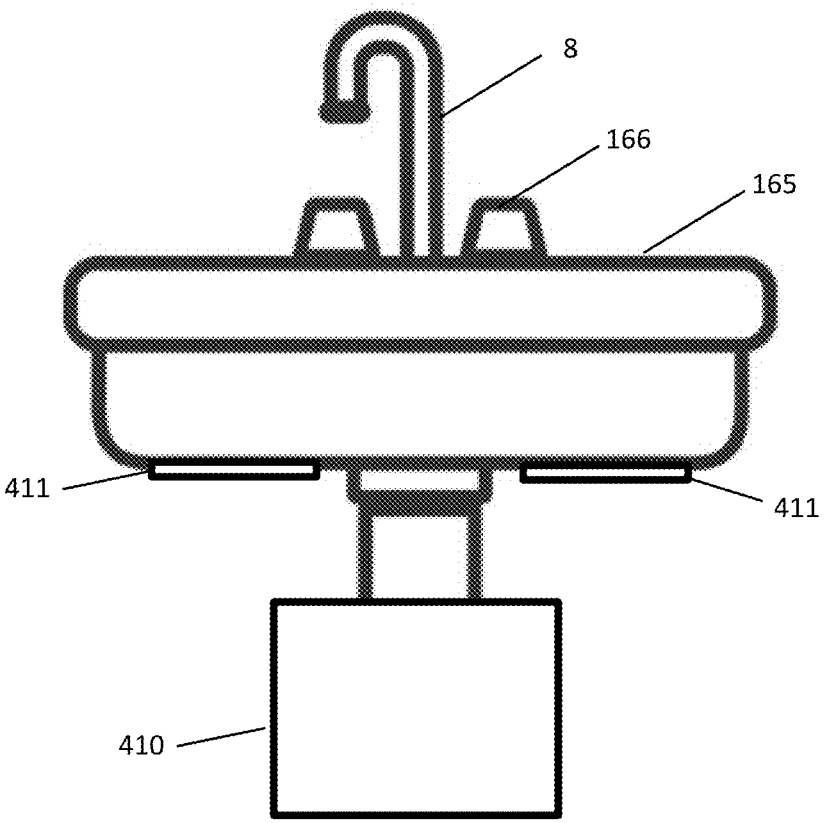
FIG. 52 illustrates another embodiment for a magnetic catch.

FIG. 52 illustrates another embodiment for the magnetic catch 411. In this embodiment, the magnetic catch 411 is mounted under the basin 165. The magnetic catch 411 attracts metal object, ferromagnetic objects, or magnetic objects to the bottom of the basin 165 to reduce the likelihood they fall down the drain or into the garbage disposal 410.

Magnetic Drive

Figure 53:
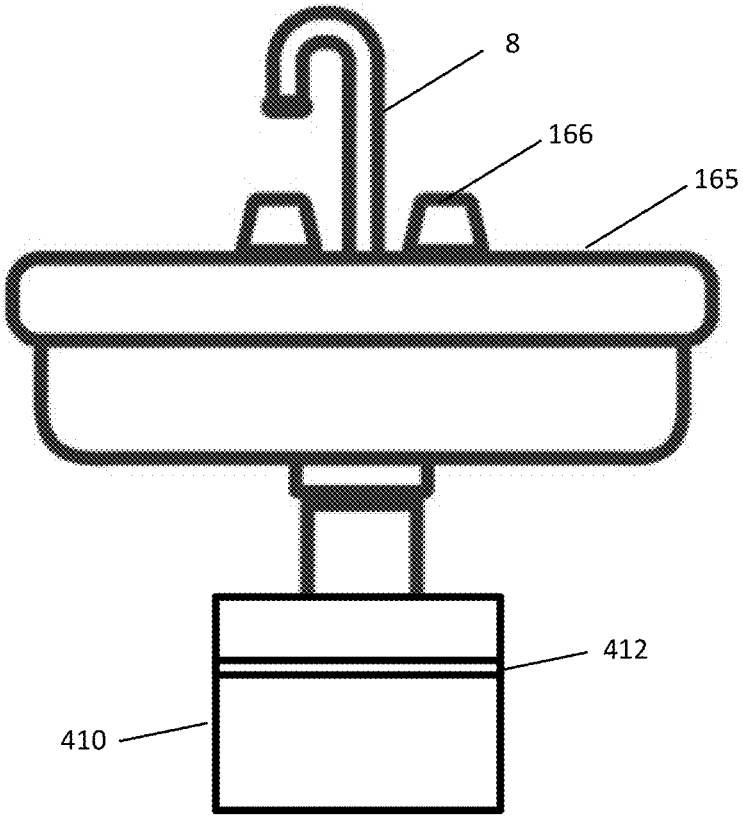
FIG. 53 illustrates a magnetic drive for a garbage disposal.

FIG. 53 illustrates a magnetic drive 412 for a garbage disposal 410. The magnetic drive may include a motor on the outside of the garbage disposal chamber. The motor rotates a magnet that drives another magnet on one or more blades inside the garbage disposal chamber. If any foreign objects (i.e., not food waster or water) enter the garbage disposal, the foreign objects may resistance the movement of the blade or magnetic drive 412. Thus, the garbage disposal may be slowed or stopped without damage.

Magnetic Clog Sensor

Figure 54:
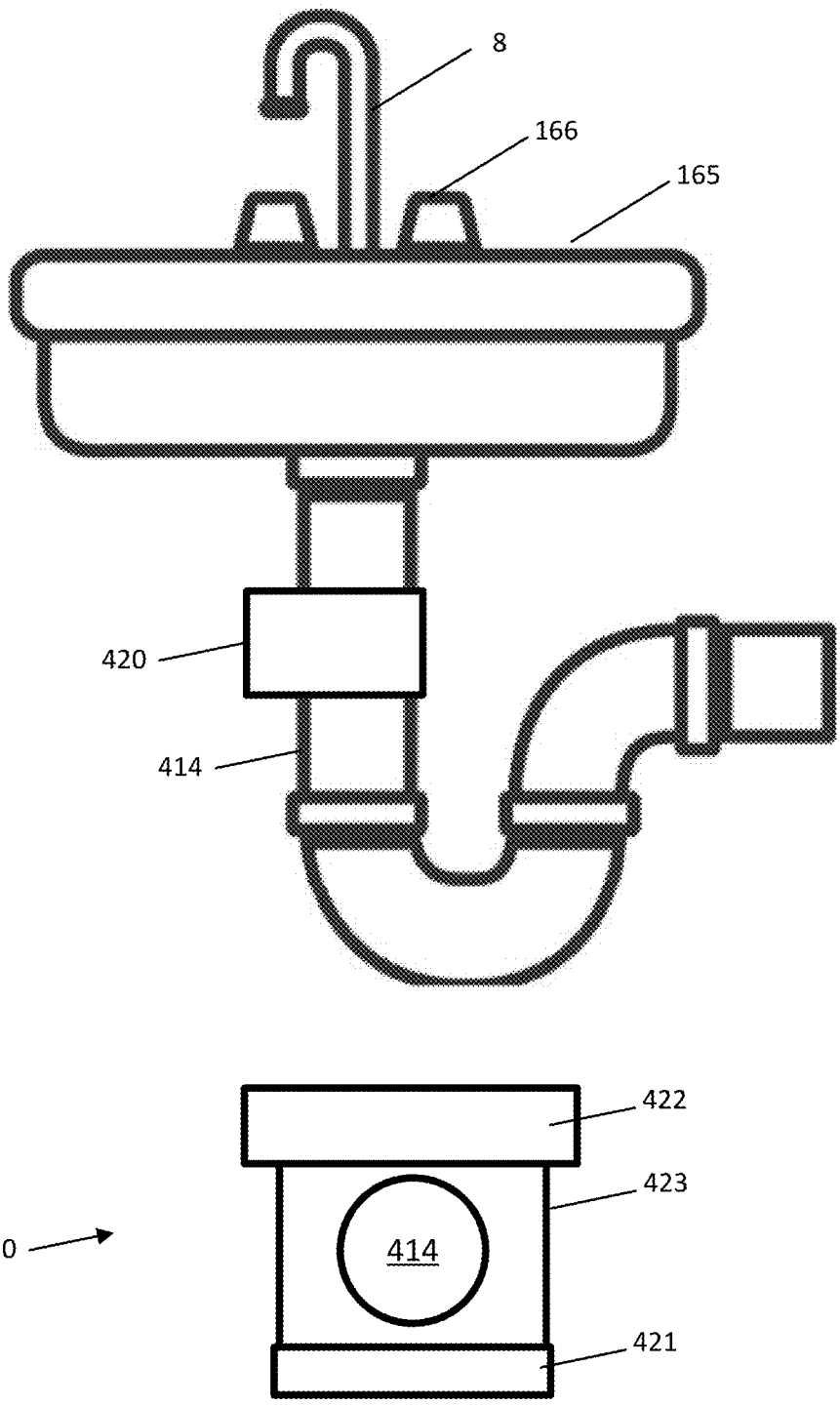
FIG. 54 illustrates a magnetic clog sensor.

FIG. 54 illustrates a magnetic clog sensing system 420. The magnetic clog sensor 420 is mounted around the drain pipe 414. The magnetic clog sensor 420 may include a mounting bracket 423, magnet 421 and a magnetic sensor 422. Additional, different or fewer components may be included.

The magnetic sensor 422 may be electrically connected to a controller (e.g., controller 222). The magnetic sensor 422 is configured to detect the magnetic field passing through the drain pipe 414. The magnetic field is generated by the magnet 421 and modified by the drain pipe 414 and the contents of the drain pipe 414.

The controller determines a magnetic field property based on sensor data from the magnetic sensor 422. The magnetic field property may include a magnitude of the magnetic field or a magnitude of a component of the magnetic field at a predetermined point. The magnetic field property may be an array of values across a field or range of the magnetic sensor 422. The magnetic field property may include a direction of the magnetic field or component thereof. The magnetic field property may be a change or rate of change of the magnetic field property.

The controller is configured to compare the magnetic field property to a threshold value. When the magnetic field property falls below the threshold value, the controller determines that the drain pipe 414 has become clogged or partially clogged.

The controller may determine the threshold value over time based on a running average of the magnetic field property (i.e., when no clog exists). The controller may determine the threshold value in response to a reset button pressed by the user or technician.

The controller may generate alert when a clog is determined. The alert may be a light, audible, or other message to the user. The alert may trigger a water valve to be closed. The controller may open such a valve or other mechanism that releases a cleaning agent or other means such as a chemical, ozone, electrolyzed water, hydrogen peroxide, ultrasonic cavitation, nanobubbles, or microbubbles. In another example, the controller may cause an actuator to move an internal plug to remove the blockage.

Magnetic Valve

Figure 55:
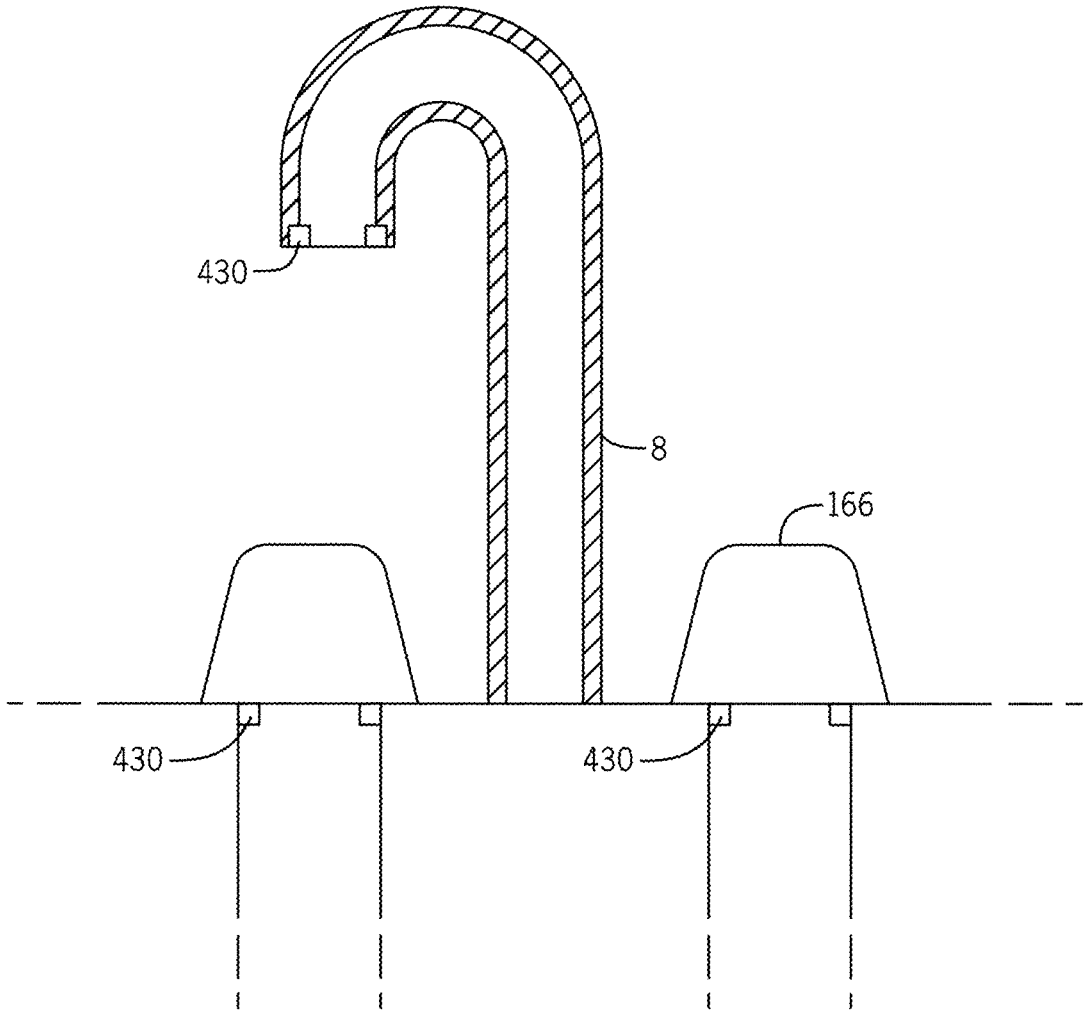
FIG. 55 illustrates magnetic valves.

FIG. 55 illustrates magnetic valves 430. The magnetic valves 430 control the flow of water through a pipe or opening such as the outlet of faucet 8 or the valves 430 for a hot water pipe or a cold water pipe. The magnetic valves 430 may not be shutoff valves but rather partial flow restrictors to adjust the flow of water through the pipe or opening. The magnetic valves 430 may narrow the opening to increase the velocity of the water flow. Additional, different or fewer components may be included. The magnetic valves may couple magnetically to handle 166, allowing for handle 166 to easily be changed or replaced for aesthetic or functional purposes.

The magnetic valves 430 may included two or more opposing magnets. The magnets may be spaced apart at a predetermined gap. The magnets are attracted to each other but can be forced apart by the flow water. The magnets narrow the passage for the water but as the water pressure increases, the magnets will separate. Thus, the magnets may maintain a predetermined velocity off water and varying flow rates.

The magnetic valves 430 may include at least one electromagnetic such that the flow rate or velocity through the pipe or opening can be controlled electronically by energizing the electromagnetic by a specified amount.

Levitating Dispenser

Figure 56:
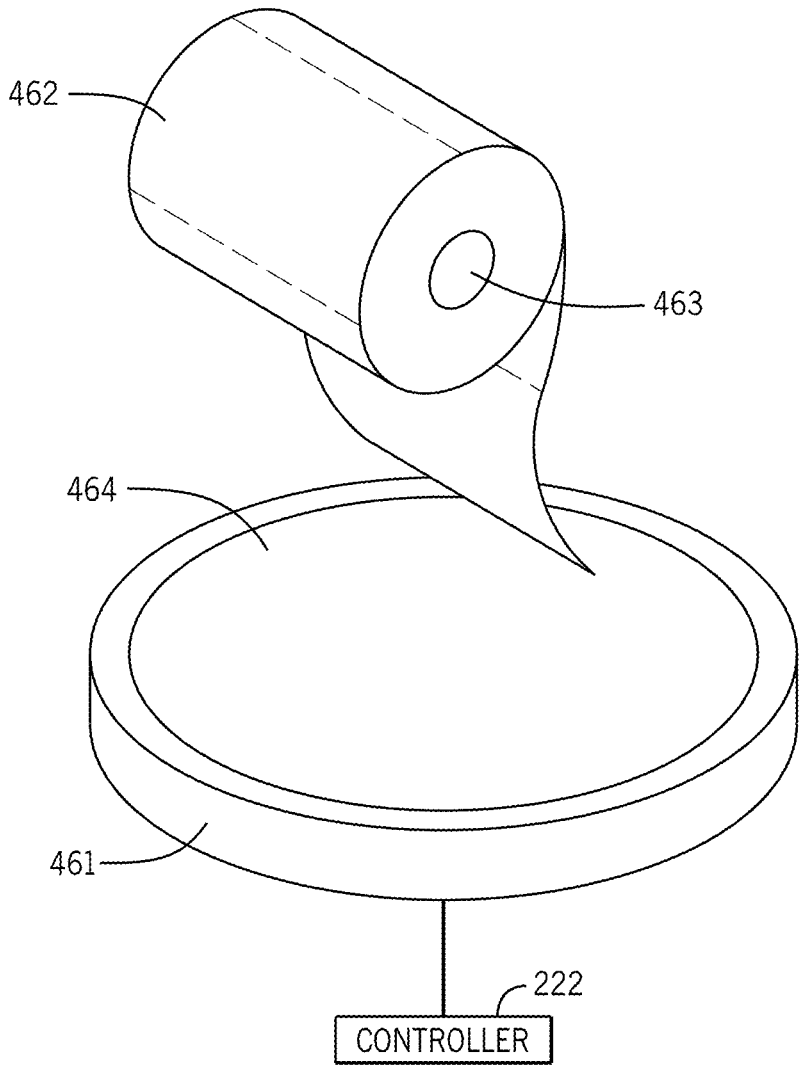
FIG. 56 illustrates a levitating dispenser.

FIG. 56 illustrates a levitating dispenser. The levitating dispenser may include a base magnet 461 and a levitating magnet 463. The base magnet 461 generates a magnetic field that acts on the levitating magnet 463. The levitating magnet 463 may support another object such as the tissue paper roll 462 as illustrated.

The base magnet 461 may be an electromagnet connected to controller 222 and a power supply. The controller 222 may control the electromagnet in order to levitate the levitating magnet 463.

A sensor 464 (e.g., position sensor) may detect the supported object (e.g., tissue paper roll 462). The controller 222 may adjust the magnitude off the power signal provided to the electromagnet in response to the sensor data from sensor 464 in order to maintain a predetermined height. The base magnet 461 may include multiple electromagnets. The controller 222 may provide varying power signal to the electromagnetics so that the levitating magnet 463 slowly spins above the base magnet 461.

Magnetic Water Steering

Figure 57:
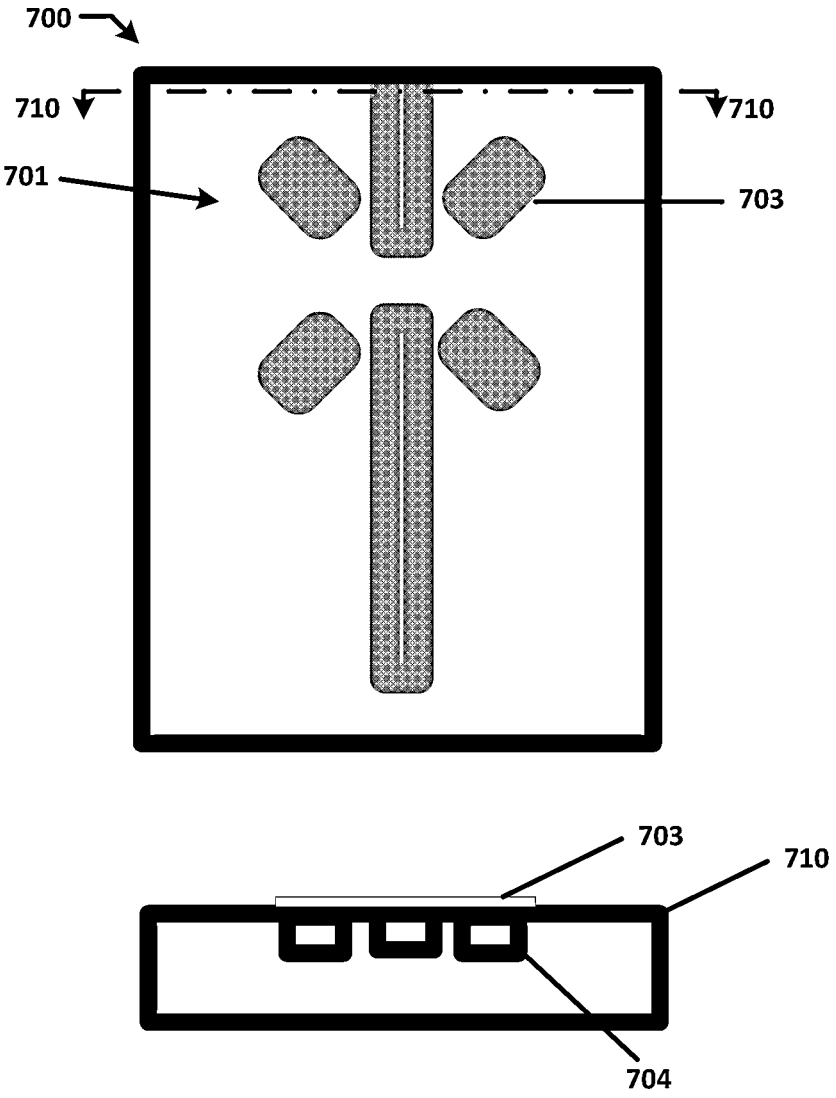
FIG. 57 illustrates a tile with a magnetic water pattern.

FIG. 57 illustrates a tile 700 with a magnetic water pattern 701. The magnetic water pattern 701 is formed under a magnetic field from magnets 704. Multiple magnets may arranged in predetermined positions and orientations in order to create the magnetic water pattern 701. The magnets may have different sizes, shapes, and orientations.

Water is a diamagnetic material that is repelled by a magnetic field. This force is proportional to the strength of the magnetic field. In addition or in the alternative, an electrostatic charger may replace one or more of the magnets 704. The electrostatic charger may be within the tile 700 or at the rear of the tile 700. The electrostatic charger is configured to generate an electrostatic field that repels or attracts the water molecules to create the magnetic water pattern 701. The electrostatic charger may be connected to a power source.

The magnetic water pattern 701 may be pooled in specific shapes 703 due to cohesion. Different water steering phenomena may occur depending on the arrangement of the magnets 704. In some example, the diamagnetism of the water may repel the water droplets from the magnets 704 such that the magnetic water pattern 701 represents the absence of water. In other examples, the magnets 704 may be arranged to attract the water such that the magnetic water pattern 701 represents water retained against the tile and to each other through surface tension. The attraction to the tile may be referred to as adhesion and the attraction of the water droplets to each other may be referred to as cohesion.

In a shower or other tiled surface, multiple tiles 700 may be installed together. Each tile may be installed individually. At the time off installation, there is no water on the tiles and the magnetic water pattern 701 may not be visible. To aid in installation, a marking or indicia may be including on the tiles 700 to indicate the direction of installation. In other words, the indicia may show the direction of the magnets 704 so that all of the tiles 700 can be installed in the same direction. The indicium may be indicative of a predetermined orientation and a predetermined position of the first magnet and the second magnet.

Figure 58:
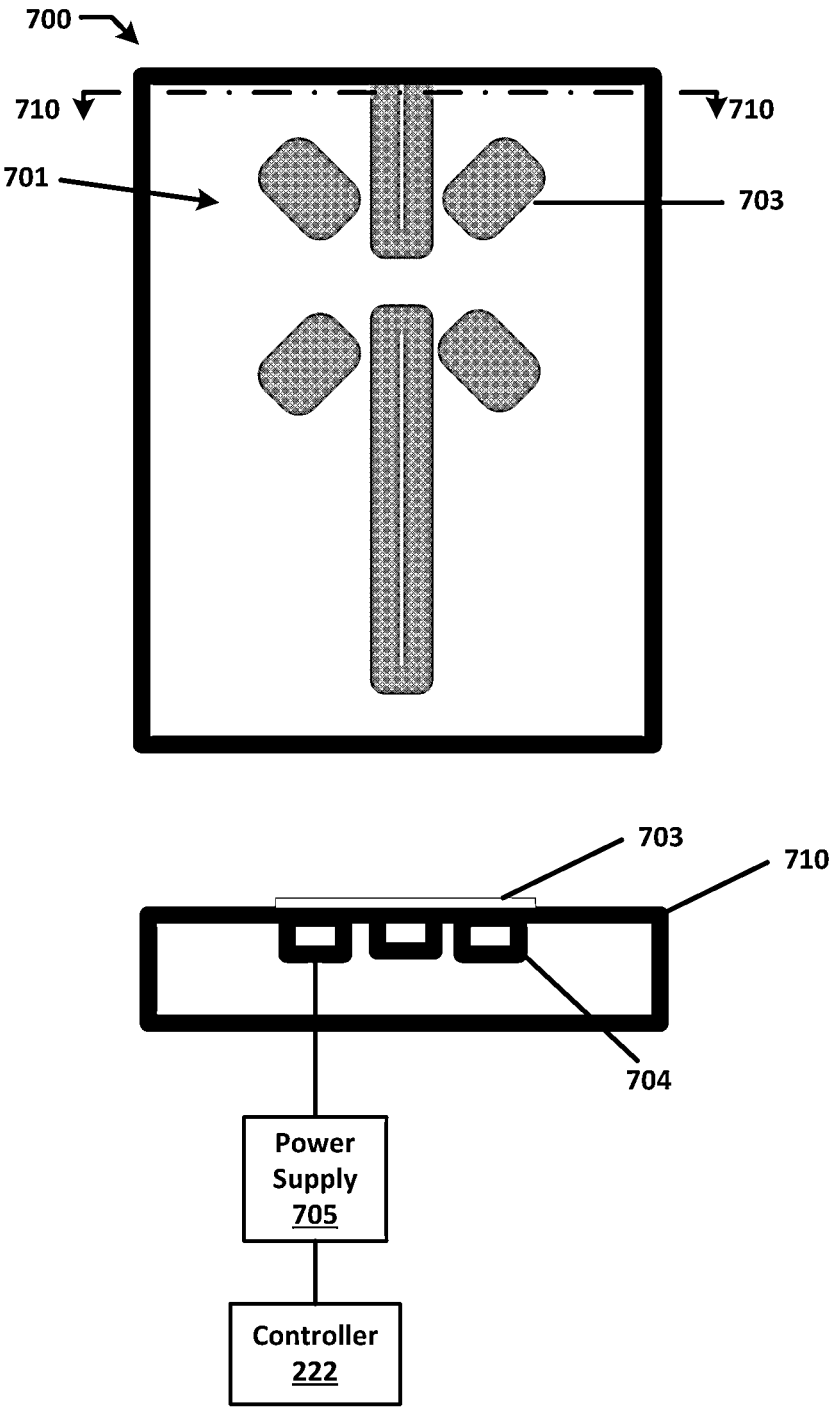
FIG. 58 illustrates a tile with a magnetic water pattern and an electromagnet.

FIG. 58 illustrates a tile with a magnetic water pattern as described above, using an electromagnet for the magnet 704. The electromagnet may be energized by a power supply 705 controlled by controller 222. In some examples, the electrostatic chargers may supplement the magnet 706. The magnet 704 may be implemented as multiple permanent magnets or electromagnets having various shapes that create the water pattern. A first magnet may have a first shape and a second magnet may have a second shape. A user input to the controller 222 may trigger activation of the first and/or second magnet to create a desired water pattern.

Figure 59:
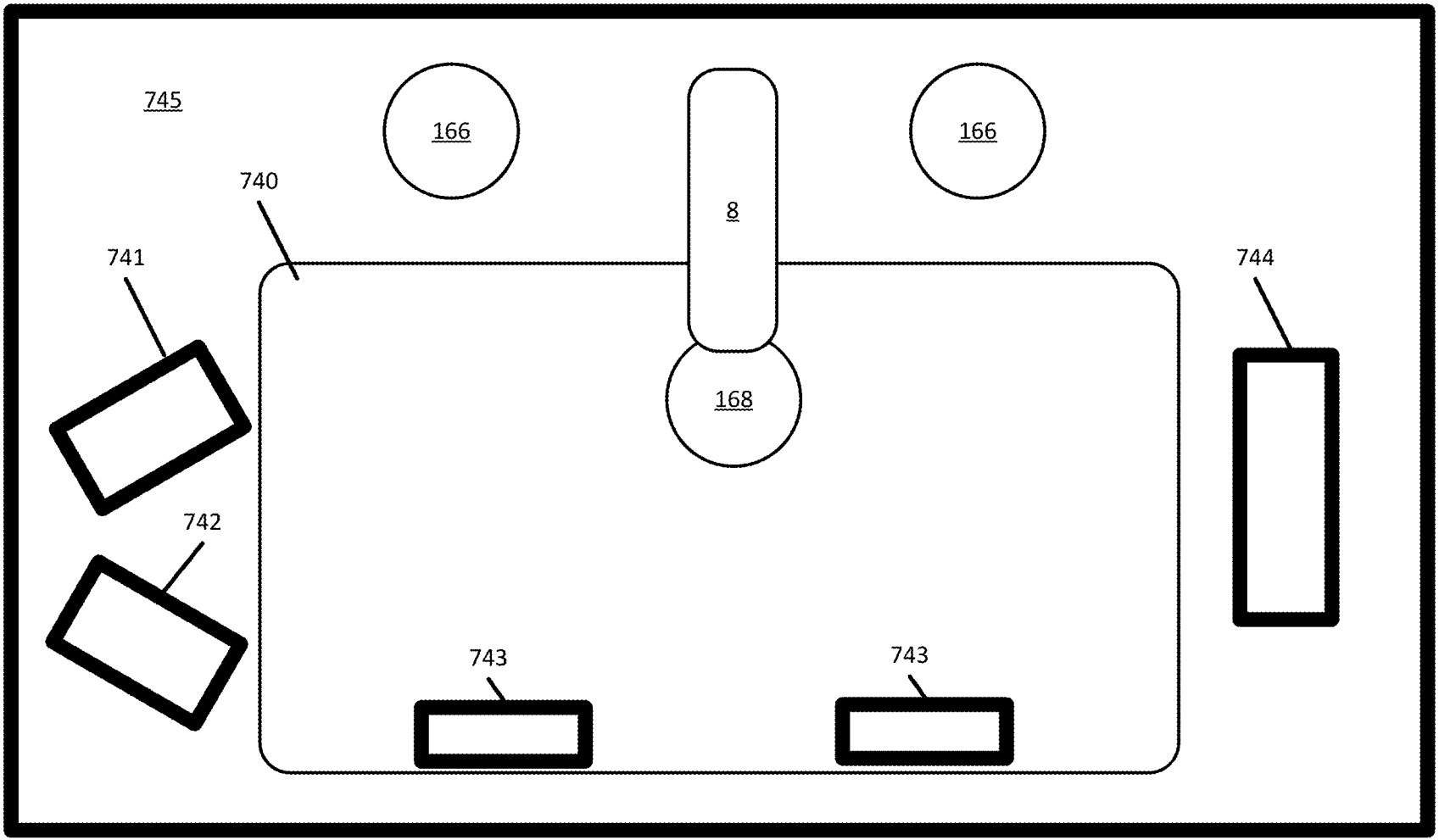
FIG. 59 illustrates magnetic splash shields.

FIG. 59 illustrates a basin 740 having a faucet 8 and valve knobs 166. The basin 740 may include one or more of various magnetic splash shields 741-744. In all example, the magnetic splash shields 741-744 may be supplemented with electrostatic charging.

The magnetic splash shields 741-744 are configured to steer water toward the inside of the basin 740. The magnetic splash shields 741-744 include magnets (e.g., permanent magnets or electromagnets) having poles facing in a predetermined direction and orientation. Water that is dispensed from the faucet 8 may include the water flow from the faucet 8, water that is contained in the basin 740, or water that is deflected on an object (e.g., the user's hands during hand-washing) or other splashes or deflections of water. The magnetic splash shields 741-744 are configured to place a magnetic field on the water flow from the faucet 8. Water has a property of diamagnetism. Under the magnetic field, the water creates another magnetic field in opposition to the externally applied magnetic field.

The magnetic splash shields 741-744 may be arranged to that the magnetic field from diamagnetism applies forces to the water in the direction toward the center of the basin. For example, magnetic splash shields 741 and 742 are arranged to provide complementary forces on water splashing toward the left side of the basin 740. The magnetic splash shields 741 is aa first magnet having a first predetermined orientation and a predetermined position with respect to the water orifice (e.g., drain 168 of the basin 740 or the faucet 8). The magnetic splash shields 742 is a second magnet having a second predetermined orientation and a predetermined position with respect to the first magnet.

The magnetic splash shields 743 may be arranged at the rear of the basin 740 to apply forward forces on splashing water. The magnetic splash shields 743 include one or more magnet having a predetermined orientation and a predetermined position with respect to the water orifice (e.g., drain 168 of the basin 740 or the faucet 8). In one alternative, a single magnetic splash shield 744 may be placed on one or more sides of the basin to apply forces to return water toward the basin 740.

The magnetic splash shields 741-744 may be mounted in a counter 745 adjacent to the basin 740. The magnetic splash shields 741-744 may be oriented with respect to the counter.

In other examples, magnets 120 may serve as magnetic splash shields as shown in FIG. 13 on the top or rim of bathtub 3 or as shown in FIG. 26 around the top or rim of basin 165.

The magnetic water steering system may be installed in the proximity or relation to any plumbing fixture or water orifice. Example water orifices include water outlets and drains. A first magnet having a first predetermined orientation and a predetermined position is installed with respect to the water orifice and a second magnet having a second predetermined orientation and a predetermined position is installed with respect to the first magnet.

The magnetic water steering system may be installed on a basin 165 including any of the magnetic stoppers described herein. The magnetic water steering system may be installed on a shower tile such that the shower tile includes the first magnet or second magnet in an esthetic pattern. The shower tile may also include surface patterns based on ferrous materials in the shower tile as described herein.

The shower tile may include an electrostatic plate coupled to the shower tile.

Figure 60:
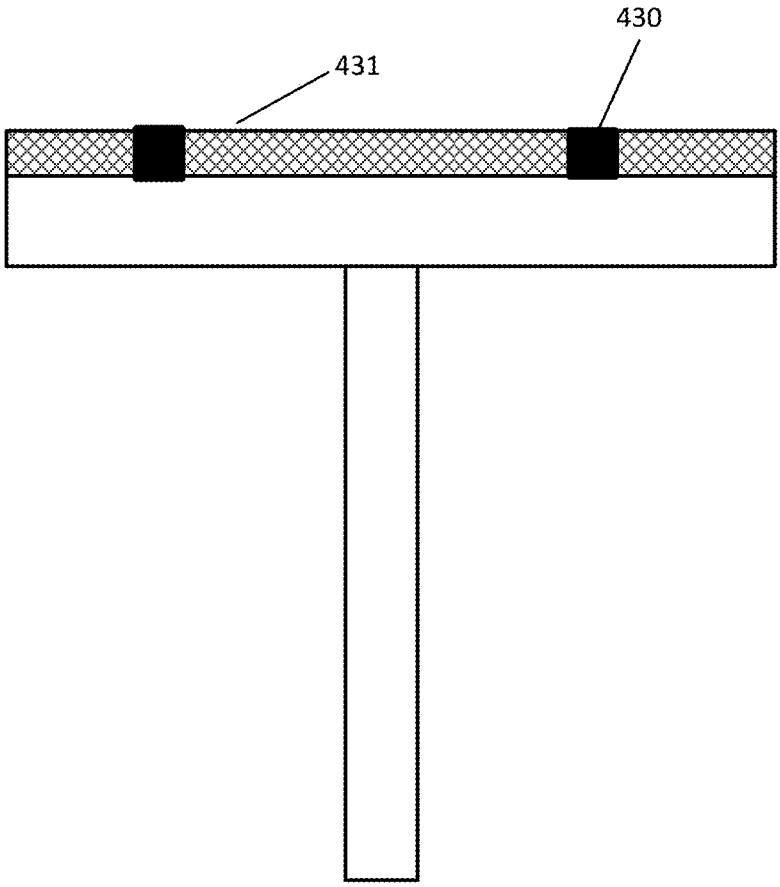
FIG. 60 illustrates a magnetic wiper.

FIG. 60 illustrates a magnetic wiper or a squeegee tool. The end of the tool includes a rubber blade 431. The tool is configured to wipe, remove, or otherwise control the presence or flow of water on a flat surface. The flat surface may be glass. The tool also includes at least one magnet 430 to aid in the control of water. The magnet 430 may cause a magnetic field that repels water away from the tool. The magnet 430 may cause the water to create an opposing magnetic field that opposes the motion of the tool and aids in the removal of water from the flat surface.

Figure 61:
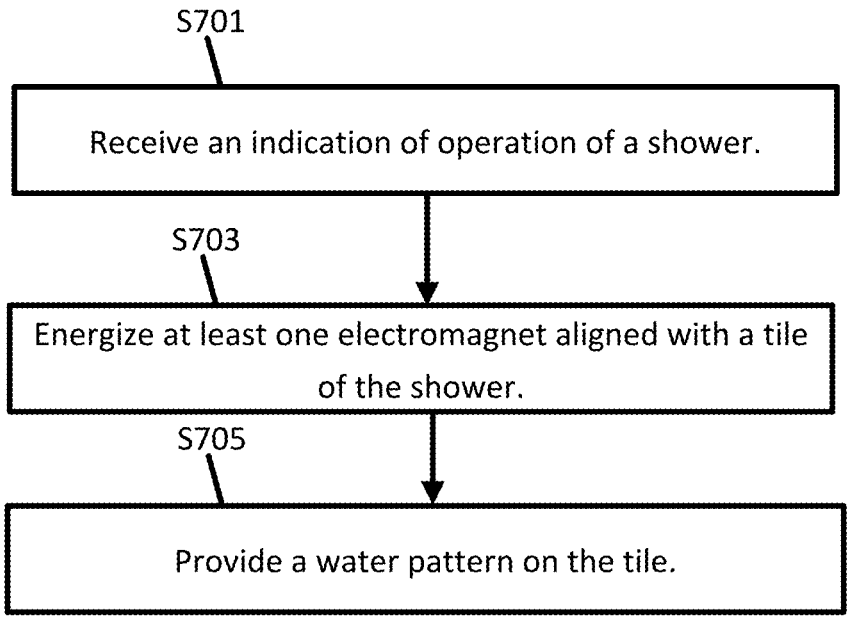
FIG. 61 illustrates a flow chart for a water repelling system.

FIG. 61 illustrates a flow chart for a water repelling system. Additional, different or fewer acts may be included. At act S701, an indication of operation of the plumbing fixture (e.g., shower, sink, toilet, bathtub, etc.) is received at the controller 122. The indication of the operation may be a flow sensor that detect water flow in the plumbing fixture or attached pipe.

At act S703, energize at least one electromagnet aligned with a tile of the shower. For example, the controller 122 may send the power signal to the electromagnet in order to steer, repel, or otherwise direct water droplets away from the electromagnet. For example, water may be directed back to the plumbing fixture. The electromagnet may be supplemented by an electrostatic charger in some examples. In another example, as shown by act S705, a water pattern on the tile or other surface associated with the electromagnet.

Figure 62:
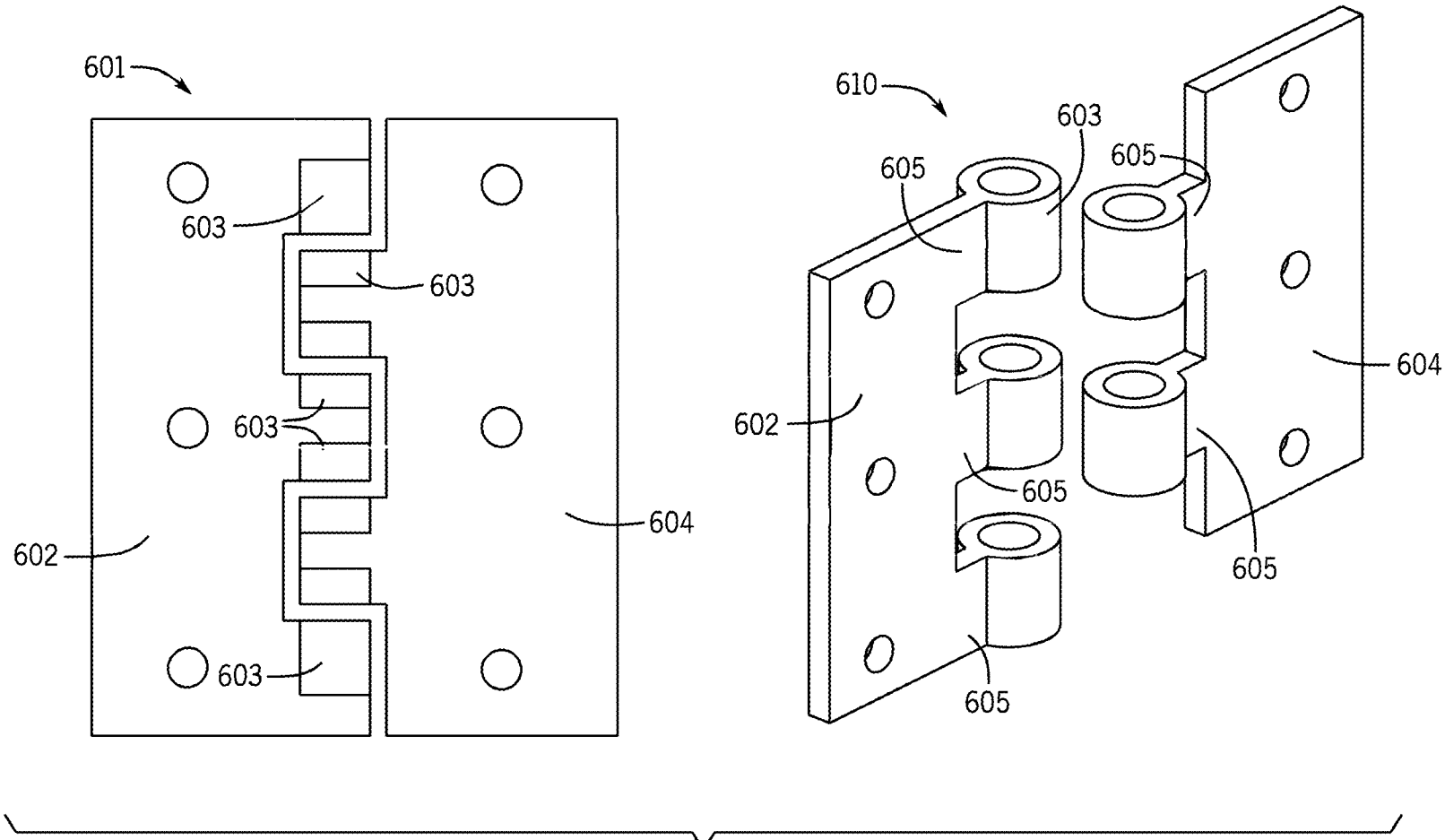
FIG. 62 illustrates a first embodiment of a magnetic hinge.

FIG. 62 illustrates a first embodiment of a magnetic hinge including a cross section view 601 of the magnetic hinge and an exploded view 610 of the magnetic hinge. The magnetic hinge may include a first plate 602 and a second plate 604. Additional, different, or fewer components may be included.

The magnetic hinge includes multiple magnets 603, which may be arranged so that magnetic poles of opposite polarity are placed in proximity to one another. Overlapping sections of the hinge plates 605 may be configured to bring the opposite polarity portions of the magnets 603 in proximity to each other. For example, the first plate 602 may expose the positive poles at each of the overlapping sections of the hinge plates 605 and the second plate 604 may expose the negative poles at each of the overlapping sections of the hinge plates 605.

The repelling force of the magnets 603 at the hinge plates 605 causes an air gap to be maintained between the overlapping sections of the hinge plates 605 so that the first plate 602 and second plate 604 levitate with respect to each other. The magnetic hinge eliminates friction/wear and tear on the hinge components. The magnetic hinge also eliminates the need for lubrication.

Figure 63:
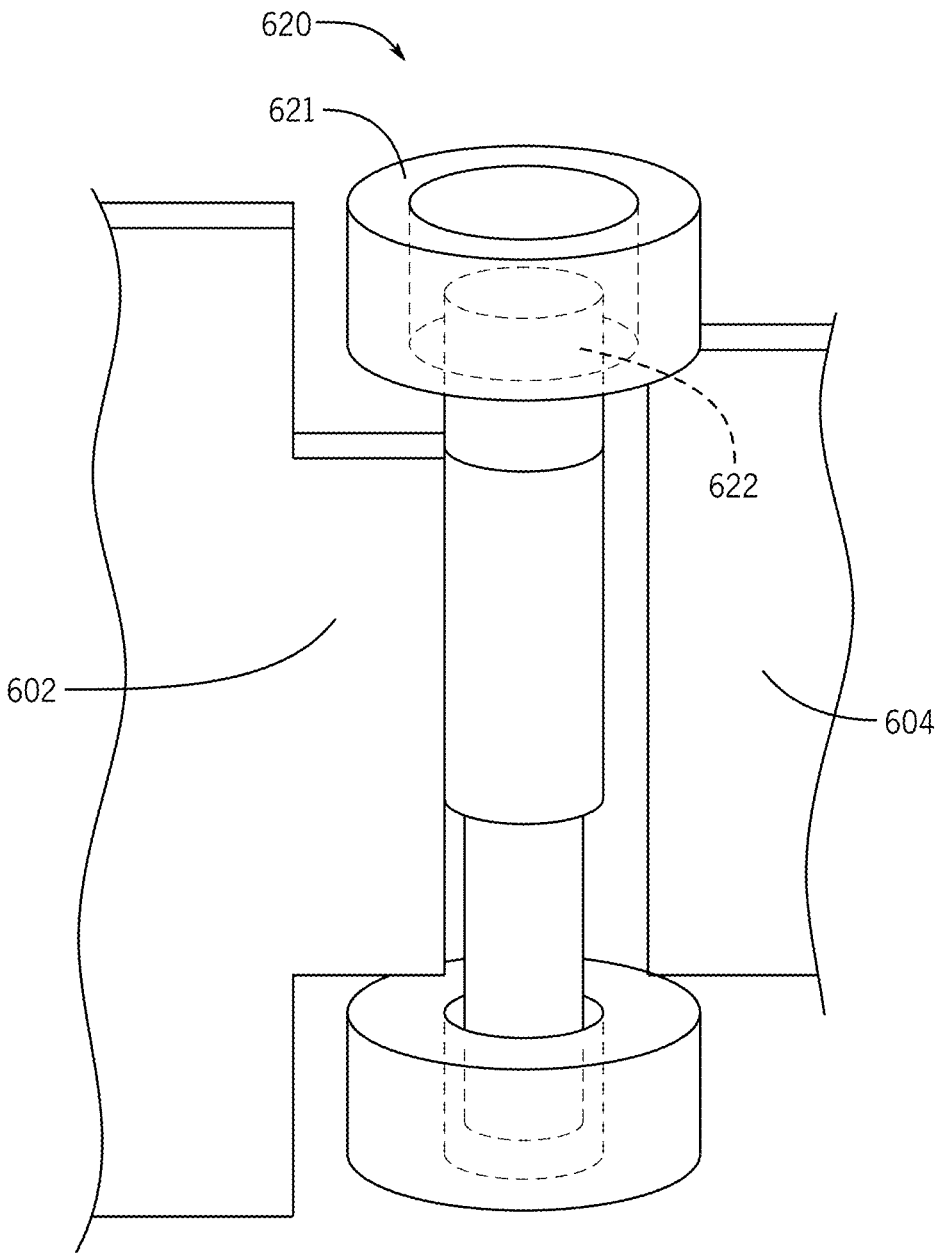
FIG. 63 illustrates a second embodiment of a magnetic hinge.

FIG. 63 illustrates a second embodiment of a magnetic hinge 620 in which the opposing magnets are in a different arrangement. Here an outer magnet 621 is sized and shaped to fit over an inner magnet 622. For example the first plate 602 may be coupled to the outer magnet 621 having a first polarity (at an outward facing side). The second plate 604 is coupled to the inner magnet 622 having a second polarity (at an outward facing side). The first plate 602 supports the second part 604 using the magnetic field between the outer magnet 621 and the inner magnet 622.

As in all examples described herein, the magnets in the embodiments of FIGS. 62 and 63 may be implemented using one or more electromagnets coupled electrically to a power supply and/or a controller 222 that generates commands for the electromagnets and regulates the magnetic field of the electromagnets.

Magnetic Canister

Figure 64:
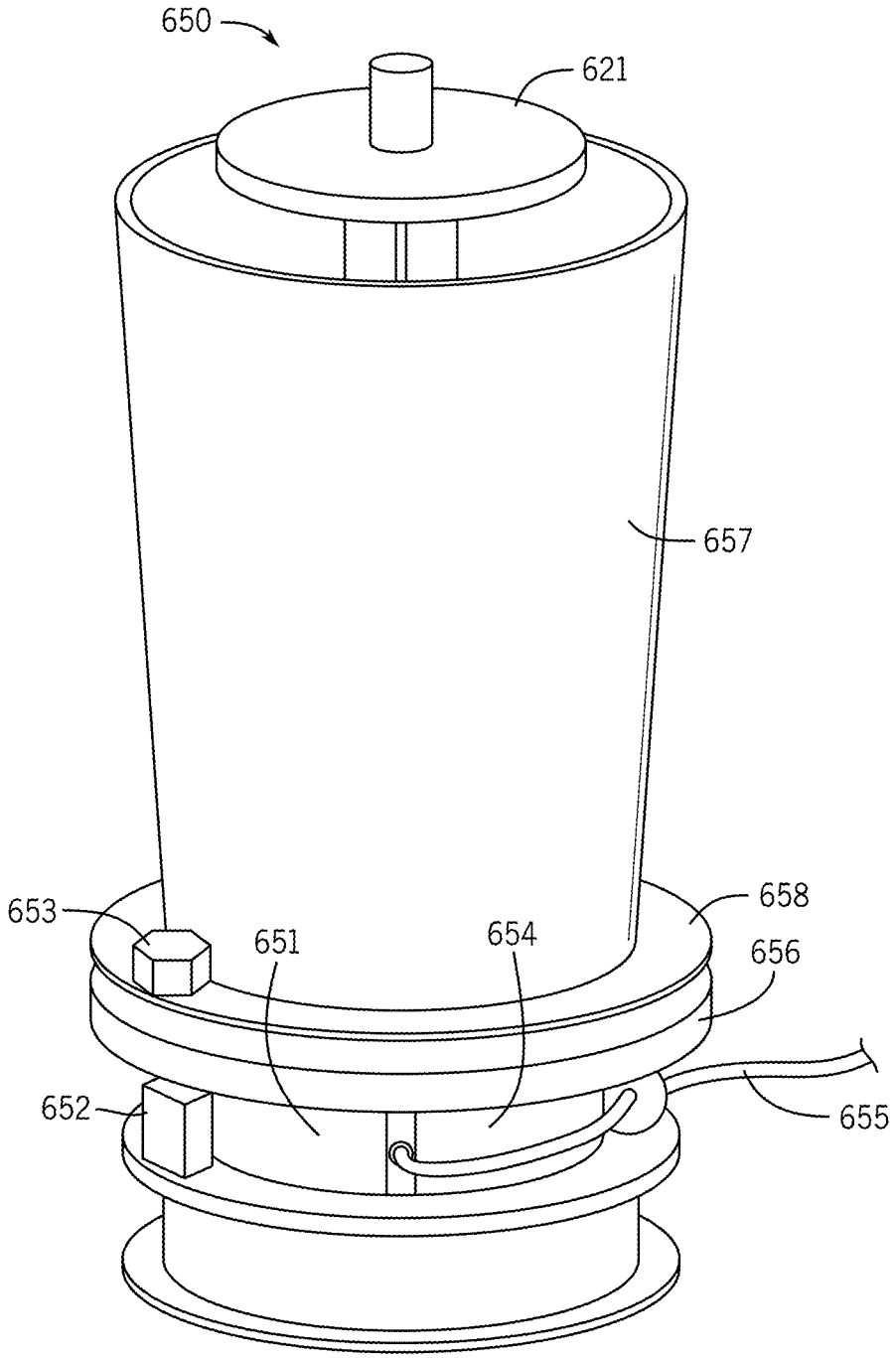
FIG. 64 illustrates a magnetic flush valve.

FIG. 64 illustrates a magnetic canister 650, which may be used as a flush valve. The magnetic canister 650 includes a slider 651, a slider magnet 652, a canister magnet 653, a track 654, a cable 655, a sealing surface 656, and a canister float 657. Additional, different, or fewer components may be included.

The cable 655 may be coupled to a flush lever. For example, the flush lever 167 of FIG. 27 may be used. Any flush lever may be used. The flush lever may be mounted to the tank of the toilet. The flush lever may have a handle portion external to the toilet tank and an internal portion (e.g., arm or rod) that is coupled to the cable 655. When the toilet lever is rotated or otherwise moved by the user, the internal portion pulls (or pushes) the cable 655. A chain or a rigid pole may be used in place of the cable 655.

The cable 655 applies a force to the slider 651 to cause the slider 651 to move to rotate with respect to the track 654 or otherwise move along the track 654. Movement of the slider 651 brings the slider magnet 652 into alignment with the canister magnet 653. When the slider magnet 652 is brought into alignment with the canister magnet 653 so that opposite polarities of the magnets are in proximity to each other, the slider magnet 652 applies a magnetic force to the canister magnet 653 causing actuation of the canister. That is the magnet force moves the canister float 657 to break the seal at the sealing surface 657, and as a result water flows out of the tank through opening 658. The opening may lead to one or more rim channels for washing the sides of the toilet bowl or evacuating the contents of the toilet bowl.

The polarities between the slider magnet 652 and the canister magnet 653 may be used either to attract each other when in alignment or repel each other when in alignment. If the canister float 657 is made to have a specific high buoyancy (e.g., by selecting a material of a specific low density, or by enclosing an air chamber with the canister) such that it cannot remain seated without an external force, the magnetic force from attracting magnets may be used hold the canister down in a full tank of water. Thus, the opening 658 remains closed under the attracting force of the slider magnet 652 and the canister magnet 653 until one of the magnets is moved, causing the opening 658 to open and release the water from the tank.

If the canister float 657 is made to have a specific low buoyancy (e.g., by selecting a material of a specific high density), the magnetic force from repelling magnets may be used to repel each other in order to unseat the canister. Thus, the opening 658 remains closed under no magnetic force until the repelling force of the slider magnet 652 and the canister magnet 653 when the two magnets are aligned causes the canister to be unseated from the base, causing the opening 658 to open and release the water from the tank.

In some examples, the cable 655 may be omitted. Instead, an actuator is configured to move the slider 651 back and forth under a command. The slider 651 may be coupled to a motor, a solenoid, or other mechanical device. A controller (e.g., controller 222) may generate a command for the actuator to cause the magnetic canister to flush the toilet or otherwise release the water from the tank.

In addition, the slider magnet 652 and/or the canister magnet 653 may be implemented by an electromagnets. In addition, in some examples one of the slider magnet 652 or the canister magnet 653 is an electromagnet and the other of the slider magnet 652 or the canister magnet 653 is formed of ferromagnetic metal.

The electromagnets may be connected to a power source configured supply a specific current or range of currents to the electromagnets so that the electromagnets have a desired intensity (e.g., create a magnetic field of a desired strength) under instructions, signals, or commands from the controller. In some embodiments, the power source may be one supplying either direct or alternating current. In some embodiments, the power source may be a battery. In other embodiments, the electromagnet may be electrically connected to a power source such as a wall outlet.

The controller may receive inputs from the user via a remote control. Alternatively, the controller may receive inputs from the flush lever wirelessly. The trip lever is configured to detect the distance of an object (e.g., a user's hand or forearm, etc.) within a detection region of the trip lever, and to send a corresponding signal to the controller to actuate the flush valve assembly (e.g., by lifting the canister). In this manner, the trip lever assembly can, advantageously, allow for both manual and touchless actuation of a flushing function of a toilet, such as toilet 6.

The controller may receive inputs from a magnetic coupling. The magnetic coupling may include a magnet on the flush lever moved with respect to a magnet inside the tank. The controller detects the change in magnetic field or movement of the magnet inside the tank.

The controller generates the actuator command in response to the user inputs. Alternatively, the controller may generator the actuator command on a schedule or at predetermined times in order to periodically flush or clean the toilet.

Figure 65:
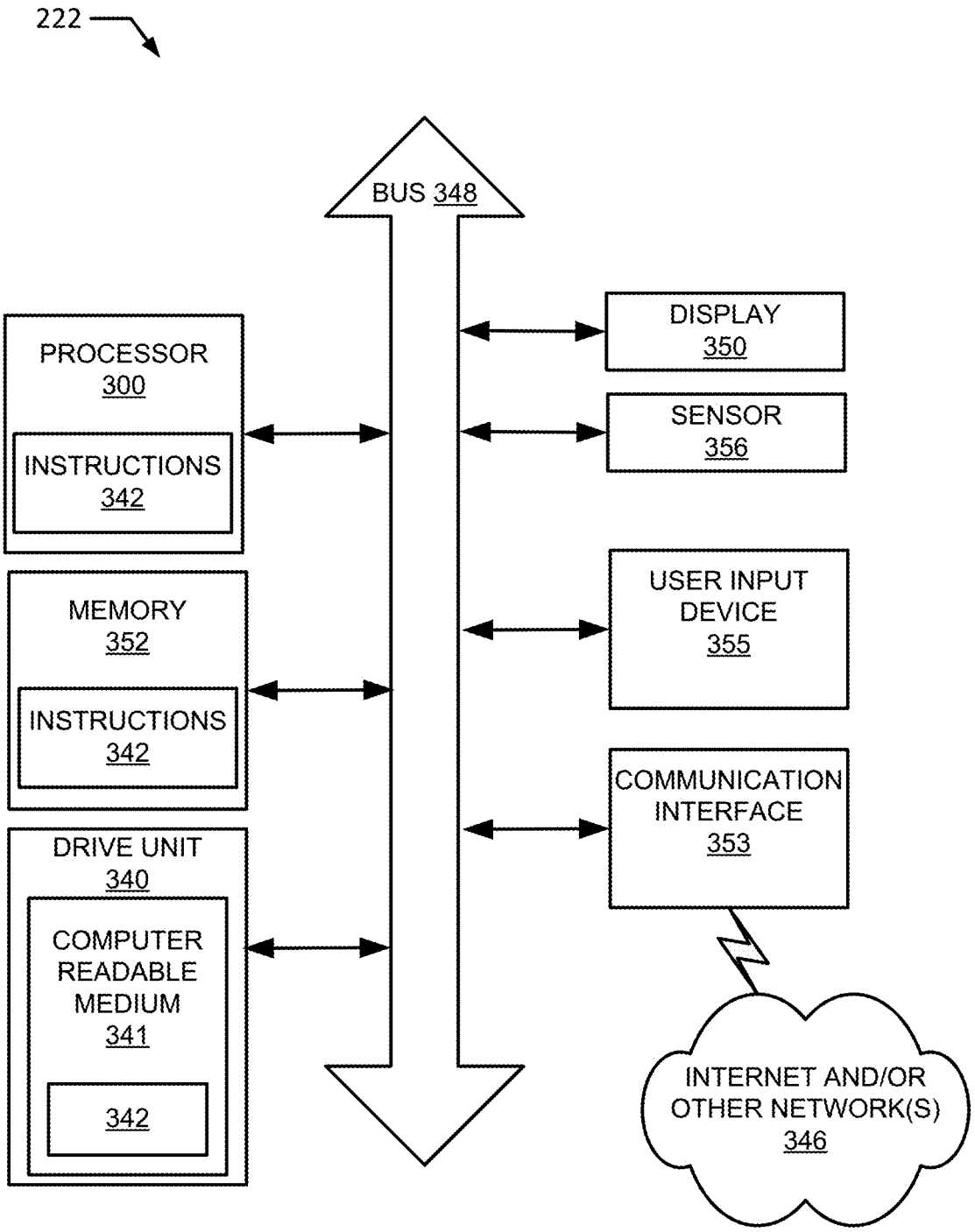
FIG. 65 illustrates an example controller for any of the disclosed embodiments.

FIG. 65 illustrates an example control system or controller 222 for any of the embodiments described herein. The controller 222 may include a processor 300, a memory 352, and a communication interface 353 for interfacing with devices or to the internet and/or other networks 346. In addition to the communication interface 353, a sensor interface may be configured to receive data from the sensors described herein or data from any source. The components of the control system may communicate using bus 348. The control system may be connected to a workstation or another external device (e.g., control panel) and/or a database for receiving user inputs, system characteristics, and any of the values described herein.

Optionally, the control system may include an input device 355 and/or a sensing circuit 356 in communication with any of the sensors. The sensing circuit receives sensor measurements from sensors as described above. The input device may include any of the user inputs such as buttons, touchscreen, a keyboard, a microphone for voice inputs, a camera for gesture inputs, and/or another mechanism.

Optionally, the control system may include a drive unit 340 for receiving and reading non-transitory computer media 341 having instructions 342. Additional, different, or fewer components may be included. The processor 300 is configured to perform instructions 342 stored in memory 352 for executing the algorithms described herein. A display 350 may be an indicator or other screen output device. The display 350 may be combined with the user input device 355.

Processor 300 may be a general purpose or specific purpose processor, an application specific integrated circuit (ASIC), one or more programmable logic controllers (PLCs), one or more field programmable gate arrays (FPGAs), a group of processing components, or other suitable processing components. Processor 300 is configured to execute computer code or instructions stored in memory 352 or received from other computer readable media (e.g., embedded flash memory, local hard disk storage, local ROM, network storage, a remote server, etc.). The processor 300 may be a single device or combinations of devices, such as associated with a network, distributed processing, or cloud computing.

Memory 352 may include one or more devices (e.g., memory units, memory devices, storage devices, etc.) for storing data and/or computer code for completing and/or facilitating the various processes described in the present disclosure. Memory 352 may include random access memory (RAM), read-only memory (ROM), hard drive storage, temporary storage, non-volatile memory, flash memory, optical memory, or any other suitable memory for storing software objects and/or computer instructions. Memory 352 may include database components, object code components, script components, or any other type of information structure for supporting the various activities and information structures described in the present disclosure. Memory 352 may be communicably connected to processor 300 via a processing circuit and may include computer code for executing (e.g., by processor 300) one or more processes described herein. For example, the memory 352 may include graphics, web pages, HTML files, XML files, script code, shower configuration files, or other resources for use in generating graphical user interfaces for display and/or for use in interpreting user interface inputs to make command, control, or communication decisions.

In addition to ingress ports and egress ports, the communication interface 353 may include any operable connection. An operable connection may be one in which signals, physical communications, and/or logical communications may be sent and/or received. An operable connection may include a physical interface, an electrical interface, and/or a data interface. The communication interface 353 may be connected to a network. The network may include wired networks (e.g., Ethernet), wireless networks, or combinations thereof. The wireless network may be a cellular telephone network, an 802.11, 802.16, 802.20, or WiMax network, a Bluetooth pairing of devices, or a Bluetooth mesh network. Further, the network may be a public network, such as the Internet, a private network, such as an intranet, or combinations thereof, and may utilize a variety of networking protocols now available or later developed including, but not limited to TCP/IP based networking protocols.

While the computer-readable medium (e.g., memory 352) is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random access memory or other volatile re-writable memory. Additionally, the computer-readable medium can include a magneto-optical or optical medium, such as a disk or tapes or other storage device to capture carrier wave signals such as a signal communicated over a transmission medium. A digital file attachment to an e-mail or other self-contained information archive or set of archives may be considered a distribution medium that is a tangible storage medium. Accordingly, the disclosure is considered to include any one or more of a computer-readable medium or a distribution medium and other equivalents and successor media, in which data or instructions may be stored. The computer-readable medium may be non-transitory, which includes all tangible computer-readable media.

In an alternative embodiment, dedicated hardware implementations, such as application specific integrated circuits, programmable logic arrays and other hardware devices, can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

While this specification contains many specifics, these should not be construed as limitations on the scope of the invention or of what may be claimed, but rather as descriptions of features specific to particular embodiments of the invention. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

It is intended that the foregoing detailed description be regarded as illustrative rather than limiting and that it is understood that the following claims including all equivalents are intended to define the scope of the invention. The claims should not be read as limited to the described order or elements unless stated to that effect. Therefore, all embodiments that come within the scope and spirit of the following claims and equivalents thereto are claimed as the invention.

What is claimed is:

1. A magnetic cleaning system for bathroom surfaces, the magnetic cleaning system comprising:

a shower including a drain and at least one vertical shower wall;

a robot cleaning device configured to traverse the surfaces of the bathroom; and a docking station integrated with the drain of the shower and attached to one of the bathroom surfaces and configured to couple with the robot cleaning device; and a pattern of magnets configured to hold the robot cleaning device to the at least one vertical shower wall.

2. The magnetic cleaning system of claim 1, wherein the docking station is configured to replenish the robot cleaning device with a cleaning compound.

3. The magnetic cleaning system of claim 1, wherein the docking station is configured to charge a battery of the robot cleaning device.

4. The magnetic cleaning system of claim 1, wherein the docking station is configured to remove wastewater from the robot cleaning device.

5. The magnetic cleaning system of claim 1, wherein the docking station is configured to replenish the robot cleaning device with water.

6. The magnetic cleaning system of claim 1, wherein the bathroom surface includes a magnetic stopper.

7. The magnetic cleaning system of claim 1, further comprising:

a magnetic guide path on the bathroom surface for guiding the robot cleaning device.

8. The magnetic cleaning system of claim 7, wherein the magnetic guide path magnetically holds the robot cleaning device against the bathroom surface.

9. The magnetic cleaning system of claim 7, wherein the magnetic guide path magnetically steers the robot cleaning device.

10. The magnetic cleaning system of claim 1, wherein the surface includes one or more patterns formed from internal ferrous particles.

11. A magnetic cleaning system comprising:

a shower including a vertical shower wall and a drain;

a cleaning device including at least one rotator wheel and at least one driven magnet, wherein the rotator wheel provides a rotational force to a scrubbing brush, wherein the driven magnet provides a translational force to the cleaning device;

a driving device including at least one driving magnet positioned to attract the driven magnet and guide the cleaning device to traverse the vertical shower wall and clean the vertical shower wall with the scrubbing brush; and a docking station integrated with the drain of the shower and configured to couple with the robot cleaning device.

12. The magnetic cleaning system of claim 11, wherein the cleaning device comprises:

a longitudinal gear driven by friction; and a ring gear coupled to the scrubbing brush and driven by the longitudinal gear to provide the rotational force to the scrubbing brush.

13. The magnetic cleaning system of claim 11, wherein the driving device includes a handle.

14. A magnetic cleaning system comprising:

a shower including a drain and a vertical shower wall a robot cleaning device configured to traverse the vertical shower wall;

a docking station integrated with the drain of the shower and configured to couple with the robot cleaning device; and a magnetic guide path on the vertical shower wall for guiding the robot cleaning device.

* * * * *